US009721436B2

(12) United States Patent
Itagaki et al.

(10) Patent No.: US 9,721,436 B2
(45) Date of Patent: Aug. 1, 2017

(54) GAMING MACHINE EXECUTING FREE GAME SHIFTED FROM NORMAL GAME AND METHOD OF CONTROLLING SAME

(71) Applicants: Universal Entertainment Corporation, Tokyo (JP); Aruze Gaming America, Inc., Las Vegas, NV (US)

(72) Inventors: Takehisa Itagaki, Tokyo (JP); Masahiro Yoshida, Tokyo (JP); Yukihiro Kawakami, Tokyo (JP); Hiromoto Yamauchi, Tokyo (JP); Hiroshi Takahashi, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 129 days.

(21) Appl. No.: 14/484,409

(22) Filed: Sep. 12, 2014

(65) Prior Publication Data

US 2015/0087388 A1 Mar. 26, 2015

(30) Foreign Application Priority Data

Sep. 20, 2013 (JP) ..... 2013-195655

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3213* (2013.01); *G07F 17/3251* (2013.01); *G07F 17/3258* (2013.01); *G07F 17/3267* (2013.01)

(58) Field of Classification Search

CPC ... G07F 17/3265; G07F 17/3267; G07F 17/34

See application file for complete search history.

(56) References Cited

U.S. PATENT DOCUMENTS

| | | | |
|---|---|---|---|
| 6,604,999 | B2 | 8/2003 | Ainsworth |
| 2002/0065124 | A1 | 5/2002 | Ainsworth |

(Continued)

FOREIGN PATENT DOCUMENTS

| | | |
|---|---|---|
| CN | 1846237 | 10/2006 |
| CN | 101163526 | 4/2008 |
| CN | 103250190 | 8/2013 |

OTHER PUBLICATIONS

The Office Action and Search Report, Macau State Intellectual Property Office of the P.R.C, Oct. 9, 2015, MO Patent Application No. I/001340.

*Primary Examiner* — Steve Rowland

(74) *Attorney, Agent, or Firm* — Lex IP Meister, PLLC

(57) ABSTRACT

When a normal game is executed and a benefit awarded as a result of the game is the right to execute a free game, video reel groups of types A to E are randomly associated with first to fifth video reels 3*a* to 3*e*, respectively, a player selects one of the first to fifth video reels 3*a* to 3*e*, the type of the video reel group associated with the selected video reel is set as a video reel 3 used in the free game, and the free game is executed by using the selected video reel 3. After the free game is executed 6 times, whether to award the right to execute the free game again is randomly determined, and the right to execute the free game 6 times is awarded if it is determined that the right to execute the free game is awarded.

9 Claims, 84 Drawing Sheets

(56) References Cited

U.S. PATENT DOCUMENTS

| | | | | |
|---|---|---|---|---|
| 2004/0038729 | A1* | 2/2004 | Webb | G07F 17/3267 463/20 |
| 2004/0053676 | A1 | 3/2004 | Rodgers | |
| 2004/0053683 | A1* | 3/2004 | Hartl | G07F 17/32 463/25 |
| 2005/0143165 | A1* | 6/2005 | Berman | G07F 17/32 463/20 |
| 2008/0176627 | A1 | 7/2008 | Lardie | |
| 2009/0131145 | A1* | 5/2009 | Aoki | G07F 17/3211 463/20 |
| 2010/0035674 | A1 | 2/2010 | Slomiany | |
| 2010/0124969 | A1 | 5/2010 | Hughes | |
| 2011/0111824 | A1* | 5/2011 | Cuddy | G07F 17/3239 463/20 |
| 2012/0115565 | A1 | 5/2012 | Schwerdling | |
| 2012/0172106 | A1 | 7/2012 | Caputo et al. | |
| 2012/0270633 | A1* | 10/2012 | Jackson | G07F 17/34 463/20 |
| 2014/0094250 | A1* | 4/2014 | Inamura | G07F 17/34 463/20 |
| 2014/0094260 | A1* | 4/2014 | Cuddy | G07F 17/3239 463/20 |

* cited by examiner

FIG.7

REEL STRIPS IN NORMAL GAME

| CODE NUMBERS | REEL1 | REEL2 | REEL3 | REEL4 | REEL5 |
|---|---|---|---|---|---|
| 0 | R-MERMAID | Y-MERMAID | P-MERMAID | G-MERMAID | B-MERMAID |
| 1 | R-MERMAID | Y-MERMAID | P-MERMAID | G-MERMAID | B-MERMAID |
| 2 | R-MERMAID | Y-MERMAID | P-MERMAID | G-MERMAID | B-MERMAID |
| 3 | R-MERMAID | Y-MERMAID | P-MERMAID | G-MERMAID | B-MERMAID |
| 4 | S-FISH | WILD | FEATURE | FEATURE | O-FISH |
| 5 | S-FISH | B-FISH | R-CORAL | Y-FISH | O-FISH |
| 6 | S-FISH | B-FISH | R-CORAL | Y-FISH | O-FISH |
| 7 | S-FISH | B-FISH | R-CORAL | Y-FISH | O-FISH |
| 8 | Y-MERMAID | B-FISH | R-CORAL | Y-FISH | G-MERMAID |
| 9 | Y-MERMAID | FEATURE | WILD | WILD | G-MERMAID |
| 10 | Y-MERMAID | P-MERMAID | B-MERMAID | Y-MERMAID | G-MERMAID |
| 11 | Y-MERMAID | P-MERMAID | B-MERMAID | Y-MERMAID | G-MERMAID |
| 12 | Y-MERMAID | P-MERMAID | B-MERMAID | Y-MERMAID | B-FISH |
| 13 | Y-MERMAID | P-MERMAID | B-MERMAID | Y-MERMAID | B-FISH |
| 14 | Y-MERMAID | WILD | FEATURE | FEATURE | B-FISH |
| 15 | Y-MERMAID | S-FISH | Y-FISH | O-FISH | B-FISH |
| 16 | Y-FISH | S-FISH | Y-FISH | O-FISH | P-MERMAID |
| 17 | Y-FISH | S-FISH | Y-FISH | O-FISH | P-MERMAID |
| 18 | Y-FISH | S-FISH | Y-FISH | O-FISH | P-MERMAID |
| 19 | Y-FISH | FEATURE | WILD | WILD | P-MERMAID |
| 20 | P-MERMAID | B-MERMAID | Y-MERMAID | P-MERMAID | Y-FISH |
| 21 | P-MERMAID | B-MERMAID | Y-MERMAID | P-MERMAID | Y-FISH |
| 22 | P-MERMAID | B-MERMAID | Y-MERMAID | P-MERMAID | Y-FISH |
| 23 | P-MERMAID | B-MERMAID | Y-MERMAID | P-MERMAID | Y-FISH |
| 24 | Y-CORAL | FEATURE | FEATURE | FEATURE | WILD |
| 25 | Y-CORAL | O-FISH | S-FISH | B-FISH | WILD |
| 26 | Y-CORAL | O-FISH | S-FISH | B-FISH | WILD |
| 27 | Y-CORAL | O-FISH | S-FISH | B-FISH | WILD |
| 28 | R-MERMAID | O-FISH | S-FISH | B-FISH | R-MERMAID |
| 29 | R-MERMAID | WILD | WILD | WILD | R-MERMAID |
| 30 | R-MERMAID | WILD | WILD | WILD | R-MERMAID |
| 31 | R-MERMAID | WILD | WILD | WILD | R-MERMAID |
| 32 | R-MERMAID | WILD | WILD | WILD | R-MERMAID |
| 33 | R-MERMAID | R-MERMAID | R-MERMAID | R-MERMAID | R-MERMAID |
| 34 | R-MERMAID | R-MERMAID | R-MERMAID | R-MERMAID | R-MERMAID |
| 35 | R-MERMAID | R-MERMAID | R-MERMAID | R-MERMAID | R-MERMAID |
| 36 | Y-FISH | R-MERMAID | R-MERMAID | R-MERMAID | WILD |
| 37 | Y-FISH | R-MERMAID | R-MERMAID | R-MERMAID | O-FISH |
| 38 | Y-FISH | R-MERMAID | R-MERMAID | R-MERMAID | O-FISH |
| 39 | Y-FISH | R-MERMAID | R-MERMAID | R-MERMAID | O-FISH |
| 40 | G-MERMAID | R-MERMAID | R-MERMAID | R-MERMAID | O-FISH |

FIG.8

REEL STRIPS IN NORMAL GAME

| CODE NUMBERS | REEL1 | REEL2 | REEL3 | REEL4 | REEL5 |
|---|---|---|---|---|---|
| 41 | G-MERMAID | WILD | WILD | WILD | WILD |
| 42 | G-MERMAID | R-CORAL | B-FISH | S-FISH | Y-MERMAID |
| 43 | G-MERMAID | R-CORAL | B-FISH | S-FISH | Y-MERMAID |
| 44 | G-MERMAID | R-CORAL | B-FISH | S-FISH | Y-MERMAID |
| 45 | G-MERMAID | R-CORAL | B-FISH | S-FISH | Y-MERMAID |
| 46 | G-MERMAID | FEATURE | FEATURE | FEATURE | Y-MERMAID |
| 47 | G-MERMAID | P-MERMAID | G-MERMAID | P-MERMAID | Y-MERMAID |
| 48 | R-CORAL | P-MERMAID | G-MERMAID | P-MERMAID | Y-MERMAID |
| 49 | R-CORAL | P-MERMAID | G-MERMAID | P-MERMAID | Y-MERMAID |
| 50 | R-CORAL | P-MERMAID | G-MERMAID | P-MERMAID | WILD |
| 51 | R-CORAL | P-MERMAID | G-MERMAID | P-MERMAID | Y-CORAL |
| 52 | B-MERMAID | P-MERMAID | G-MERMAID | P-MERMAID | Y-CORAL |
| 53 | B-MERMAID | P-MERMAID | G-MERMAID | P-MERMAID | Y-CORAL |
| 54 | B-MERMAID | P-MERMAID | G-MERMAID | P-MERMAID | Y-CORAL |
| 55 | B-MERMAID | WILD | WILD | WILD | WILD |
| 56 | B-MERMAID | Y-CORAL | O-FISH | Y-FISH | B-MERMAID |
| 57 | B-MERMAID | Y-CORAL | O-FISH | Y-FISH | B-MERMAID |
| 58 | B-MERMAID | Y-CORAL | O-FISH | Y-FISH | B-MERMAID |
| 59 | B-MERMAID | Y-CORAL | O-FISH | Y-FISH | B-MERMAID |
| 60 | O-FISH | FEATURE | FEATURE | FEATURE | B-MERMAID |
| 61 | O-FISH | Y-MERMAID | B-MERMAID | G-MERMAID | B-MERMAID |
| 62 | O-FISH | Y-MERMAID | B-MERMAID | G-MERMAID | B-MERMAID |
| 63 | O-FISH | Y-MERMAID | B-MERMAID | G-MERMAID | B-MERMAID |
| 64 | Y-MERMAID | Y-MERMAID | B-MERMAID | G-MERMAID | WILD |
| 65 | Y-MERMAID | Y-MERMAID | B-MERMAID | G-MERMAID | R-CORAL |
| 66 | Y-MERMAID | Y-MERMAID | B-MERMAID | G-MERMAID | R-CORAL |
| 67 | Y-MERMAID | Y-MERMAID | B-MERMAID | G-MERMAID | R-CORAL |
| 68 | B-FISH | Y-MERMAID | B-MERMAID | G-MERMAID | R-CORAL |
| 69 | B-FISH | WILD | WILD | WILD | WILD |
| 70 | B-FISH | O-FISH | B-FISH | S-FISH | G-MERMAID |
| 71 | B-FISH | O-FISH | B-FISH | S-FISH | G-MERMAID |
| 72 | B-MERMAID | O-FISH | B-FISH | S-FISH | G-MERMAID |
| 73 | B-MERMAID | O-FISH | B-FISH | S-FISH | G-MERMAID |
| 74 | B-MERMAID | G-MERMAID | FEATURE | FEATURE | G-MERMAID |
| 75 | B-MERMAID | G-MERMAID | Y-MERMAID | B-MERMAID | G-MERMAID |
| 76 | Y-CORAL | G-MERMAID | Y-MERMAID | B-MERMAID | G-MERMAID |
| 77 | Y-CORAL | G-MERMAID | Y-MERMAID | B-MERMAID | G-MERMAID |
| 78 | Y-CORAL | WILD | Y-MERMAID | B-MERMAID | WILD |
| 79 | Y-CORAL | R-CORAL | Y-MERMAID | R-CORAL | Y-FISH |
| 80 | P-MERMAID | R-CORAL | Y-MERMAID | R-CORAL | Y-FISH |

FIG.9

REEL STRIPS IN NORMAL GAME

| CODE NUMBERS | REEL1 | REEL2 | REEL3 | REEL4 | REEL5 |
|---|---|---|---|---|---|
| 82 | P-MERMAID | R-CORAL | Y-MERMAID | R-CORAL | Y-FISH |
| 83 | P-MERMAID | FEATURE | WILD | WILD | Y-MERMAID |
| 84 | P-MERMAID | B-MERMAID | R-CORAL | Y-MERMAID | Y-MERMAID |
| 85 | P-MERMAID | B-MERMAID | R-CORAL | Y-MERMAID | Y-MERMAID |
| 86 | P-MERMAID | B-MERMAID | R-CORAL | Y-MERMAID | Y-MERMAID |
| 87 | P-MERMAID | B-MERMAID | R-CORAL | Y-MERMAID | B-FISH |
| 88 | O-FISH | B-MERMAID | G-MERMAID | Y-MERMAID | B-FISH |
| 89 | O-FISH | B-MERMAID | G-MERMAID | Y-MERMAID | B-FISH |
| 90 | O-FISH | B-MERMAID | G-MERMAID | Y-MERMAID | B-FISH |
| 91 | O-FISH | B-MERMAID | G-MERMAID | Y-MERMAID | WILD |
| 92 | G-MERMAID | WILD | WILD | WILD | P-MERMAID |
| 93 | G-MERMAID | S-FISH | Y-CORAL | Y-CORAL | P-MERMAID |
| 94 | G-MERMAID | S-FISH | Y-CORAL | Y-CORAL | P-MERMAID |
| 95 | G-MERMAID | S-FISH | Y-CORAL | Y-CORAL | P-MERMAID |
| 96 | R-CORAL | S-FISH | Y-CORAL | Y-CORAL | P-MERMAID |
| 97 | R-CORAL | FEATURE | FEATURE | WILD | P-MERMAID |
| 98 | R-CORAL | G-MERMAID | P-MERMAID | B-MERMAID | P-MERMAID |
| 99 | R-CORAL | G-MERMAID | P-MERMAID | B-MERMAID | P-MERMAID |
| 100 | | G-MERMAID | P-MERMAID | B-MERMAID | WILD |
| 101 | | G-MERMAID | P-MERMAID | B-MERMAID | S-FISH |
| 102 | | G-MERMAID | P-MERMAID | B-MERMAID | S-FISH |
| 103 | | G-MERMAID | P-MERMAID | B-MERMAID | S-FISH |
| 104 | | G-MERMAID | P-MERMAID | B-MERMAID | S-FISH |
| 105 | | G-MERMAID | P-MERMAID | B-MERMAID | WILD |
| 106 | | WILD | WILD | WILD | WILD |
| 107 | | Y-FISH | Y-CORAL | B-FISH | WILD |
| 108 | | Y-FISH | Y-CORAL | B-FISH | WILD |
| 109 | | Y-FISH | Y-CORAL | B-FISH | R-MERMAID |
| 110 | | Y-FISH | Y-CORAL | B-FISH | R-MERMAID |
| 111 | | WILD | WILD | WILD | R-MERMAID |
| 112 | | WILD | WILD | WILD | R-MERMAID |
| 113 | | WILD | WILD | WILD | S-FISH |
| 114 | | WILD | WILD | WILD | S-FISH |
| 115 | | R-MERMAID | R-MERMAID | R-MERMAID | S-FISH |
| 116 | | R-MERMAID | R-MERMAID | R-MERMAID | S-FISH |
| 117 | | R-MERMAID | R-MERMAID | R-MERMAID | |
| 118 | | R-MERMAID | R-MERMAID | R-MERMAID | |
| 119 | | R-CORAL | S-FISH | O-FISH | |
| 120 | | R-CORAL | S-FISH | O-FISH | |

FIG.10

REEL STRIPS IN NORMAL GAME

| CODE NUMBERS | REEL1 | REEL2 | REEL3 | REEL4 | REEL5 |
|---|---|---|---|---|---|
| 121 | | Y-CORAL | S-FISH | O-FISH | |
| 122 | | Y-CORAL | S-FISH | O-FISH | |
| 123 | | FEATURE | WILD | WILD | |
| 124 | | | | | |
| 125 | | | | | |
| 126 | | | | | |
| 127 | | | | | |
| 128 | | | | | |
| 129 | | | | | |
| 130 | | | | | |
| 131 | | | | | |
| 132 | | | | | |
| 133 | | | | | |
| 134 | | | | | |
| 135 | | | | | |
| 136 | | | | | |
| 137 | | | | | |
| 138 | | | | | |
| 139 | | | | | |
| 140 | | | | | |
| 141 | | | | | |
| 142 | | | | | |
| 143 | | | | | |
| 144 | | | | | |
| 145 | | | | | |
| 146 | | | | | |
| 147 | | | | | |
| 148 | | | | | |
| 149 | | | | | |
| 150 | | | | | |

FIG.11

FREE GAME TYPE A

| CODE NUMBERS | REEL1 | REEL2 | REEL3 | REEL4 | REEL5 |
|---|---|---|---|---|---|
| 0 | R-MERMAID | R-MERMAID | R-MERMAID | R-MERMAID | R-MERMAID |
| 1 | R-MERMAID | R-MERMAID | R-MERMAID | R-MERMAID | R-MERMAID |
| 2 | R-MERMAID | R-MERMAID | R-MERMAID | R-MERMAID | R-MERMAID |
| 3 | R-MERMAID | R-MERMAID | R-MERMAID | R-MERMAID | R-MERMAID |
| 4 | R-MERMAID | R-MERMAID | R-MERMAID | R-MERMAID | R-MERMAID |
| 5 | R-MERMAID | R-MERMAID | R-MERMAID | R-MERMAID | R-MERMAID |
| 6 | R-MERMAID | R-MERMAID | R-MERMAID | R-MERMAID | R-MERMAID |
| 7 | R-MERMAID | R-MERMAID | R-MERMAID | R-MERMAID | R-MERMAID |
| 8 | R-MERMAID | R-MERMAID | R-MERMAID | R-MERMAID | R-MERMAID |
| 9 | R-MERMAID | R-MERMAID | R-MERMAID | R-MERMAID | R-MERMAID |
| 10 | R-MERMAID | R-MERMAID | R-MERMAID | R-MERMAID | R-MERMAID |
| 11 | R-MERMAID | R-MERMAID | R-MERMAID | R-MERMAID | R-MERMAID |
| 12 | R-MERMAID | R-MERMAID | R-MERMAID | R-MERMAID | R-MERMAID |
| 13 | R-MERMAID | R-MERMAID | R-MERMAID | R-MERMAID | R-MERMAID |
| 14 | R-MERMAID | R-MERMAID | R-MERMAID | R-MERMAID | R-MERMAID |
| 15 | R-MERMAID | R-MERMAID | R-MERMAID | R-MERMAID | R-MERMAID |
| 16 | R-MERMAID | R-MERMAID | R-MERMAID | R-MERMAID | R-MERMAID |
| 17 | R-MERMAID | R-MERMAID | R-MERMAID | R-MERMAID | R-MERMAID |
| 18 | R-MERMAID | R-MERMAID | R-MERMAID | R-MERMAID | R-MERMAID |
| 19 | R-MERMAID | R-MERMAID | R-MERMAID | R-MERMAID | R-MERMAID |
| 20 | R-MERMAID | R-MERMAID | R-MERMAID | R-MERMAID | R-MERMAID |
| 21 | R-MERMAID | R-MERMAID | R-MERMAID | R-MERMAID | R-MERMAID |
| 22 | R-MERMAID | R-MERMAID | R-MERMAID | R-MERMAID | R-MERMAID |
| 23 | R-MERMAID | R-MERMAID | R-MERMAID | R-MERMAID | R-MERMAID |
| 24 | R-MERMAID | R-MERMAID | R-MERMAID | R-MERMAID | R-MERMAID |
| 25 | R-MERMAID | R-MERMAID | R-MERMAID | R-MERMAID | R-MERMAID |
| 26 | R-MERMAID | R-MERMAID | R-MERMAID | R-MERMAID | R-MERMAID |
| 27 | R-MERMAID | R-MERMAID | R-MERMAID | R-MERMAID | R-MERMAID |
| 28 | R-MERMAID | R-MERMAID | R-MERMAID | R-MERMAID | R-MERMAID |
| 29 | R-MERMAID | R-MERMAID | R-MERMAID | R-MERMAID | R-MERMAID |
| 30 | R-MERMAID | R-MERMAID | R-MERMAID | R-MERMAID | R-MERMAID |
| 31 | R-MERMAID | R-MERMAID | R-MERMAID | R-MERMAID | R-MERMAID |
| 32 | R-CORAL | Y-FISH | Y-FISH | Y-FISH | Y-FISH |
| 33 | R-CORAL | Y-FISH | Y-FISH | Y-FISH | Y-FISH |
| 34 | R-CORAL | Y-FISH | Y-FISH | Y-FISH | Y-FISH |
| 35 | R-CORAL | Y-FISH | Y-FISH | Y-FISH | Y-FISH |
| 36 | Y-CORAL | S-FISH | S-FISH | S-FISH | O-FISH |
| 37 | Y-CORAL | S-FISH | S-FISH | S-FISH | O-FISH |
| 38 | Y-CORAL | S-FISH | S-FISH | S-FISH | O-FISH |
| 39 | Y-CORAL | S-FISH | S-FISH | S-FISH | O-FISH |
| 40 | Y-FISH | Y-CORAL | Y-CORAL | Y-CORAL | B-FISH |

FIG.12

FREE GAME TYPE A

| | | | | | |
|---|---|---|---|---|---|
| 41 | Y-FISH | Y-CORAL | Y-CORAL | Y-CORAL | B-FISH |
| 42 | Y-FISH | Y-CORAL | Y-CORAL | Y-CORAL | B-FISH |
| 43 | Y-FISH | Y-CORAL | Y-CORAL | Y-CORAL | B-FISH |
| 44 | O-FISH | R-CORAL | R-CORAL | R-CORAL | S-FISH |
| 45 | O-FISH | R-CORAL | R-CORAL | R-CORAL | S-FISH |
| 46 | O-FISH | R-CORAL | R-CORAL | R-CORAL | S-FISH |
| 47 | O-FISH | R-CORAL | R-CORAL | R-CORAL | S-FISH |
| 48 | B-FISH | O-FISH | O-FISH | O-FISH | R-CORAL |
| 49 | B-FISH | O-FISH | O-FISH | O-FISH | R-CORAL |
| 50 | B-FISH | O-FISH | O-FISH | O-FISH | R-CORAL |
| 51 | B-FISH | O-FISH | O-FISH | O-FISH | R-CORAL |
| 52 | S-FISH | B-FISH | B-FISH | B-FISH | Y-CORAL |
| 53 | S-FISH | B-FISH | B-FISH | B-FISH | Y-CORAL |
| 54 | S-FISH | B-FISH | B-FISH | B-FISH | Y-CORAL |
| 55 | S-FISH | B-FISH | B-FISH | B-FISH | Y-CORAL |
| 56 | R-CORAL | Y-CORAL | Y-CORAL | Y-CORAL | Y-FISH |
| 57 | R-CORAL | Y-CORAL | Y-CORAL | Y-CORAL | Y-FISH |
| 58 | R-CORAL | Y-CORAL | Y-CORAL | Y-CORAL | Y-FISH |
| 59 | R-CORAL | Y-CORAL | Y-CORAL | Y-CORAL | Y-FISH |
| 60 | Y-CORAL | O-FISH | O-FISH | O-FISH | O-FISH |
| 61 | Y-CORAL | O-FISH | O-FISH | O-FISH | O-FISH |
| 62 | Y-CORAL | O-FISH | O-FISH | O-FISH | O-FISH |
| 63 | Y-CORAL | O-FISH | O-FISH | O-FISH | O-FISH |
| 64 | | R-CORAL | R-CORAL | R-CORAL | B-FISH |
| 65 | | R-CORAL | R-CORAL | R-CORAL | B-FISH |
| 66 | | R-CORAL | R-CORAL | R-CORAL | B-FISH |
| 67 | | R-CORAL | R-CORAL | R-CORAL | B-FISH |
| 68 | | S-FISH | S-FISH | S-FISH | |
| 69 | | S-FISH | S-FISH | S-FISH | |
| 70 | | S-FISH | S-FISH | S-FISH | |
| 71 | | S-FISH | S-FISH | S-FISH | |
| 72 | | B-FISH | B-FISH | B-FISH | |
| 73 | | B-FISH | B-FISH | B-FISH | |
| 74 | | B-FISH | B-FISH | B-FISH | |
| 75 | | B-FISH | B-FISH | B-FISH | |
| 76 | | Y-FISH | Y-FISH | Y-FISH | |
| 77 | | Y-FISH | Y-FISH | Y-FISH | |
| 78 | | Y-FISH | Y-FISH | Y-FISH | |
| 79 | | Y-FISH | Y-FISH | Y-FISH | |
| 80 | | | | | |

FIG.13

FREE GAME TYPE B

| CODE NUMBERS | REEL1 | REEL2 | REEL3 | REEL4 | REEL5 |
|---|---|---|---|---|---|
| 0 | P-MERMAID | P-MERMAID | P-MERMAID | P-MERMAID | P-MERMAID |
| 1 | P-MERMAID | P-MERMAID | P-MERMAID | P-MERMAID | P-MERMAID |
| 2 | P-MERMAID | P-MERMAID | P-MERMAID | P-MERMAID | P-MERMAID |
| 3 | P-MERMAID | P-MERMAID | P-MERMAID | P-MERMAID | P-MERMAID |
| 4 | P-MERMAID | P-MERMAID | P-MERMAID | P-MERMAID | P-MERMAID |
| 5 | P-MERMAID | P-MERMAID | P-MERMAID | P-MERMAID | P-MERMAID |
| 6 | P-MERMAID | P-MERMAID | P-MERMAID | P-MERMAID | P-MERMAID |
| 7 | P-MERMAID | P-MERMAID | P-MERMAID | P-MERMAID | P-MERMAID |
| 8 | P-MERMAID | P-MERMAID | P-MERMAID | P-MERMAID | P-MERMAID |
| 9 | P-MERMAID | P-MERMAID | P-MERMAID | P-MERMAID | P-MERMAID |
| 10 | P-MERMAID | P-MERMAID | P-MERMAID | P-MERMAID | P-MERMAID |
| 11 | P-MERMAID | P-MERMAID | P-MERMAID | P-MERMAID | P-MERMAID |
| 12 | P-MERMAID | P-MERMAID | P-MERMAID | P-MERMAID | P-MERMAID |
| 13 | P-MERMAID | P-MERMAID | P-MERMAID | P-MERMAID | P-MERMAID |
| 14 | P-MERMAID | P-MERMAID | P-MERMAID | P-MERMAID | P-MERMAID |
| 15 | P-MERMAID | P-MERMAID | P-MERMAID | P-MERMAID | P-MERMAID |
| 16 | P-MERMAID | P-MERMAID | P-MERMAID | P-MERMAID | P-MERMAID |
| 17 | P-MERMAID | P-MERMAID | P-MERMAID | P-MERMAID | P-MERMAID |
| 18 | P-MERMAID | P-MERMAID | P-MERMAID | P-MERMAID | P-MERMAID |
| 19 | P-MERMAID | P-MERMAID | P-MERMAID | P-MERMAID | P-MERMAID |
| 20 | P-MERMAID | P-MERMAID | P-MERMAID | P-MERMAID | P-MERMAID |
| 21 | P-MERMAID | P-MERMAID | P-MERMAID | P-MERMAID | P-MERMAID |
| 22 | P-MERMAID | P-MERMAID | P-MERMAID | P-MERMAID | P-MERMAID |
| 23 | P-MERMAID | P-MERMAID | P-MERMAID | P-MERMAID | P-MERMAID |
| 24 | P-MERMAID | P-MERMAID | P-MERMAID | P-MERMAID | P-MERMAID |
| 25 | P-MERMAID | P-MERMAID | P-MERMAID | P-MERMAID | P-MERMAID |
| 26 | P-MERMAID | P-MERMAID | P-MERMAID | P-MERMAID | P-MERMAID |
| 27 | P-MERMAID | P-MERMAID | P-MERMAID | P-MERMAID | P-MERMAID |
| 28 | P-MERMAID | P-MERMAID | P-MERMAID | P-MERMAID | P-MERMAID |
| 29 | P-MERMAID | P-MERMAID | P-MERMAID | P-MERMAID | P-MERMAID |
| 30 | P-MERMAID | P-MERMAID | P-MERMAID | P-MERMAID | P-MERMAID |
| 31 | P-MERMAID | P-MERMAID | P-MERMAID | P-MERMAID | P-MERMAID |
| 32 | Y-FISH | Y-FISH | Y-FISH | Y-FISH | Y-FISH |
| 33 | Y-FISH | Y-FISH | Y-FISH | Y-FISH | Y-FISH |
| 34 | Y-FISH | Y-FISH | Y-FISH | Y-FISH | Y-FISH |
| 35 | Y-FISH | Y-FISH | Y-FISH | Y-FISH | Y-FISH |
| 36 | S-FISH | S-FISH | S-FISH | S-FISH | O-FISH |
| 37 | S-FISH | S-FISH | S-FISH | S-FISH | O-FISH |
| 38 | S-FISH | S-FISH | S-FISH | S-FISH | O-FISH |
| 39 | S-FISH | S-FISH | S-FISH | S-FISH | O-FISH |
| 40 | Y-CORAL | Y-CORAL | WILD | Y-CORAL | B-FISH |

FIG.14

FREE GAME TYPE B

| | | | | | |
|---|---|---|---|---|---|
| 41 | Y-FISH | Y-CORAL | Y-CORAL | Y-CORAL | B-FISH |
| 42 | Y-FISH | Y-CORAL | Y-CORAL | Y-CORAL | B-FISH |
| 43 | Y-FISH | Y-CORAL | Y-CORAL | Y-CORAL | B-FISH |
| 44 | O-FISH | R-CORAL | R-CORAL | R-CORAL | S-FISH |
| 45 | O-FISH | R-CORAL | R-CORAL | R-CORAL | S-FISH |
| 46 | O-FISH | R-CORAL | R-CORAL | R-CORAL | S-FISH |
| 47 | O-FISH | R-CORAL | R-CORAL | R-CORAL | S-FISH |
| 48 | B-FISH | O-FISH | O-FISH | O-FISH | R-CORAL |
| 49 | B-FISH | O-FISH | O-FISH | O-FISH | R-CORAL |
| 50 | B-FISH | O-FISH | O-FISH | O-FISH | R-CORAL |
| 51 | B-FISH | O-FISH | O-FISH | O-FISH | R-CORAL |
| 52 | S-FISH | B-FISH | B-FISH | B-FISH | Y-CORAL |
| 53 | S-FISH | B-FISH | B-FISH | B-FISH | Y-CORAL |
| 54 | S-FISH | B-FISH | B-FISH | B-FISH | Y-CORAL |
| 55 | S-FISH | B-FISH | B-FISH | B-FISH | Y-CORAL |
| 56 | R-CORAL | Y-CORAL | Y-CORAL | Y-CORAL | Y-FISH |
| 57 | R-CORAL | Y-CORAL | Y-CORAL | Y-CORAL | Y-FISH |
| 58 | R-CORAL | Y-CORAL | Y-CORAL | Y-CORAL | Y-FISH |
| 59 | R-CORAL | Y-CORAL | Y-CORAL | Y-CORAL | Y-FISH |
| 60 | Y-CORAL | O-FISH | O-FISH | O-FISH | O-FISH |
| 61 | Y-CORAL | O-FISH | O-FISH | O-FISH | O-FISH |
| 62 | Y-CORAL | O-FISH | O-FISH | O-FISH | O-FISH |
| 63 | Y-CORAL | O-FISH | O-FISH | O-FISH | O-FISH |
| 64 | | R-CORAL | R-CORAL | R-CORAL | B-FISH |
| 65 | | R-CORAL | R-CORAL | R-CORAL | B-FISH |
| 66 | | R-CORAL | R-CORAL | R-CORAL | B-FISH |
| 67 | | R-CORAL | R-CORAL | R-CORAL | B-FISH |
| 68 | | S-FISH | S-FISH | S-FISH | |
| 69 | | S-FISH | S-FISH | S-FISH | |
| 70 | | S-FISH | S-FISH | S-FISH | |
| 71 | | S-FISH | S-FISH | S-FISH | |
| 72 | | B-FISH | B-FISH | B-FISH | |
| 73 | | B-FISH | B-FISH | B-FISH | |
| 74 | | B-FISH | B-FISH | B-FISH | |
| 75 | | B-FISH | B-FISH | B-FISH | |
| 76 | | Y-FISH | Y-FISH | Y-FISH | |
| 77 | | Y-FISH | Y-FISH | Y-FISH | |
| 78 | | Y-FISH | Y-FISH | Y-FISH | |
| 79 | | Y-FISH | Y-FISH | Y-FISH | |
| 80 | | | | | |

FIG.15

FREE GAME TYPE C

| CODE NUMBERS | REEL1 | REEL2 | REEL3 | REEL4 | REEL5 |
|---|---|---|---|---|---|
| 0 | Y-MERMAID | Y-MERMAID | Y-MERMAID | Y-MERMAID | Y-MERMAID |
| 1 | Y-MERMAID | Y-MERMAID | Y-MERMAID | Y-MERMAID | Y-MERMAID |
| 2 | Y-MERMAID | Y-MERMAID | Y-MERMAID | Y-MERMAID | Y-MERMAID |
| 3 | Y-MERMAID | Y-MERMAID | Y-MERMAID | Y-MERMAID | Y-MERMAID |
| 4 | Y-MERMAID | Y-MERMAID | Y-MERMAID | Y-MERMAID | Y-MERMAID |
| 5 | Y-MERMAID | Y-MERMAID | Y-MERMAID | Y-MERMAID | Y-MERMAID |
| 6 | Y-MERMAID | Y-MERMAID | Y-MERMAID | Y-MERMAID | Y-MERMAID |
| 7 | Y-MERMAID | Y-MERMAID | Y-MERMAID | Y-MERMAID | Y-MERMAID |
| 8 | Y-MERMAID | Y-MERMAID | Y-MERMAID | Y-MERMAID | Y-MERMAID |
| 9 | Y-MERMAID | Y-MERMAID | Y-MERMAID | Y-MERMAID | Y-MERMAID |
| 10 | Y-MERMAID | Y-MERMAID | Y-MERMAID | Y-MERMAID | Y-MERMAID |
| 11 | Y-MERMAID | Y-MERMAID | Y-MERMAID | Y-MERMAID | Y-MERMAID |
| 12 | Y-MERMAID | Y-MERMAID | Y-MERMAID | Y-MERMAID | Y-MERMAID |
| 13 | Y-MERMAID | Y-MERMAID | Y-MERMAID | Y-MERMAID | Y-MERMAID |
| 14 | Y-MERMAID | Y-MERMAID | Y-MERMAID | Y-MERMAID | Y-MERMAID |
| 15 | Y-MERMAID | Y-MERMAID | Y-MERMAID | Y-MERMAID | Y-MERMAID |
| 16 | Y-MERMAID | Y-MERMAID | Y-MERMAID | Y-MERMAID | Y-MERMAID |
| 17 | Y-MERMAID | Y-MERMAID | Y-MERMAID | Y-MERMAID | Y-MERMAID |
| 18 | Y-MERMAID | Y-MERMAID | Y-MERMAID | Y-MERMAID | Y-MERMAID |
| 19 | Y-MERMAID | Y-MERMAID | Y-MERMAID | Y-MERMAID | Y-MERMAID |
| 20 | Y-MERMAID | Y-MERMAID | Y-MERMAID | Y-MERMAID | Y-MERMAID |
| 21 | Y-MERMAID | Y-MERMAID | Y-MERMAID | Y-MERMAID | Y-MERMAID |
| 22 | Y-MERMAID | Y-MERMAID | Y-MERMAID | Y-MERMAID | Y-MERMAID |
| 23 | Y-MERMAID | Y-MERMAID | Y-MERMAID | Y-MERMAID | Y-MERMAID |
| 24 | Y-MERMAID | Y-MERMAID | Y-MERMAID | Y-MERMAID | Y-MERMAID |
| 25 | Y-MERMAID | Y-MERMAID | Y-MERMAID | Y-MERMAID | Y-MERMAID |
| 26 | Y-MERMAID | Y-MERMAID | Y-MERMAID | Y-MERMAID | Y-MERMAID |
| 27 | Y-MERMAID | Y-MERMAID | Y-MERMAID | Y-MERMAID | Y-MERMAID |
| 28 | Y-MERMAID | Y-MERMAID | Y-MERMAID | Y-MERMAID | Y-MERMAID |
| 29 | Y-MERMAID | Y-MERMAID | Y-MERMAID | Y-MERMAID | Y-MERMAID |
| 30 | Y-MERMAID | Y-MERMAID | Y-MERMAID | Y-MERMAID | Y-MERMAID |
| 31 | Y-MERMAID | Y-MERMAID | Y-MERMAID | Y-MERMAID | Y-MERMAID |
| 32 | Y-FISH | Y-FISH | Y-FISH | Y-FISH | Y-FISH |
| 33 | Y-FISH | Y-FISH | Y-FISH | Y-FISH | Y-FISH |
| 34 | Y-FISH | Y-FISH | Y-FISH | Y-FISH | Y-FISH |
| 35 | Y-FISH | Y-FISH | Y-FISH | Y-FISH | Y-FISH |
| 36 | S-FISH | S-FISH | S-FISH | S-FISH | O-FISH |
| 37 | S-FISH | S-FISH | S-FISH | S-FISH | O-FISH |
| 38 | S-FISH | S-FISH | S-FISH | S-FISH | O-FISH |
| 39 | S-FISH | S-FISH | S-FISH | S-FISH | O-FISH |
| 40 | Y-CORAL | Y-CORAL | WILD | Y-CORAL | B-FISH |

FIG.16

FREE GAME TYPE C

| | | | | | |
|---|---|---|---|---|---|
| 41 | Y-CORAL | Y-CORAL | Y-CORAL | Y-CORAL | B-FISH |
| 42 | Y-CORAL | Y-CORAL | Y-CORAL | Y-CORAL | B-FISH |
| 43 | Y-CORAL | Y-CORAL | Y-CORAL | Y-CORAL | B-FISH |
| 44 | R-CORAL | R-CORAL | Y-CORAL | R-CORAL | S-FISH |
| 45 | R-CORAL | R-CORAL | WILD | R-CORAL | S-FISH |
| 46 | R-CORAL | R-CORAL | R-CORAL | R-CORAL | S-FISH |
| 47 | R-CORAL | R-CORAL | R-CORAL | R-CORAL | S-FISH |
| 48 | O-FISH | O-FISH | R-CORAL | O-FISH | R-CORAL |
| 49 | O-FISH | O-FISH | R-CORAL | O-FISH | R-CORAL |
| 50 | O-FISH | O-FISH | WILD | O-FISH | R-CORAL |
| 51 | O-FISH | O-FISH | O-FISH | O-FISH | R-CORAL |
| 52 | B-FISH | B-FISH | O-FISH | B-FISH | Y-CORAL |
| 53 | B-FISH | B-FISH | O-FISH | B-FISH | Y-CORAL |
| 54 | B-FISH | B-FISH | O-FISH | B-FISH | Y-CORAL |
| 55 | B-FISH | B-FISH | WILD | B-FISH | Y-CORAL |
| 56 | Y-CORAL | S-FISH | B-FISH | O-FISH | Y-FISH |
| 57 | Y-CORAL | S-FISH | B-FISH | O-FISH | Y-FISH |
| 58 | Y-CORAL | S-FISH | B-FISH | O-FISH | Y-FISH |
| 59 | Y-CORAL | S-FISH | B-FISH | O-FISH | Y-FISH |
| 60 | R-CORAL | B-FISH | WILD | R-CORAL | O-FISH |
| 61 | R-CORAL | B-FISH | O-FISH | R-CORAL | O-FISH |
| 62 | R-CORAL | B-FISH | O-FISH | R-CORAL | O-FISH |
| 63 | R-CORAL | B-FISH | O-FISH | R-CORAL | O-FISH |
| 64 | B-FISH | Y-FISH | O-FISH | S-FISH | B-FISH |
| 65 | B-FISH | Y-FISH | WILD | S-FISH | B-FISH |
| 66 | B-FISH | Y-FISH | R-CORAL | S-FISH | B-FISH |
| 67 | B-FISH | Y-FISH | R-CORAL | S-FISH | B-FISH |
| 68 | S-FISH | O-FISH | R-CORAL | B-FISH | S-FISH |
| 69 | S-FISH | O-FISH | R-CORAL | B-FISH | S-FISH |
| 70 | S-FISH | O-FISH | WILD | B-FISH | S-FISH |
| 71 | S-FISH | O-FISH | S-FISH | B-FISH | S-FISH |
| 72 | | Y-CORAL | S-FISH | Y-FISH | |
| 73 | | Y-CORAL | S-FISH | Y-FISH | |
| 74 | | Y-CORAL | S-FISH | Y-FISH | |
| 75 | | Y-CORAL | WILD | Y-FISH | |
| 76 | | R-CORAL | B-FISH | Y-CORAL | |
| 77 | | R-CORAL | B-FISH | Y-CORAL | |
| 78 | | R-CORAL | B-FISH | Y-CORAL | |
| 79 | | R-CORAL | B-FISH | Y-CORAL | |
| 80 | | | WILD | | |
| 81 | | | Y-FISH | | |
| 82 | | | Y-FISH | | |
| 83 | | | Y-FISH | | |
| 84 | | | Y-FISH | | |
| 85 | | | Y-CORAL | | |
| 86 | | | Y-CORAL | | |
| 87 | | | Y-CORAL | | |
| 88 | | | Y-CORAL | | |
| 89 | | | | | |

FIG.17

FREE GAME TYPE D

| CODE NUMBERS | REEL1 | REEL2 | REEL3 | REEL4 | REEL5 |
|---|---|---|---|---|---|
| 0 | G-MERMAID | G-MERMAID | G-MERMAID | G-MERMAID | G-MERMAID |
| 1 | G-MERMAID | G-MERMAID | G-MERMAID | G-MERMAID | G-MERMAID |
| 2 | G-MERMAID | G-MERMAID | G-MERMAID | G-MERMAID | G-MERMAID |
| 3 | G-MERMAID | G-MERMAID | G-MERMAID | G-MERMAID | G-MERMAID |
| 4 | G-MERMAID | G-MERMAID | G-MERMAID | G-MERMAID | G-MERMAID |
| 5 | G-MERMAID | G-MERMAID | G-MERMAID | G-MERMAID | G-MERMAID |
| 6 | G-MERMAID | G-MERMAID | G-MERMAID | G-MERMAID | G-MERMAID |
| 7 | G-MERMAID | G-MERMAID | G-MERMAID | G-MERMAID | G-MERMAID |
| 8 | G-MERMAID | G-MERMAID | G-MERMAID | G-MERMAID | G-MERMAID |
| 9 | G-MERMAID | G-MERMAID | G-MERMAID | G-MERMAID | G-MERMAID |
| 10 | G-MERMAID | G-MERMAID | G-MERMAID | G-MERMAID | G-MERMAID |
| 11 | G-MERMAID | G-MERMAID | G-MERMAID | G-MERMAID | G-MERMAID |
| 12 | G-MERMAID | G-MERMAID | G-MERMAID | G-MERMAID | G-MERMAID |
| 13 | G-MERMAID | G-MERMAID | G-MERMAID | G-MERMAID | G-MERMAID |
| 14 | G-MERMAID | G-MERMAID | G-MERMAID | G-MERMAID | G-MERMAID |
| 15 | G-MERMAID | G-MERMAID | G-MERMAID | G-MERMAID | G-MERMAID |
| 16 | G-MERMAID | G-MERMAID | G-MERMAID | G-MERMAID | G-MERMAID |
| 17 | G-MERMAID | G-MERMAID | G-MERMAID | G-MERMAID | G-MERMAID |
| 18 | G-MERMAID | G-MERMAID | G-MERMAID | G-MERMAID | G-MERMAID |
| 19 | G-MERMAID | G-MERMAID | G-MERMAID | G-MERMAID | G-MERMAID |
| 20 | G-MERMAID | G-MERMAID | G-MERMAID | G-MERMAID | G-MERMAID |
| 21 | G-MERMAID | G-MERMAID | G-MERMAID | G-MERMAID | G-MERMAID |
| 22 | G-MERMAID | G-MERMAID | G-MERMAID | G-MERMAID | G-MERMAID |
| 23 | G-MERMAID | G-MERMAID | G-MERMAID | G-MERMAID | G-MERMAID |
| 24 | G-MERMAID | G-MERMAID | G-MERMAID | G-MERMAID | G-MERMAID |
| 25 | G-MERMAID | G-MERMAID | G-MERMAID | G-MERMAID | G-MERMAID |
| 26 | G-MERMAID | G-MERMAID | G-MERMAID | G-MERMAID | G-MERMAID |
| 27 | G-MERMAID | G-MERMAID | G-MERMAID | G-MERMAID | G-MERMAID |
| 28 | G-MERMAID | G-MERMAID | G-MERMAID | G-MERMAID | G-MERMAID |
| 29 | G-MERMAID | G-MERMAID | G-MERMAID | G-MERMAID | G-MERMAID |
| 30 | G-MERMAID | G-MERMAID | G-MERMAID | G-MERMAID | G-MERMAID |
| 31 | G-MERMAID | G-MERMAID | G-MERMAID | G-MERMAID | G-MERMAID |
| 32 | Y-FISH | Y-FISH | Y-FISH | Y-FISH | Y-FISH |
| 33 | Y-FISH | Y-FISH | Y-FISH | Y-FISH | Y-FISH |
| 34 | Y-FISH | Y-FISH | Y-FISH | Y-FISH | Y-FISH |
| 35 | Y-FISH | Y-FISH | Y-FISH | Y-FISH | Y-FISH |
| 36 | S-FISH | S-FISH | S-FISH | S-FISH | O-FISH |
| 37 | S-FISH | S-FISH | S-FISH | S-FISH | O-FISH |
| 38 | S-FISH | S-FISH | S-FISH | S-FISH | O-FISH |
| 39 | S-FISH | S-FISH | S-FISH | S-FISH | O-FISH |
| 40 | Y-CORAL | Y-CORAL | WILD | Y-CORAL | B-FISH |

FIG.18

FREE GAME TYPE D

| | | | | | |
|---|---|---|---|---|---|
| 41 | Y-CORAL | Y-CORAL | Y-CORAL | Y-CORAL | B-FISH |
| 42 | Y-CORAL | Y-CORAL | Y-CORAL | Y-CORAL | B-FISH |
| 43 | Y-CORAL | Y-CORAL | Y-CORAL | Y-CORAL | B-FISH |
| 44 | R-CORAL | R-CORAL | Y-CORAL | R-CORAL | S-FISH |
| 45 | R-CORAL | R-CORAL | R-CORAL | R-CORAL | S-FISH |
| 46 | R-CORAL | R-CORAL | R-CORAL | R-CORAL | S-FISH |
| 47 | R-CORAL | R-CORAL | R-CORAL | R-CORAL | S-FISH |
| 48 | O-FISH | O-FISH | R-CORAL | O-FISH | R-CORAL |
| 49 | O-FISH | O-FISH | WILD | O-FISH | R-CORAL |
| 50 | O-FISH | O-FISH | O-FISH | O-FISH | R-CORAL |
| 51 | O-FISH | O-FISH | O-FISH | O-FISH | R-CORAL |
| 52 | B-FISH | B-FISH | O-FISH | B-FISH | Y-CORAL |
| 53 | B-FISH | B-FISH | O-FISH | B-FISH | Y-CORAL |
| 54 | B-FISH | B-FISH | B-FISH | B-FISH | Y-CORAL |
| 55 | B-FISH | B-FISH | B-FISH | B-FISH | Y-CORAL |
| 56 | Y-CORAL | S-FISH | B-FISH | O-FISH | Y-FISH |
| 57 | Y-CORAL | S-FISH | B-FISH | O-FISH | Y-FISH |
| 58 | Y-CORAL | S-FISH | WILD | O-FISH | Y-FISH |
| 59 | Y-CORAL | S-FISH | O-FISH | O-FISH | Y-FISH |
| 60 | R-CORAL | B-FISH | O-FISH | R-CORAL | O-FISH |
| 61 | R-CORAL | B-FISH | O-FISH | R-CORAL | O-FISH |
| 62 | R-CORAL | B-FISH | O-FISH | R-CORAL | O-FISH |
| 63 | R-CORAL | B-FISH | R-CORAL | R-CORAL | O-FISH |
| 64 | | Y-FISH | R-CORAL | S-FISH | B-FISH |
| 65 | | Y-FISH | R-CORAL | S-FISH | B-FISH |
| 66 | | Y-FISH | R-CORAL | S-FISH | B-FISH |
| 67 | | Y-FISH | WILD | S-FISH | B-FISH |
| 68 | | O-FISH | S-FISH | B-FISH | S-FISH |
| 69 | | O-FISH | S-FISH | B-FISH | S-FISH |
| 70 | | O-FISH | S-FISH | B-FISH | S-FISH |
| 71 | | O-FISH | S-FISH | B-FISH | S-FISH |
| 72 | | Y-CORAL | B-FISH | Y-FISH | |
| 73 | | Y-CORAL | B-FISH | Y-FISH | |
| 74 | | Y-CORAL | B-FISH | Y-FISH | |
| 75 | | Y-CORAL | B-FISH | Y-FISH | |
| 76 | | | WILD | Y-CORAL | |
| 77 | | | Y-FISH | Y-CORAL | |
| 78 | | | Y-FISH | Y-CORAL | |
| 79 | | | Y-FISH | Y-CORAL | |
| 80 | | | Y-FISH | | |
| 81 | | | Y-CORAL | | |
| 82 | | | Y-CORAL | | |
| 83 | | | Y-CORAL | | |
| 84 | | | Y-CORAL | | |
| 85 | | | | | |

FIG.19

FREE GAME TYPE E

| CODE NUMBERS | REEL1 | REEL2 | REEL3 | REEL4 | REEL5 |
|---|---|---|---|---|---|
| 0 | B-MERMAID | B-MERMAID | B-MERMAID | B-MERMAID | B-MERMAID |
| 1 | B-MERMAID | B-MERMAID | B-MERMAID | B-MERMAID | B-MERMAID |
| 2 | B-MERMAID | B-MERMAID | B-MERMAID | B-MERMAID | B-MERMAID |
| 3 | B-MERMAID | B-MERMAID | B-MERMAID | B-MERMAID | B-MERMAID |
| 4 | B-MERMAID | B-MERMAID | B-MERMAID | B-MERMAID | B-MERMAID |
| 5 | B-MERMAID | B-MERMAID | B-MERMAID | B-MERMAID | B-MERMAID |
| 6 | B-MERMAID | B-MERMAID | B-MERMAID | B-MERMAID | B-MERMAID |
| 7 | B-MERMAID | B-MERMAID | B-MERMAID | B-MERMAID | B-MERMAID |
| 8 | B-MERMAID | B-MERMAID | B-MERMAID | B-MERMAID | B-MERMAID |
| 9 | B-MERMAID | B-MERMAID | B-MERMAID | B-MERMAID | B-MERMAID |
| 10 | B-MERMAID | B-MERMAID | B-MERMAID | B-MERMAID | B-MERMAID |
| 11 | B-MERMAID | B-MERMAID | B-MERMAID | B-MERMAID | B-MERMAID |
| 12 | B-MERMAID | B-MERMAID | B-MERMAID | B-MERMAID | B-MERMAID |
| 13 | B-MERMAID | B-MERMAID | B-MERMAID | B-MERMAID | B-MERMAID |
| 14 | B-MERMAID | B-MERMAID | B-MERMAID | B-MERMAID | B-MERMAID |
| 15 | B-MERMAID | B-MERMAID | B-MERMAID | B-MERMAID | B-MERMAID |
| 16 | B-MERMAID | B-MERMAID | B-MERMAID | B-MERMAID | B-MERMAID |
| 17 | B-MERMAID | B-MERMAID | B-MERMAID | B-MERMAID | B-MERMAID |
| 18 | B-MERMAID | B-MERMAID | B-MERMAID | B-MERMAID | B-MERMAID |
| 19 | B-MERMAID | B-MERMAID | B-MERMAID | B-MERMAID | B-MERMAID |
| 20 | B-MERMAID | B-MERMAID | B-MERMAID | B-MERMAID | B-MERMAID |
| 21 | B-MERMAID | B-MERMAID | B-MERMAID | B-MERMAID | B-MERMAID |
| 22 | B-MERMAID | B-MERMAID | B-MERMAID | B-MERMAID | B-MERMAID |
| 23 | B-MERMAID | B-MERMAID | B-MERMAID | B-MERMAID | B-MERMAID |
| 24 | B-MERMAID | B-MERMAID | B-MERMAID | B-MERMAID | B-MERMAID |
| 25 | B-MERMAID | B-MERMAID | B-MERMAID | B-MERMAID | B-MERMAID |
| 26 | B-MERMAID | B-MERMAID | B-MERMAID | B-MERMAID | B-MERMAID |
| 27 | B-MERMAID | B-MERMAID | B-MERMAID | B-MERMAID | B-MERMAID |
| 28 | B-MERMAID | B-MERMAID | B-MERMAID | B-MERMAID | B-MERMAID |
| 29 | B-MERMAID | B-MERMAID | B-MERMAID | B-MERMAID | B-MERMAID |
| 30 | B-MERMAID | B-MERMAID | B-MERMAID | B-MERMAID | B-MERMAID |
| 31 | B-MERMAID | B-MERMAID | B-MERMAID | B-MERMAID | B-MERMAID |
| 32 | Y-FISH | Y-FISH | Y-FISH | Y-FISH | Y-FISH |
| 33 | Y-FISH | Y-FISH | Y-FISH | Y-FISH | Y-FISH |
| 34 | Y-FISH | Y-FISH | Y-FISH | Y-FISH | Y-FISH |
| 35 | Y-FISH | Y-FISH | Y-FISH | Y-FISH | Y-FISH |
| 36 | S-FISH | S-FISH | S-FISH | S-FISH | O-FISH |
| 37 | S-FISH | S-FISH | S-FISH | S-FISH | O-FISH |
| 38 | S-FISH | S-FISH | S-FISH | S-FISH | O-FISH |
| 39 | S-FISH | S-FISH | S-FISH | S-FISH | O-FISH |
| 40 | Y-CORAL | Y-CORAL | WILD | Y-CORAL | B-FISH |

FIG.20

FREE GAME TYPE E

| | | | | | |
|---|---|---|---|---|---|
| 41 | Y-CORAL | Y-CORAL | Y-CORAL | Y-CORAL | B-FISH |
| 42 | Y-CORAL | Y-CORAL | Y-CORAL | Y-CORAL | B-FISH |
| 43 | Y-CORAL | Y-CORAL | Y-CORAL | Y-CORAL | B-FISH |
| 44 | R-CORAL | R-CORAL | Y-CORAL | R-CORAL | S-FISH |
| 45 | R-CORAL | R-CORAL | WILD | R-CORAL | S-FISH |
| 46 | R-CORAL | R-CORAL | R-CORAL | R-CORAL | S-FISH |
| 47 | R-CORAL | R-CORAL | R-CORAL | R-CORAL | S-FISH |
| 48 | O-FISH | O-FISH | R-CORAL | O-FISH | R-CORAL |
| 49 | O-FISH | O-FISH | R-CORAL | O-FISH | R-CORAL |
| 50 | O-FISH | O-FISH | WILD | O-FISH | R-CORAL |
| 51 | O-FISH | O-FISH | O-FISH | O-FISH | R-CORAL |
| 52 | B-FISH | B-FISH | O-FISH | B-FISH | Y-CORAL |
| 53 | B-FISH | B-FISH | O-FISH | B-FISH | Y-CORAL |
| 54 | B-FISH | B-FISH | O-FISH | B-FISH | Y-CORAL |
| 55 | B-FISH | B-FISH | WILD | B-FISH | Y-CORAL |
| 56 | Y-CORAL | S-FISH | B-FISH | O-FISH | Y-FISH |
| 57 | Y-CORAL | S-FISH | B-FISH | O-FISH | Y-FISH |
| 58 | Y-CORAL | S-FISH | B-FISH | O-FISH | Y-FISH |
| 59 | Y-CORAL | S-FISH | B-FISH | O-FISH | Y-FISH |
| 60 | R-CORAL | B-FISH | WILD | R-CORAL | O-FISH |
| 61 | R-CORAL | B-FISH | O-FISH | R-CORAL | O-FISH |
| 62 | R-CORAL | B-FISH | O-FISH | R-CORAL | O-FISH |
| 63 | R-CORAL | B-FISH | O-FISH | R-CORAL | O-FISH |
| 64 | | Y-FISH | O-FISH | S-FISH | B-FISH |
| 65 | | Y-FISH | WILD | S-FISH | B-FISH |
| 66 | | Y-FISH | R-CORAL | S-FISH | B-FISH |
| 67 | | Y-FISH | R-CORAL | S-FISH | B-FISH |
| 68 | | O-FISH | R-CORAL | B-FISH | S-FISH |
| 69 | | O-FISH | R-CORAL | B-FISH | S-FISH |
| 70 | | O-FISH | WILD | B-FISH | S-FISH |
| 71 | | O-FISH | S-FISH | B-FISH | S-FISH |
| 72 | | Y-CORAL | S-FISH | Y-FISH | |
| 73 | | Y-CORAL | S-FISH | Y-FISH | |
| 74 | | Y-CORAL | S-FISH | Y-FISH | |
| 75 | | Y-CORAL | WILD | Y-FISH | |
| 76 | | R-CORAL | B-FISH | Y-CORAL | |
| 77 | | R-CORAL | B-FISH | Y-CORAL | |
| 78 | | R-CORAL | B-FISH | Y-CORAL | |
| 79 | | R-CORAL | B-FISH | Y-CORAL | |
| 80 | | | WILD | | |
| 81 | | | Y-FISH | | |
| 82 | | | Y-FISH | | |
| 83 | | | Y-FISH | | |
| 84 | | | Y-FISH | | |
| 85 | | | Y-CORAL | | |
| 86 | | | Y-CORAL | | |
| 87 | | | Y-CORAL | | |
| 88 | | | Y-CORAL | | |
| 89 | | | | | |

FIG.22

NORMAL GAME:SYMBOL COMBINATION TABLE

| SYMBOL TYPES \ NUMBERS OF SYMBOLS | 1 | 2 | 3 | 4 | 5 |
|---|---|---|---|---|---|
| WILD | 0 | 0 | 0 | 0 | 0 |
| R-MERMAID | 0 | 2 | 10 | 40 | 100 |
| P-MERMAID | 0 | 1 | 9 | 30 | 70 |
| Y-MERMAID | 0 | 1 | 8 | 25 | 50 |
| G-MERMAID | 0 | 1 | 7 | 20 | 40 |
| B-MERMAID | 0 | 1 | 6 | 15 | 30 |
| Y-FISH | 0 | 0 | 5 | 10 | 15 |
| O-FISH | 0 | 0 | 4 | 9 | 14 |
| B-FISH | 0 | 0 | 3 | 8 | 13 |
| S-FISH | 0 | 0 | 2 | 7 | 12 |
| R-CORAL | 0 | 0 | 1 | 6 | 11 |
| Y-CORAL | 0 | 0 | 1 | 6 | 11 |
| FEATURE | 0 | 0 | 2 | 0 | 0 |

FIG.23

FREE GAME:SYMBOL COMBINATION TABLE

| SYMBOL TYPES \ NUMBERS OF SYMBOLS | 1 | 2 | 3 | 4 | 5 |
|---|---|---|---|---|---|
| WILD | 0 | 0 | 0 | 0 | 0 |
| R-MERMAID | 0 | 2 | 10 | 40 | 100 |
| P-MERMAID | 0 | 1 | 9 | 30 | 70 |
| Y-MERMAID | 0 | 1 | 8 | 25 | 50 |
| G-MERMAID | 0 | 1 | 7 | 20 | 40 |
| B-MERMAID | 0 | 1 | 6 | 15 | 30 |
| Y-FISH | 0 | 0 | 5 | 10 | 15 |
| O-FISH | 0 | 0 | 4 | 9 | 14 |
| B-FISH | 0 | 0 | 3 | 8 | 13 |
| S-FISH | 0 | 0 | 2 | 7 | 12 |
| R-CORAL | 0 | 0 | 1 | 6 | 11 |
| Y-CORAL | 0 | 0 | 1 | 6 | 11 |

FIG.28

(RE-TRIGGER TABLE)

| WHETHER RIGHT TO EXECUTE FREE GAME IS AWARDED AGAIN | WEIGHT |
|---|---|
| AWARDED AGAIN | 1/2 |
| NOT AWARDED AGAIN (END) | 1/2 |
| TOTAL | 2/2 |

FIG.53

A-TABLE SELECTION RATE
(WHEN RE-TRIGGER IS ACHIEVED)

| | WEIGHT |
|---|---|
| PATTERN 1 | 5 |
| PATTERN 2 | 20 |
| PATTERN 3 | 15 |
| PATTERN 4 | 5 |
| PATTERN 5 | 5 |
| PATTERN 6 | 5 |
| PATTERN 7 | 5 |
| PATTERN 8 | 5 |
| PATTERN 9 | 5 |
| PATTERN 10 | 5 |
| PATTERN 11 | 5 |
| PATTERN 12 | 5 |
| PATTERN 13 | 5 |
| PATTERN 14 | 5 |
| PATTERN 15 | 5 |
| TOTAL | 100 |

B-TABLE SELECTION RATE
(WHEN RE-TRIGGER IS ACHIEVED)

| | WEIGHT |
|---|---|
| PATTERN 21 | 35 |
| PATTERN 22 | 20 |
| PATTERN 23 | 20 |
| PATTERN 24 | 15 |
| PATTERN 25 | 10 |
| TOTAL | 100 |

FIG.54

A-MEMORY INCREASE PREDETERMINED FREQUENCY TABLE
(WHEN SUCCEEDING IN RE-TRIGGER)

| | PATTERN 1 | PATTERN 2 | PATTERN 3 | PATTERN 4 | PATTERN 5 | PATTERN 6 | PATTERN 7 | PATTERN 8 | PATTERN 9 | PATTERN 10 | PATTERN 11 | PATTERN 12 | PATTERN 13 | PATTERN 14 | PATTERN 15 |
|---|---|---|---|---|---|---|---|---|---|---|---|---|---|---|---|
| FIRST STAGE | 1 | 1 | 1 | 1 | 1 | 1 | 1 | 1 | 1 | 1 | 2 | 2 | 2 | 2 | 2 |
| SECOND STAGE | 1 | 2 | 2 | 2 | 2 | 2 | 2 | 2 | 2 | 2 | 4 | 4 | 4 | 4 | 4 |
| THIRD STAGE | 1 | 3 | 3 | 3 | 3 | 3 | 3 | 3 | 3 | 3 | 6 | 6 | 6 | 6 | 6 |
| FOURTH STAGE | 1 | 3 | 3 | 3 | 3 | 3 | 3 | 10 | 10 | 12 | 6 | 6 | 8 | 10 | 10 |
| FIFTH STAGE | 1 | 5 | 5 | 5 | 10 | 10 | 10 | 5 | 5 | 1 | 6 | 6 | 10 | 3 | 3 |
| SIX STAGE | 1 | 6 | 10 | 15 | 1 | 10 | 15 | 5 | 10 | 1 | 8 | 12 | 1 | 5 | 10 |
| TO HIGHEST STAGE | 6 | 20 | 24 | 29 | 20 | 29 | 34 | 26 | 31 | 20 | 32 | 36 | 31 | 30 | 35 |

B-MEMORY INCREASE PREDETERMINED FREQUENCY TABLE
(WHEN FAILING IN RE-TRIGGER)

| | PATTERN 21 | PATTERN 22 | PATTERN 23 | PATTERN 24 | PATTERN 25 |
|---|---|---|---|---|---|
| FIRST STAGE | 1 | 1 | 1 | 2 | 2 |
| SECOND STAGE | 2 | 2 | 2 | 4 | 4 |
| THIRD STAGE | 3 | 3 | 3 | 6 | 6 |
| FOURTH STAGE | 3 | 3 | 10 | 6 | 10 |
| FIFTH STAGE | 5 | 10 | 5 | 6 | 3 |
| SIX STAGE | | | | | |
| TO HIGHEST STAGE | 14 | 19 | 21 | 24 | 25 |

FIG.66

| | GAMBLE ON | GAMBLE ON |
|---|---|---|
| CASH OUT | TAKE WIN | TAKE WIN |
| GAMBLE | GAMBLE START | — |
| MAX BET | INVALID | INVALID |
| SPIN | TO NORMAL GAME | TO NORMAL GAME |

FIG.70

| NO | SCREEN | CONTROL PANEL | OPERATION |
|---|---|---|---|
| 1 | EXIT | HELP | SHIFT TO NORMAL SCREEN |
| 2 | PREV. | BET ×1 | SHIFT TO PREVIOUS PAGE |
| 3 | NEXT | BET ×2 | SHIFT TO NEXT PAGE |

FIG.73

| TYPE OF BUTTON | DURING IDLE | DURING GAME | DURING ERROR | DURING AUDIT | TAKE WIN OR GAMBLE |
|---|---|---|---|---|---|
| HELP | ON | OFF | OFF | OFF | ON |
| LANGUAGE SWITCHING | ON | OFF | OFF | OFF | OFF |
| VOLUME | ON | ON | OFF | OFF | ON |
| NUMBER OF LINES | ON (WHEN SELECTABLE) | OFF | OFF | OFF | OFF |
| NUMBER OF BETS | ON | OFF | OFF | OFF | OFF |
| PAY TABLE | ON | OFF | OFF | OFF | ON |

FIG.83

| | WINNING LINE REGION | | | | WINNING LINE REGION |
|---|---|---|---|---|---|
| 1 | 1 | — | — — — — — — — | 10 | 10 |
| 11 | 11 | — | — — — — — — — | 20 | 20 |
| 21 | 21 | — | — — — — — — — | 30 | 30 |
| 31 | 31 | — | — — — — — — — | 40 | 40 |
| 41 | 41 | — | — — — — — — — | 50 | 50 |

GAMING MACHINE EXECUTING FREE GAME SHIFTED FROM NORMAL GAME AND METHOD OF CONTROLLING SAME

CROSS REFERENCE TO RELATED APPLICATION

The present application claims priority from Japanese Patent Application No. 2013-195655 and Japanese Patent Application No. 2013-195656, which were filed on Sep. 20, 2013, the disclosure of which is herein incorporated by reference in its entirety.

BACKGROUND OF THE INVENTION

The present invention relates to a gaming machine which includes plural video reels and is configured to execute a normal game and a free game shifted from the normal game.

Known gaming machines each having plural video reels employ the following technology, for example. According to the technology, when a trigger occurs, the video reels are upgraded for the free game which is developed from the normal game and about to start. After the video reels are upgraded, the player is able to easily achieve a winning combination (see, e.g., Patent Literature 1 (U.S. Patent Publication No. 2012/0172106)).

SUMMARY OF THE INVENTION

The upgrade of the video reels is carried out in such a way that, for example, the number of wild symbols which are able to replace any symbols is increased. This simple increase in the number of wild symbols, however, gives a monotonous impression to the player.

An object of the present invention is therefore to provide a gaming machine which realizes a new way of upgrading video reels at the time of shifting from a normal game to a free game.

The present invention relates to a gaming machine executing a normal game and a free game shifted from the normal game, the gaming machine including:

a storage configured to store a normal game video reel group which is used in the normal game and free game video reel groups which are different from one another in layout of symbols and are used in the free game;

a display device configured to display a game result by rearranging the normal game video reel group and the free game video reel groups;

an input device configured to receive an input from a player; and a controller, the controller being programmed to execute the processes of:

(1A) as the normal game, randomly determining which symbols laid out on the normal game video reel group are to be rearranged on the display device;

(1B) rearranging the symbols determined in the process (1A) on the display device and awarding a benefit in accordance with a combination of the rearranged symbols;

(1C) when the awarded benefit is a right to execute the free game, randomly associating the free game video reel groups with options displayed on the display device, respectively;

(1D) by the input device, receiving an input indicating which one of the options displayed on the display device is selected;

(1E) determining the video reel group associated with the option selected by the input device as a video reel group used in the free game;

(1F) by using the video reel group determined in the process (1E), randomly determining, as the free game, which symbols laid out on the free game video reel group are to be rearranged on the display device, rearranging the determined symbols on the display device, and awarding a benefit of the free game in accordance with a combination of the rearranged symbols;

(1G) after repeating the process (1F) for a predetermined number of times, randomly determining whether to award the right to execute the free game as the benefit again;

(1H) when it is determined in the process (1G) that the right to execute the free game is awarded as the benefit, repeating the processes (1C) to (1G); and (1I) when it is determined in the process (1G) that the right to execute the free game is not awarded as the benefit, terminating the free game.

According to the arrangement above, when the right to execute the free game is awarded in the normal game, the video reel groups for the free game are randomly associated with options, respectively, the player selects one of these options, and the video reel group associated with the selected option is used in the free game. This process of determining the video reel group used in the free game based on the selection by the player is carried out also when the right to execute the free game is awarded again as a result of the random determination performed after the free game is repeated for the predetermined number of times.

This allows the player to enjoy the game with freshness, as the video reel group with a different layout of the symbols is used each time the free game is executed for the predetermined number of times.

In the present invention, the above-described gaming machine is arranged so that the number of a predetermined symbol laid out on each of the free game video reel groups is larger than the number of the predetermined symbol laid out on the normal game video reel group.

According to this arrangement, provided that the predetermined symbol is a symbol advantageous for the player, the probability of obtaining an advantageous benefit is higher in the free game than in the normal game, and hence the player's expectation on the benefit is enhanced.

In the present invention, the above-described gaming machine is arranged so that in the free game, expectation for the benefit to be awarded is arranged to be different between the video reel groups to be used, and in the process (1E), expectations of the video reel groups associated with the options in the process (1C) are displayed when the video reel group used in the free game is determined.

According to this arrangement, the player is able to check, before the start of the free game, the expectation for the payout of the free game video reel group associated with the option selected by the player.

In the present invention, the above-described gaming machine is arranged so that, in the process (1G), (e1) on the display device, multi-level display regions are provided and a meter is displayed to indicate a display region of a higher level one by one each time a predetermined time elapses or an input is received by the input device, (e2) an effect is performed in such a way that, each time the predetermined time elapses or the input is received by the input device, the meter indicates a display region of a higher level one by one, and (e3) when it is determined in the process (1E) that the right to execute the free game is to be awarded as the benefit, an effect of causing the meter to indicate a display region of a predetermined level is performed and an effect of notifying that the right to execute the free game is to be awarded is performed.

According to this arrangement, when random determination as to whether the right to execute the free game is awarded again as the benefit after the free game is repeated for the predetermined number of times, the effect is performed in such a way that the meter indicates a display region of a higher level one by one, in response to the input from the player to the input device.

This provides the player with a vivid sensory perception of as if he/she actually participates in the random determination as to whether the right to execute the free game is awarded.

In the present invention, the above-described gaming machine is arranged so that the symbols laid out on the video reel groups are classified into plural types, and in the process of awarding the benefit, when the combination of the symbols rearranged on the display device is a combination with which the benefit is awarded, an integral effect is performed for symbols which are of the same type and serially rearranged in one video reel group, among the symbols constituting the combination with which the benefit is awarded.

According to this arrangement, When the symbols rearranged on the display device form a combination with which a benefit is awarded and the symbols achieving the combination with which the benefit is awarded includes symbols which are of the same type and serially arranged on a video reel, an integral effect is executed for those serial symbols. With this, the player enjoys the effect above.

In addition to the above, the present invention relates to a method of controlling a gaming machine executing a normal game and a free game shifted from the normal game, the gaming machine including:

a storage configured to store a normal game video reel group which is used in the normal game and free game video reel groups which are different from one another in layout of symbols and are used in the free game;

a display device configured to display a game result by rearranging the normal game video reel group and the free game video reel groups;

an input device configured to receive an input from a player; and a controller, under the control by the controller, the method including the steps of:

(2A) as the normal game, randomly determining which symbols laid out on the normal game video reel group are to be rearranged on the display device;

(2B) rearranging the symbols determined in the step (2A) on the display device and awarding a benefit in accordance with a combination of the rearranged symbols;

(2C) when the awarded benefit is a right to execute the free game, randomly associating the free game video reel groups with options displayed on the display device, respectively;

(2D) by the input device, receiving an input indicating which one of the options displayed on the display device is selected;

(2E) determining the video reel group associated with the option selected by the input device as a video reel group used in the free game;

(2F) by using the video reel group determined in the step (2E), randomly determining, as the free game, which symbols laid out on the free game video reel group are to be rearranged on the display device, rearranging the determined symbols on the display device, and awarding a benefit of the free game in accordance with a combination of the rearranged symbols;

(2G) after repeating the step (2F) for a predetermined number of times, randomly determining whether to award the right to execute the free game as the benefit again;

(2H) when it is determined in the step (2G) that the right to execute the free game is awarded as the benefit, repeating the steps (2C) to (2G); and (2I) when it is determined in the step (2G) that the right to execute the free game is not awarded as the benefit, terminating the free game.

According to the method above, when the right to execute the free game is awarded in the normal game, the video reel groups for the free game are randomly associated with the options, and the player selects one of the options, so that the video reel group associated with the selected option is used in the free game. Furthermore, the determination of the video reel group used in the free game by means of the selection by the player is executed when the right to execute the free game is awarded again as a result of the random determination after the free game is repeated for the predetermined number of times.

This allows the player to enjoy the game with freshness, as the video reel group with a different layout of the symbols is used each time the free game is executed for the predetermined number of times.

In addition to the above, the gaming machine of the present invention is arranged such that the predetermined symbol is a symbol with which a benefit advantageous for the player is awarded.

In addition to the above, the gaming machine of the present invention is arranged such that, in the free game, the video reel groups to be used are arranged to be different from one another in the maximum payout or minimum payout with respect to the benefit to be awarded.

In addition to the above, the gaming machine of the present invention is arranged such that, in the free game, expectation for the benefit to be awarded is arranged to be different between the video reel groups to be used, and the expectation is either expectation for the benefit when the free game is executed once or expectation for a payout as a result of the execution of the free game for the predetermined number of times awarded as the benefit of the normal game.

In addition to the above, the gaming machine of the present invention is arranged such that, predetermined symbols are serially laid out on the normal game video reel group and the free game video reel groups, and the number of the predetermined symbols serially laid out on each of the free game video reel groups is arranged to be larger than the number of the predetermined symbols serially laid out on the normal game video reel group.

In addition to the above, the present invention relates to a gaming machine executing a normal game and a free game shifted from the normal game, the gaming machine including:

a storage configured to store a normal game video reel group which is used in the normal game and free game video reel groups which are different from one another in layout of symbols and are used in the free game;

a display device configured to display a game result by rearranging the normal game video reel group and the free game video reel groups;

an input device configured to receive an input from a player; and a controller, the controller being programmed to execute the processes of:.

(3A) as the normal game, randomly determining which symbols laid out on the normal game video reel group are to be rearranged on the display device;

(3B) rearranging the symbols determined in the process (3A) on the display device and awarding a benefit in accordance with a combination of the rearranged symbols;

(3C) when the awarded benefit is a right to execute the free game, selecting one of the free game video reel groups as a video reel group used in the free game, by automatic random determination;

(3D) by using the video reel group selected in the process (3C), randomly determining, as the free game, which symbols laid out on the free game video reel group are to be rearranged on the display device, rearranging the determined symbols on the display device, and awarding a benefit of the free game in accordance with a combination of the rearranged symbols;

(3E) after repeating the process (3D) for a predetermined number of times, randomly determining whether to award the right to execute the free game as the benefit again;

(3F) when it is determined in the process (3E) that the right to execute the free game is awarded as the benefit, repeating the processes (3C) to (3E); and (3G) when it is determined in the process (3E) that the right to execute the free game is not awarded as the benefit, terminating the free game.

The present invention relates to a gaming machine including: a symbol display device configured to display a game result by rearranging symbols; and a controller, the controller being programmed to execute the processes of:

(A1) randomly determining the symbols to be rearranged on the symbol display device;

(A2) rearranging the symbols determined in the process (A1) on the symbol display device, and determining whether the game result is a win based on a combination of positions of the rearranged symbols;

(A3) when it is determined in the process (A2) that the game result is the win, setting the combination of the positions of the rearranged symbols achieving the win as a winning line region; and (A4) relatively decreasing the brightness of a symbol provided outside the winning line region as compared to the brightness of the symbols rearranged in the winning line region in the process (A3).

According to the arrangement above, the gaming machine realizes a new way of winning notification which is arranged in such a way that a combination of symbols achieving winning is easily recognizable for the player as the brightness of a symbol provided outside the winning line region is relatively lowered as compared to the brightness of symbols rearranged in the winning line region.

In addition to the above, in the gaming machine of the present invention, the controller may be further programmed to execute the process of:

(A5) when it is determined in the process (A2) that the game result is plural wins, executing the steps (A3) and (A4) at different timings for the respective wins.

With this arrangement, the gaming machine realizes a new way of winning notification which is arranged in such a way that each combination of symbols achieving a win is easily recognizable for the player as the step of relatively decreasing the brightness of a symbol provided outside the winning line region as compared to the brightness of symbols rearranged in the winning line region is executed at different timings for the win of the respective times.

In addition to the above, the gaming machine of the present invention further includes a storage configured to store winning line regions composed of combinations of positions of rearranged symbols with which the game result is the win and winning line numbers associated with the respective winning line regions, the controller being further programmed to execute the process of:

(A6) when it is determined in the process (A2) that the game result is plural wins, reading the winning line number associated with the winning line region set in the process (A3) from the storage for each of the wins, and executing the process (A4) in an ascending order or a descending order of the winning line numbers.

With this arrangement, the gaming machine realizes a new way of winning notification which is arranged in such a way that each combination of symbols achieving a win is easily recognizable for the player as the step of relatively decreasing the brightness of a symbol provided outside the winning line region as compared to the brightness of the symbols rearranged in the winning line region is executed for the respective winning line numbers in descending order or ascending order, and because the order of display is associated with the ascending order or descending order of the winning line numbers, each state of the combinations of the symbols achieving the win can be easily remembered.

In addition to the above, the gaming machine of the present invention may be arranged such that, in the step (A6), a timing of switching is varied each time the step (A4) is executed.

This arrangement allows the gaming machine to provide an effect which is arranged such that the timing of switching of the winning line numbers in the ascending order or descending order is unexpected for the player as the timing is changed each time.

In addition to the above, the gaming machine of the present invention may be arranged such that, in the process (A4), a display state (color, flickering, shape, mark display, or the like) of the symbols rearranged in the winning line region is differentiated from a display state of the symbol rearranged outside the winning line region.

According to this arrangement, the gaming machine realizes a new way of winning notification which is arranged in such a way that, in addition to the relative decrease in the brightness of a symbol provided outside the winning line region as compared to the brightness of the symbols rearranged in the winning line region, the state of the combination of the symbols achieving the win is further easily recognizable for the player, as the display state of the symbols in the winning line region is differentiated from the display state of the symbol outside the winning line region.

The present invention relates to a method of controlling a gaming machine including a symbol display device configured to display a game result by rearranging symbols, comprising the steps of:

(A1) randomly determining the symbols to be rearranged on the symbol display device;

(A2) rearranging the symbols determined in the step (A1) on the symbol display device, and determining whether the game result is a win based on a combination of positions of the rearranged symbols;

(A3) when it is determined in the step (A2) that the game result is the win, setting the combination of the positions of the rearranged symbols achieving the win as a winning line region; and (A4) relatively decreasing the brightness of a symbol provided outside the winning line region as compared to the brightness of the symbols rearranged in the winning line region in the step (A3).

This arrangement makes it possible to realize a new way of winning notification which is arranged in such a way that a combination of symbols achieving winning is easily recognizable for the player as the brightness of a symbol provided outside the winning line region is relatively lowered as compared to the brightness of symbols rearranged in the winning line region.

In addition to the above, the gaming machine of the present invention is arranged such that, when there are plural types of wins, a difference between the brightness of the symbols in the winning line region and the brightness of the symbol outside the winning line region is differentiated between the types of wins.

In addition to the above, the gaming machine of the present invention is arranged such that, the brightness of the symbols rearranged in the winning line region is arranged to increase in proportion to the magnitude of a payout amount which is won.

In addition to the above, the gaming machine of the present invention is arranged such that, in addition to the brightness of the symbols, a display state indicated by a combination of at least one of color, blinking, shape, and mark display is differentiated between the types of wins.

In addition to the above, the gaming machine of the present invention is arranged such that, after the process (A4), a waiting process is further executed to continue, until a predetermined time elapses, a state in which the brightness of the symbol rearranged outside the winning line region is relatively decreased as compared to the brightness of the symbols rearranged in the winning line region, and the predetermined time is arranged to be in proportion to a payout amount awarded based on the symbols rearranged in the winning line region.

A gaming machine which realizes a new way of upgrading video reels at the time of shifting from a normal game to a free game is provided.

BRIEF DESCRIPTION OF THE DRAWINGS

FIG. 7 shows the layout of symbols depicted on the circumferential surfaces of normal game video reel strips of the slot machine of the embodiment of the present invention.

FIG. 8 shows the layout of symbols depicted on the circumferential surfaces of normal game video reel strips of the slot machine of the embodiment of the present invention.

FIG. 9 shows the layout of symbols depicted on the circumferential surfaces of normal game video reel strips of the slot machine of the embodiment of the present invention.

FIG. 10 shows the layout of symbols depicted on the circumferential surfaces of normal game video reel strips of the slot machine of the embodiment of the present invention.

FIG. 11 shows the layout of symbols depicted on the circumferential surfaces of free game video reel strips of the type A of the slot machine of the embodiment of the present invention.

FIG. 12 shows the layout of symbols depicted on the circumferential surfaces of free game video reel strips of the type A of the slot machine of the embodiment of the present invention.

FIG. 13 shows the layout of symbols depicted on the circumferential surfaces of free game video reel strips of the type B of the slot machine of the embodiment of the present invention.

FIG. 14 shows the layout of symbols depicted on the circumferential surfaces of free game video reel strips of the type B of the slot machine of the embodiment of the present invention.

FIG. 15 shows the layout of symbols depicted on the circumferential surfaces of free game video reel strips of the type C of the slot machine of the embodiment of the present invention.

FIG. 16 shows the layout of symbols depicted on the circumferential surfaces of free game video reel strips of the type C of the slot machine of the embodiment of the present invention.

FIG. 17 shows the layout of symbols depicted on the circumferential surfaces of free game video reel strips of the type D of the slot machine of the embodiment of the present invention.

FIG. 18 shows the layout of symbols depicted on the circumferential surfaces of free game video reel strips of the type D of the slot machine of the embodiment of the present invention.

FIG. 19 shows the layout of symbols depicted on the circumferential surfaces of free game video reel strips of the type E of the slot machine of the embodiment of the present invention.

FIG. 20 shows the layout of symbols depicted on the circumferential surfaces of free game video reel strips of the type E of the slot machine of the embodiment of the present invention.

FIG. 22 shows a symbol combination table for the normal game in the slot machine of the embodiment of the present invention.

FIG. 23 shows a symbol combination table for the free game in the slot machine of the embodiment of the present invention.

FIG. 28 shows a re-trigger table of the slot machine of the embodiment of the present invention.

FIG. 53 shows a table selection rate of the slot machine of the embodiment of the present invention, which is referred to at the time of the re-trigger effect.

FIG. 54 shows a memory increase predetermined frequency table of the slot machine of the embodiment of the present invention, which is referred to at the time of the re-trigger effect.

FIG. 66 illustrates RESIDUAL GAMBLE in the slot machine of the embodiment of the present invention.

FIG. 70 illustrates HELP in the slot machine of the embodiment of the present invention.

FIG. 73 illustrates the layout of screen touch buttons in the slot machine of the embodiment of the present invention.

FIG. 83 illustrates a data table showing the relationship between a winning line number and a winning line region in the slot machine of the embodiment of the present invention.

DESCRIPTION OF THE PREFERRED EMBODIMENTS

[Outline of Present Invention]

Figure 1:
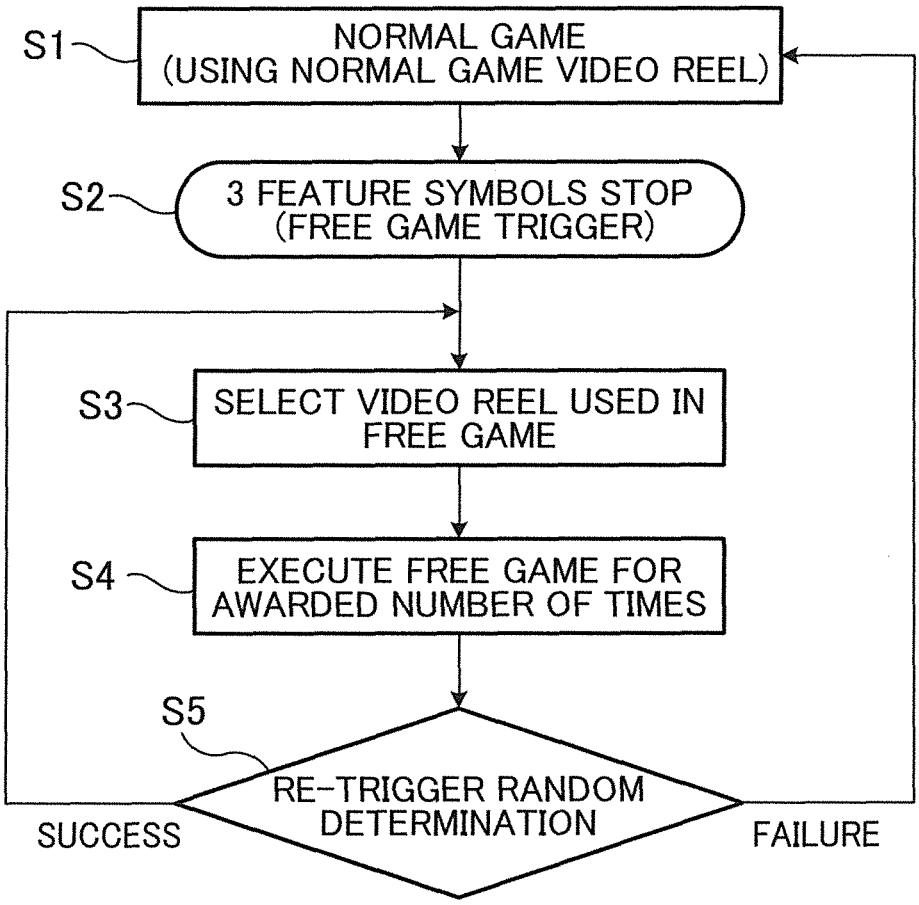
FIG. 1 shows the outline of a game flow of a slot machine according to an embodiment of the present invention.

The following will describe a gaming machine of the present invention with reference to figures. FIG. 1 shows the outline of a game flow of a slot machine of an embodiment of the present invention. As shown in FIG. 1, in the slot machine of the embodiment of the present invention, a slot game composed of a normal game and a free game shifted from the normal game is played.

The slot game is a line-type game. On a display device (lower image display panel), 50 paylines are set in a matrix of four rows and five columns. The slot game employs video reels. The video reels include five reels. That is to say, the video reels include the first reel, the second reel, the third reel, the fourth reel, and the fifth reel.

In the normal game, a normal game video reel strip is used on each reel of the video reels. In the free game, a free game video reel strip is used on each reel of the video reels. As the free game video reel strip, a free game video reel strip randomly selected immediately after the shifting from the normal game to the free game is used. There are five types of free game video reel strips. The reel strip on which more predetermined symbols are successively arranged than in the normal game is used.

In the normal game, symbols laid out on a normal game video reel strip, which are rearranged on the display device, are randomly selected, the randomly selected symbols are rearranged on the display device, and a benefit is awarded based on the combination of the symbols rearranged on a payline (S1).

Subsequently, when the awarded benefit is the right to execute the free game (free game trigger) which is awarded when three FEATURE symbols are rearranged on a payline (S2), the five types of free game video reel strips are randomly associated with five options, respectively. The player selects one of the five options, and the video reel strip associated with the selected option is determined as the video reel strip used in the free game (S3).

Subsequently, using the video reel strip determined in (S3), symbols laid out on the video reel strip to be rearranged on the display device are randomly selected as the free game, the selected symbols are rearranged on the display device, and a benefit of the free game is awarded based on the combination of the symbols rearranged on a payline (S4).

After the free game in S4 is repeated for a predetermined number of times (awarded number of times of execution of the free game), whether to award the right to execute the free game as a benefit is randomly determined again (S5: re-trigger random determination). If the right to execute the free game is awarded as a benefit (success), the process proceeds to S3. On the other hand, when the right to execute the free game as a benefit is not awarded (miss), the free game ends and the process proceeds to the normal game.

(Definitions or the like)

The slot machine is a type of a gaming machine. While the present embodiment deals with the slot machine as an example of the gaming machine, the slot machine may be a different type of machine on condition that a normal game can be individually run by the machine and a free game developing from the normal game can be run by the machine.

A normal game of the present embodiment is run by the slot machine. The normal game is a slot game of rearranging symbols.

The symbols encompass "WILD", "FEATURE", "R_MERMAID (Red Mermaid)", "P_MERMAID (Pink Mermaid)", "Y_MERMAID (Yellow Mermaid)", "G_MERMAID (Green Mermaid)", "B_MERMAID (Blue Mermaid)", "Y_FISH (Yellow Fish)", "O_FISH (Orange Fish)", "B_FISH (Blue Fish)", "S_FISH (Star Fish)", "R_CORAL (Red Coral)", and "Y_CORAL (Yellow Coral)".

A coin, a bill, or electrically valuable information corresponding to these is used as a game value. It is to be noted that the game value in the disclosure is not limited to these, and for example a game medium such as a medal, a token, electric money or the like can be adopted. Further, a later-described ticket with a barcode is also used.

The free game of the present embodiment may be any type of game on condition that the gaming state thereof is different from that of the normal game. The free game is a game which is executable with a smaller amount of game values bet than in the normal game. The expression "executable with a smaller amount of game value bet" includes a case where an amount of game values bet is zero. Therefore, the free game may be a game which is run without betting a game value and the game value is paid out for an amount corresponding to rearranged symbols. In other words, the free game may be a game that starts even if no game value is consumed. On the other hand, the normal game is run on condition that a game value is bet, and is a game of paying out a game value for an amount corresponding to rearranged symbols. In other words, the normal game is a game that starts with the consumption of the game value.

The term "rearrangement" indicates that the symbols are rearranged after the arrangement of the symbols is dismissed. The term "arrangement" indicates a state in which the symbols are visually recognizable by an external player.

[Explanation of Function Flow Diagram]

Figure 2:
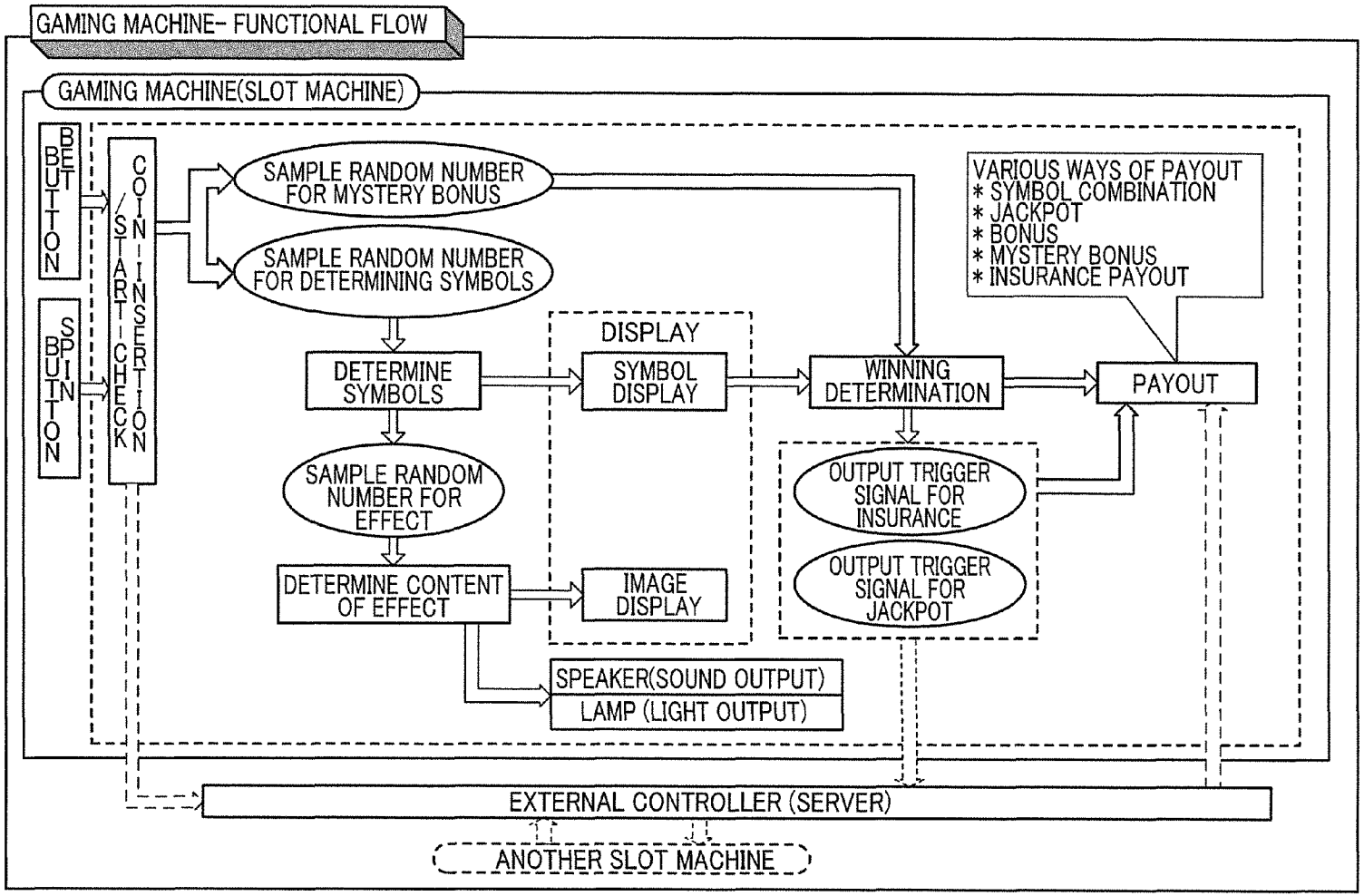
FIG. 2 shows a functional flow of the slot machine of the embodiment of the present invention.

The following describes basic functions of the slot machine of the present invention, with reference to FIG. 2. FIG. 2 is a diagram showing a functional flow of the slot machine of the present invention.

(Coin-Insertion/Start-Check Process)

First, the slot machine checks whether or not a BET button has been pressed by a player, and subsequently checks whether or not a spin button has been pressed by the player.

<Symbol Determination>

Next, when a spin button has been pressed by the player, the slot machine extracts a random number for symbol determination, and determines symbols to be displayed for the player at the time of stopping the scroll of the symbol column, for respective video reels displayed on a display.

<Symbol Display>

Then the slot machine starts the scroll of the symbol column of each video reel, and stops the scroll so that the determined symbols 501 are displayed for the player.

<Win Determination>

Subsequently, as the rotation of the symbol column of each video reel is stopped, the slot machine determines whether the combination of the symbols displayed for the player is a combination related to win.

<Payout>

When the combination of the symbols displayed for the player is a combination related to win, the slot machine offers, to the player, benefit according to the combination. For example, when a combination of symbols related to a payout of coins has been displayed, the slot machine pays out coins of the number corresponding to the combination of symbols to the player.

When a combination of symbols associated with a free game trigger is displayed, the slot machine starts the free game. In the embodiment of the present invention, as the free game, a game (free game) in which the random determination of the above-described to-be stopped symbols is carried out for a predetermined number of times without the consumption of coins is executed.

When a combination of symbols associated with a jackpot trigger is displayed, the slot machine may pay out coins corresponding to a jackpot amount to the player. As the jackpot, at least one of the coins consumed by the player at each slot machine is accumulated as a jackpot amount, and when the jackpot trigger is established at a slot machine, coins corresponding to the accumulated jackpot amount is paid out to that slot machine. In the present case, the slot machine calculates an amount (accumulative amount) accumulated to the jackpot amount each time the game is played, and sends the calculation result to an external controller. The external controller adds the accumulative amount sent from each slot machine to the jackpot amount.

In addition to the above, the slot machine may have other benefits such as mystery bonus and insurance, in addition to the benefit above. In the mystery bonus, a predetermined number of coins are paid out when a win is achieved in dedicated random determination. When a spin button is pressed, the slot machine samples a random number for the mystery bonus, and whether a mystery bonus trigger is established is randomly determined.

The insurance is a function for saving the player when the free game is not executed for a long period of time. In the embodiment of the present invention, the player is able to determined whether to activate the insurance at will. When the insurance is activated, a predetermined insurance activation amount must be paid. When the insurance is activated, the slot machine starts to count the number of times of execution of the game. When the counted number of times reaches a predetermined number while a large amount of payout on account of the free game or the like is not carried out, the slot machine pays out coins, the number of which corresponds to the amount set for the insurance.

<Determination of Effect>

The slot machine produces an effect by displaying an image on a display, outputting light from a lamp, and outputting sound from a speaker. The slot machine samples an effect-use random number and determines the content of an effect based on randomly determined symbols or the like.

<Overall Structure of Game System>

Figure 3:
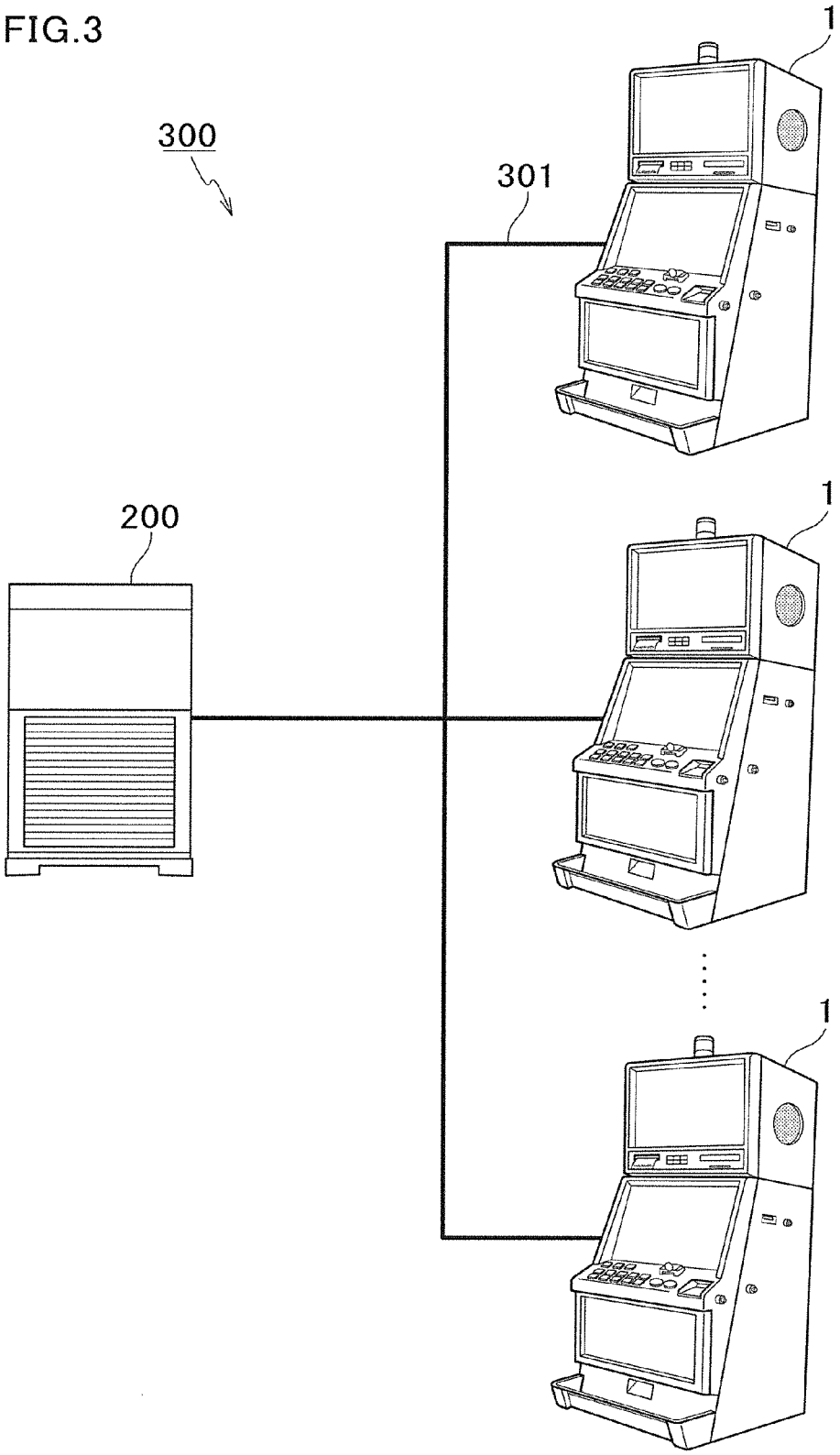
FIG. 3 shows a game system including the slot machine of the embodiment of the present invention.

The basic functions of the slot machine have been described as above. Now, referring to FIG. 3, a game system including the slot machine will be described. FIG. 3 shows the game system including the slot machine of the embodiment of the present invention.

A game system 300 includes a plurality of slot machines 1 and an external controller 200 connected with the slot machines 1 via a communication line 301.

The external controller 200 controls the plurality of slot machines 1. In the embodiment of the present invention, the external controller 200 is a hall server installed in a gaming facility having the slot machines 1. Each of the slot machines 1 has a unique identification number, and the external controller 200 identifies which one of the slot machines 1 transmitted data, by referring to the identification number. Further, when transmitting data from the external controller 200 to any of the slot machines 1, the identification number is used for designating the transmission destination.

It is to be noted that the game system 300 may be constructed within a single gaming facility where various games can be performed, such as a casino, or may be constructed among a plurality of gaming facilities. Further, when the game system 300 is constructed in a single gaming facility, the gaming system may be constructed in each floor or section of the gaming facility. The communication line 301 may be a wired or wireless line, and can adopt a dedicated line, an exchange line or the like.

[Overall Structure of Slot Machine]

Figure 4:
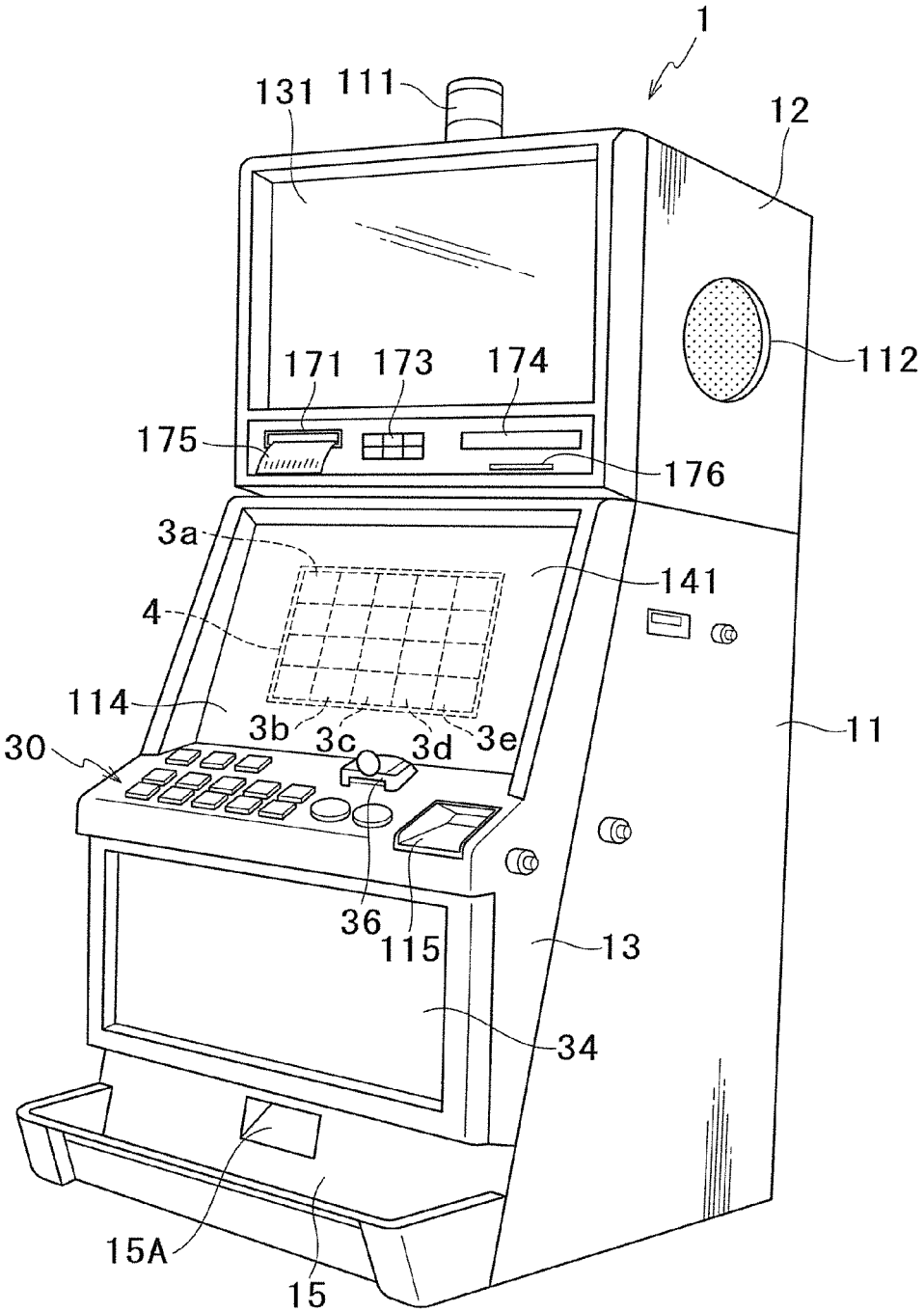
FIG. 4 shows the overall structure of the slot machine of the embodiment of the present invention.

Now, referring to FIG. 4, the overall structure of the slot machine 1 will be described. FIG. 4 shows the entire structure of the slot machine of the embodiment of the present invention.

A coin, a bill, or electrically valuable information corresponding to these is used as a game medium in the slot machine 1. In the embodiment of the present invention, furthermore, a later-described ticket with barcode is also used. It is to be noted that the game medium is not limited to these, and for example a medal, a token, electronic money or the like can be adopted.

The slot machine 1 includes a cabinet 11, a top box installed on the upper side of the cabinet 11, and a main door 13 provided at the front surface of the cabinet 11.

At the center of the main door 13, a lower image display panel 141 (equivalent to a display device) is provided. The lower image display panel 141 is a liquid crystal panel and constitute a display. The lower image display panel 141 has a symbol display region 4. On the symbol display region 4, five video reels 3 (3*a*, 3*b*, 3*c*, 3*d*, and 3*e*) are displayed. In the embodiment of the present invention, the video reels express, by images, the rotation and stop of symbols on mechanical reels depicted on the circumferential surfaces. To each video reel 3, a symbol column each constituted by predetermined symbols is allocated (see, e.g., FIG. 7 which will be described later). The five video reels correspond to plural video reel groups.

In the symbol display region 4, the symbol column allocated to each video reel 3 scrolls and stops after a predetermined time elapses. As a result, parts of the respective symbol columns (four successive symbols in the embodiment of the present invention) are displayed for the player. In the symbol display region 4, for each video reel 3, one symbol is displayed in each of four regions, i.e., the upper stage, the upper middle stage, the lower middle stage, and the lower stage. To put it differently, 20 symbols forming a 5 by 4 matrix are displayed in the symbol display region 4.

Figure 5:
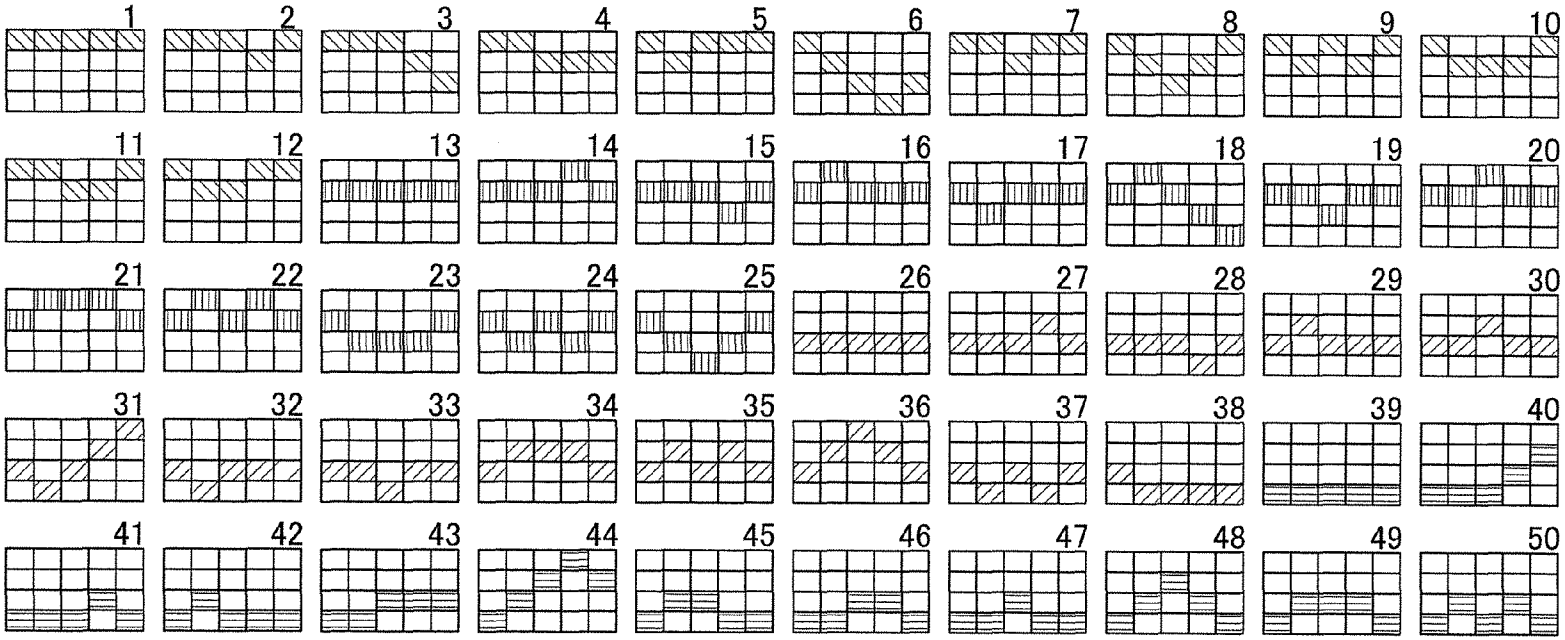
FIG. 5 shows paylines of the slot machine of the embodiment of the present invention.

In the embodiment of the present invention, one of the four regions is selected for each video reel 3, and a line formed by connecting the selected regions is used as a payline (winning line) (see FIG. 5). It is noted that any desired shape of the payline can be adopted, and examples of the shape of the payline may include a straight line formed by connecting the respective middle upper stages of the video reels 3, a V-shaped line, and a bent line. While the number of paylines in the embodiment of the present invention is 50 as shown in FIG. 5, the number may be determined at will, e.g., 30.

The lower image display panel 141 includes a touch panel 114. The player is allowed to input instructions by touching the lower image display panel 141.

Figure 6:
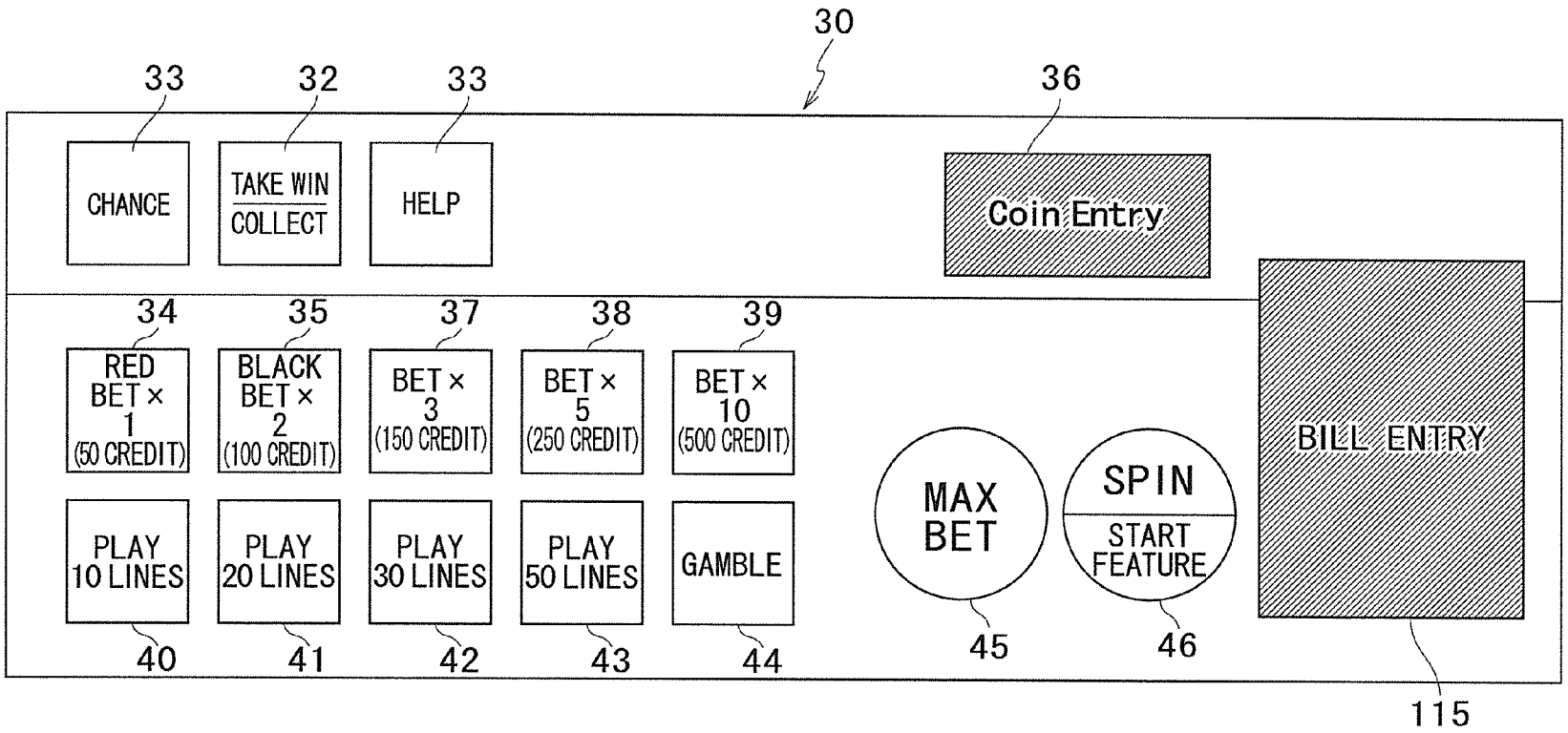
FIG. 6 shows a control panel of the slot machine of the embodiment of the present invention.

As shown in FIG. 4 and FIG. 6, below the lower image display panel 141 are provided various buttons on the control panel 30 (input device), a coin entry 36 which guides coins into the cabinet 11, and a bill entry 115.

The control panel 30 includes: a change button 31, a cashout/take win button 32, and a help button 33 arranged in the left side area of the upper stage; a 1-bet button 34, a 2-bet button 35, a 3-bet button 37, a 4-bet button 38, a 5-bet button 39, a play-10-lines button 40, a play-20-lines button 41, a play-30-lines button 42, a play-50-lines button 43, and a gamble button 44 in the left side area of the lower stage. Further, a coin entry 36 and a bill entry 115 for accepting bills or the like are arranged in the right side area of the upper stage, and a max bet button 45 and a spin button 46 are arranged in the right side area of the lower stage.

The change button 31 is an operation button to be used when temporarily leaving the seat, or when requesting a staff person of the gaming facility for an exchange. The cashout/take win button 32 is an operation button to be used for cashing out coins (credits) stored in the slot machine 1. The help button 33 is pressed when the operating method of a game is unclear. When the help button 33 is pressed, various types of help information are displayed on the upper image display panel 131 and the lower image display panel 141.

A 1-bet button 34 is arranged so that, each time the button is pressed, one gaming medium is bet on each active payline from the current credit owned by the player. A 2-bet button 35 is pressed to start a game on condition that two gaming media are bet on each active payline. A 3-bet button 37 is pressed to start a game on condition that three gaming media are bet on each active payline. A 4-bet button 38 is pressed to start a game on condition that four gaming media are bet on each active payline. A 5-bet button 39 is pressed to start a game on condition that five gaming media are bet on each active payline. A max bet button 45 is pressed to start a game on condition that ten gaming media are bet on each active payline. Thus, the bet amount on each payline is determined by pressing of the 1-bet button 34, the 2-bet button 35, the 3-bet button 37, the 4-bet button 38, the 5-bet button 39, and the max bet button 45.

A play-10-lines button 40 activates paylines when pressed. In this case, the number of paylines to be activated is 10. A play-20-lines button 41 activates paylines when pressed. In this case, the number of paylines to be activated is 20. A play-30-lines button 42 activates paylines when pressed. In this case, the number of paylines to be activated is 30. A play-50-lines button activates paylines when pressed. In this case, the number of paylines to be activated is 50.

The gamble button 44 is an operation button used for, for example, shifting to the gamble game after the end of the free game or the like. The gamble game here means a game run by using credit the player has won.

The spin button 46 is a button for starting scroll of the video reels 3 (3*a*, 3*b*, 3*c*, 3*d*, and 3*e*).

The coin entry 36 is for accepting coins into the cabinet 11. The bill entry 115 validates a bill, and accepts a genuine bill into the cabinet 11.

An upper image display panel 131 is provided at the front face of the top box 12. The upper image display panel 131 includes a liquid crystal panel, and forms the display. The upper image display panel 131 displays images related to effects and images showing introduction of the game contents and explanation of the game rules. Further, the top box 12 is provided with a speaker 112 and a lamp 111. The slot machine 1 produces effects by displaying images, outputting sounds, and outputting the light.

A ticket printer 171, a card slot 176, a data display 174, and a keypad 173 are provided on the lower side of the upper image display panel 131.

The ticket printer 171 prints on a ticket a barcode representing encoded data of the credit amount, date and time, the identification number of the slot machine 1, and the like, and then outputs the ticket as the ticket 175 with a barcode. The player is able to play games by causing the slot machine to read the ticket 175 with the barcode and to exchange the ticket 175 with the barcode for bills or the like at a predetermined location in the gaming facility (e.g., a counter in the casino).

The card slot 176 is provided to insert a card storing predetermined data thereto. The card stores, for example, data for identifying the player and data regarding the playing history of the player. From and to the card inserted into the card slot 176, data is read and written by a later-described card reader 172. The card may store data equivalent to coins, bills, or credits.

The data display 174 is constituted by a fluorescent display, LEDs and the like, and displays the data read by the card reader 172 and the data inputted by the player via the keypad 173, for example. The keypad 173 is provided to input instructions and data regarding the issuance of a ticket or the like.

[Symbol Columns of Video Reels]

Next, with reference to FIGS. 7 to 20, a configuration of the symbol columns on the video reels 3 of the slot machine 1 is described. Each of FIG. 7 to FIG. 10 shows the layout of symbols depicted on the circumferential surfaces of normal game video reel strips of the slot machine of the embodiment of the present invention. Each of FIG. 11 to FIG. 20 shows the layout of symbols depicted on the circumferential surfaces of five types of free game video reel strips of the slot machine of the embodiment of the present invention.

As shown in FIG. 7 to FIG. 10, to the first video reel ("Reel 1") 3*a* of the normal game video reel strip, a symbol column constituted by 100 symbols corresponding to the code numbers "00" to "99" is allocated. To the second video reel ("Reel 2") 3*b* of the normal game video reel strip, a symbol column constituted by 124 symbols corresponding to the code numbers "00" to "123" is allocated. To the third video reel ("Reel 3") 3*c* of the normal game video reel strip, a symbol column constituted by 124 symbols corresponding to the code numbers "00" to "123" is allocated. To the fourth video reel ("Reel 4") 3*d* of the normal game video reel strip, a symbol column constituted by 124 symbols corresponding to the code numbers "00" to "123" is allocated. To the fifth video reel ("Reel 5") 3*e* of the normal game video reel strip, a symbol column constituted by 117 symbols corresponding to the code numbers "00" to "116" is allocated.

The free game video reel strip of the type A shown in FIG. 11 and FIG. 12 is one of the free game video reel strips selected in the later-described free game video reel group selection process when shifted to the free game. To the first video reel ("Reel 1") 3*a* of the free game video reel strip of the type A, a symbol column constituted by 64 symbols corresponding to the code numbers "00" to "63" is allocated. To the second video reel ("Reel 2") 3*b* of the free game video reel strip of the type A, a symbol column constituted by 80 symbols corresponding to the code numbers "00" to "79" is allocated. To the third video reel ("Reel 3") 3*c* of the free game video reel strip of the type A, a symbol column constituted by 80 symbols corresponding to the code numbers "00" to "79" is allocated. To the fourth video reel ("Reel 4") 3*d* of the free game video reel strip of the type A, a symbol column constituted by 80 symbols corresponding to the code numbers "00" to "79" is allocated. To the fifth video reel ("Reel 5") 3*e* of the free game video reel strip of the type A, a symbol column constituted by 68 symbols corresponding to the code numbers "00" to "67" is allocated.

The free game video reel strip of the type B shown in FIG. 13 and FIG. 14 is one of the free game video reel strips selected in the later-described free game video reel group selection process when shifted to the free game. To the first video reel ("Reel 1") 3*a* of the free game video reel strip of the type B, a symbol column constituted by 64 symbols corresponding to the code numbers "00" to "63" is allocated. To the second video reel ("Reel 2") 3*b* of the free game video reel strip of the type B, a symbol column constituted by 80 symbols corresponding to the code numbers "00" to "79" is allocated. To the third video reel ("Reel 3") 3*c* of the free game video reel strip of the type B, a symbol column constituted by 80 symbols corresponding to the code numbers "00" to "79" is allocated. To the fourth video reel ("Reel 4") 3*d* of the free game video reel strip of the type B, a symbol column constituted by 80 symbols corresponding to the code numbers "00" to "79" is allocated. To the fifth video reel ("Reel 5") 3*e* of the free game video reel strip of the type B, a symbol column constituted by 68 symbols corresponding to the code numbers "00" to "67" is allocated.

The free game video reel strip of the type C shown in FIG. 15 and FIG. 16 is one of the free game video reel strips selected in the later-described free game video reel group selection process when shifted to the free game. To the first video reel ("Reel 1") 3*a* of the free game video reel strip of the type C, a symbol column constituted by 72 symbols corresponding to the code numbers "00" to "71" is allocated. To the second video reel ("Reel 2") 3*b* of the free game video reel strip of the type C, a symbol column constituted by 80 symbols corresponding to the code numbers "00" to "79" is allocated. To the third video reel ("Reel 3") 3*c* of the free game video reel strip of the type C, a symbol column constituted by 89 symbols corresponding to the code numbers "00" to "88" is allocated. To the fourth video reel ("Reel 4") 3*d* of the free game video reel strip of the type C, a symbol column constituted by 80 symbols corresponding to the code numbers "00" to "79" is allocated. To the fifth video reel ("Reel 5") 3*e* of the free game video reel strip of the type C, a symbol column constituted by 72 symbols corresponding to the code numbers "00" to "71" is allocated.

The free game video reel strip of the type D shown in FIG. 17 and FIG. 18 is one of the free game video reel strips selected in the later-described free game video reel group selection process when shifted to the free game. To the first video reel ("Reel 1") 3*a* of the free game video reel strip of the type D, a symbol column constituted by 64 symbols corresponding to the code numbers "00" to "63" is allocated. To the second video reel ("Reel 2") 3*b* of the free game video reel strip of the type D, a symbol column constituted by 76 symbols corresponding to the code numbers "00" to "75" is allocated. To the third video reel ("Reel 3") 3*c* of the free game video reel strip of the type D, a symbol column constituted by 85 symbols corresponding to the code numbers "00" to "84" is allocated. To the fourth video reel ("Reel 4") 3*d* of the free game video reel strip of the type D, a symbol column constituted by 80 symbols corresponding to the code numbers "00" to "79" is allocated. To the fifth video reel ("Reel 5") 3*e* of the free game video reel strip of the type D, a symbol column constituted by 72 symbols corresponding to the code numbers "00" to "71" is allocated.

The free game video reel strip of the type E shown in FIG. 19 and FIG. 20 is one of the free game video reel strips selected in the later-described free game video reel group selection process when shifted to the free game. To the first video reel ("Reel 1") 3*a* of the free game video reel strip of the type E, a symbol column constituted by 64 symbols corresponding to the code numbers "00" to "63" is allocated. To the second video reel ("Reel 2") 3*b* of the free game video reel strip of the type E, a symbol column constituted by 80 symbols corresponding to the code numbers "00" to "79" is allocated. To the third video reel ("Reel 3") 3*c* of the free game video reel strip of the type E, a symbol column constituted by 89 symbols corresponding to the code numbers "00" to "88" is allocated. To the fourth video reel ("Reel 4") 3*d* of the free game video reel strip of the type E, a symbol column constituted by 80 symbols corresponding to the code numbers "00" to "79" is allocated. To the fifth video reel ("Reel 5") 3*e* of the free game video reel strip of the type E, a symbol column constituted by 72 symbols corresponding to the code numbers "00" to "71" is allocated.

As shown in FIG. 7 to FIG. 10, on the normal game video reel strips, special symbols such as "WILD (Shellfish)" which is an all-purpose (almighty) symbol which can replace any symbols and "FEATURE (Pearl)" which is a symbol triggering the free game are provided. On the reel strips, furthermore, normal symbols other than the special symbols, such as "R_MERMAID (Red Mermaid)", "P_MERMAID (Pink Mermaid)", "Y_MERMAID (Yellow Mermaid)", "G_MERMAID (Green Mermaid)", "B_MERMAID (Blue Mermaid)", "Y_FISH (Yellow Fish)", "O_FISH (Orange Fish)", "B_FISH (Blue Fish)", "S_FISH (Star Fish)", "R_CORAL (Red Coral)", and "Y_CORAL (Yellow Coral)" are provided.

In the meanwhile, as shown in FIG. 11 to FIG. 20, on the free game video reel strips of the types A to E, "WILD (Shellfish)", "R_MERMAID (Red Mermaid)", "P_MERMAID (Pink Mermaid)", "Y_MERMAID (Yellow Mermaid)", "G_MERMAID (Green Mermaid)", "B_MERMAID (Blue Mermaid)", "Y_FISH (Yellow Fish)", "O_FISH (Orange Fish)", "B_FISH (Blue Fish)", "S_FISH (Star Fish)", "R_CORAL (Red Coral)", and "Y_CORAL (Yellow Coral)" are provided. Being different from the normal game video reel strips, "FEATURE (Pearl)" is not provided.

In the present embodiment, on the normal game video reel strips, as shown in FIG. 7, four "WILD" which are all-purpose (almighty) symbols each of which can replace any symbols are successively arranged in the code numbers "29" to "32" of the second video reel ("Reel 2") 3*b* or the like, and eight "R_MERMAID" which are the normal symbols are successively arranged in the code numbers "33" to "40" of the second video reel ("Reel 2") 3*b* or the like. As such, when at least four symbols of the same type are successively arranged on a video reel, the same symbols may be successively displayed in the four regions, i.e., the upper stage, the upper middle stage, the lower middle stage, and the lower stage of the symbol display region 4 displaying the video reel. In the present embodiment, furthermore, symbols of the same type are successively arranged in the free game video reel strips of the types A to E.

As described above, it has been known to increase the possibility of acquisition of a payout and the occurrence of the free game trigger by successively providing special symbols such as "WILD" and "FEATURE" on a video reel. However, there have been no slot machines in which normal symbols which are not special symbols such as "WILD" and "FEATURE" are successively arranged on a video reel.

By successively arranging normal symbols other than the special symbols such as "WILD" and "FEATURE", it is possible to display, in an easy-to-understand manner, whether a win with which a payout is obtained is established, in a slot machine having complicated paylines such as 50 lines and 100 lines. For example, when four "R_MERMAID" are successively arranged in the four regions, i.e., the upper stage, the upper middle stage, the lower middle stage, and the lower stage of the symbol display region 4 displaying the first video reel 3*a*, the player can easily understand that his/her hope should be put on whether "R_MERMAID" is arranged in any of the four stages, i.e., the upper stage, the upper middle stage, the lower middle stage, and the lower stage of the symbol display region 4 displaying the second video reel 3*b* which will stop next. As such, whether the win with which a payout is obtained is established or not is displayed in an easy-to-understand manner.

In addition to the above, the present embodiment is arranged such that, on the free game video reel strips of the types A to E, the number of the successively-arranged normal symbols is larger than the number of such symbols on the normal game video reel strips (see FIG. 11 to FIG. 20). For example, on the free game video reel strip of the type A, 32 successive "R_MERMAID" symbols are allocated to the code numbers "00" to "31" of the first to fifth video reels 3*a*, 3*b*, 3*c*, 3*d*, and 3*e*. In other words, as compared to the first to fifth video reels 3*a*, 3*b*, 3*c*, 3*d*, and 3*e* of the normal game video reel strips, more "R_MERMAID" symbols are successively arranged. (The same holds true for the types B to E). To put it differently, the number of the predetermined symbols (such as "R_MERMAID") laid out on the free game video reel strips of the types A to E used in the free game is larger than the number of the predetermined symbols laid out on the video reel strips used in the normal game. Therefore, provided that the predetermined symbols are symbols advantageous for the player, the probability of receiving an advantageous payout (benefit) is higher in the free game than in the normal game, and the player's expectation for the payout (benefit) is increased.

In addition to the above, in the free game, the expectation for the awarded payout (benefit) is differentiated between the types A to E of the free game video reel strips to be used. This causes the player to be interested in the random determination of the types A to E of the free game video reel strips used in the free game.

(Re-Trigger Table)

Now, referring to FIG. 28, a re-trigger table which is referred to in the later-described free game process will be described.

The re-trigger table is a random determination table used for determining, after the execution of the free game for a predetermined number of times is finished, whether to award the right to execute the free game for the predetermined number of times again. As shown in FIG. 28, the right to execute the free game for the predetermined number of times again is awarded at the winning probability of 1/2. This winning probability may be determined at will.

<Structures of Circuits Provided to Slot Machine>

Figure 21:
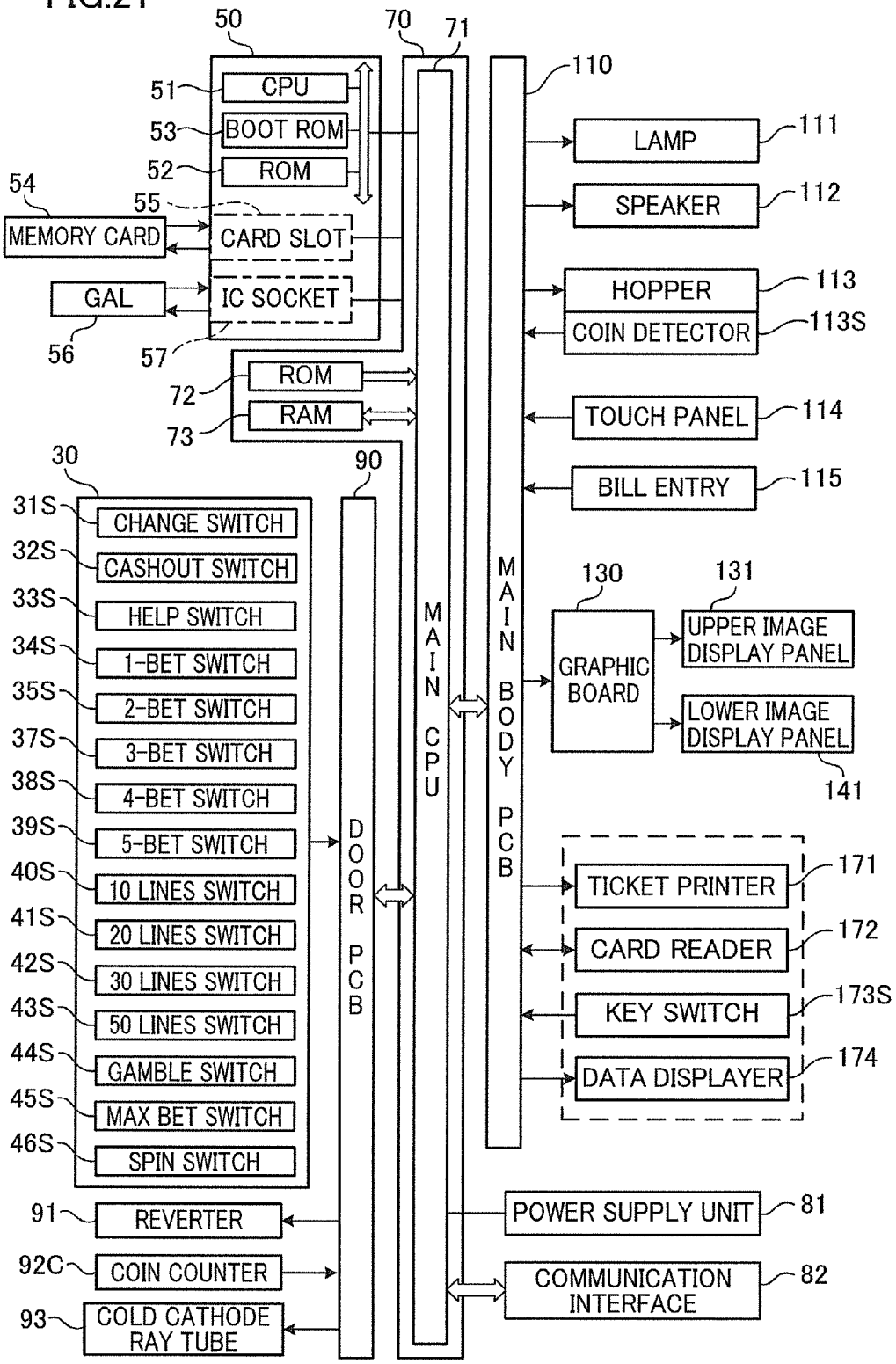
FIG. 21 is a block diagram showing an internal structure of the slot machine of the embodiment of the present invention.

Next, with reference to FIG. 21, a configuration of a circuit included in the slot machine 1 is described. FIG. 21 is a block diagram showing an internal structure of the slot machine of the embodiment of the present invention.

A gaming board 50 is provided with a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a nonvolatile memory, and stores a game program and a game system program. The game program includes a program related to game progression, a random determination program, and a program for producing effects by images and sounds (see e.g., FIGS. 24 to 26 described later). Furthermore, the game program includes data (see FIG. 7 to FIG. 20) defining the arrangement of the symbol column allocated to each video reel 3.

The random determination program is a program for randomly determining to-be stopped symbol on the video reels 3. The to-be stopped symbol is data for determining four symbols to be displayed to the symbol display region 4 out of plural symbols forming each symbol column. The slot machine 1 of the embodiment of the present invention determines, as the to-be stopped symbol, the symbols to be displayed in a predetermined area (e.g. the uppermost stage) out of the four areas provided for each of the video reels 151-155 of the symbol display region 4.

The aforementioned random determination program includes symbol determination data. The symbol determination data is data that specifies random numbers so that each of the symbols forming the symbol column is determined at an equal probability for each of the video reels 3. For example, for the first video reel ("Reel 1") 3*a* of the normal game video reel strip, the data specifies the random numbers such that 100 symbols (with the code numbers "00" to "99") constituting the symbol column are determined at the same probability (i.e., 1/100). However, because the number of the symbols in 100 symbols is different between the types, the probability of the selection is different between the types of the symbols (i.e., the types are differently weighted). For example, in FIG. 7 to FIG. 10, the symbol column of the first video reel ("Reel 1") 3*a* of the normal game video reel strip includes 12 "R_MERMAID" symbols and 4 "S_FISH" symbols. Therefore the former is selected at the probability of "12/100" whereas the latter is selected at the probability of "4/100".

While in the embodiment of the present invention the data is arranged to differentiate the number of symbols constituting the symbol column between the video reels 3, the number of symbols constituting the symbol column may be identical between the video reels 3. For example, each of all symbol columns of the video reels 3*a* to 3*e* of the normal game video reel strips and free game video reel strips may be constituted by 22 symbols. This arrangement increases the degree of freedom in setting the probabilities of the selection of the symbols of different types in each video reel 3.

Further, the card slot 55 is configured so that the memory card 54 can be inserted thereinto and removed therefrom, and is connected to a motherboard 70 by an IDE bus.

The GAL 56 is a type of PLD (programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents and settings of the game to be played on the slot machine 1 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like. The authentication program is a program (falsification check program) for authenticating the game program and the game system program. The pre-authentication program is a program for authenticating the aforementioned authentication program. The authentication program and the pre-authentication program are written along a procedure (authentication procedure) for proving that the program to be the subject has not been falsified.

The motherboard 70 is provided with a main CPU 71, a ROM 72, a RAM 73, and a communication interface 82.

The ROM 72 includes a memory device such as a flash memory, and stores a program such as BIOS to be executed by the main CPU 71, and permanent data. When the BIOS is executed by the main CPU 71, a process for initializing predetermined peripheral devices is executed. Further, through the gaming board 50, a process of loading the game program and the game system program stored in the memory card 54 is started.

The processor of the present invention includes the main CPU 71, the ROM 72, and the RAM 73 above and the memory card 54 storing the game program and the game system program, and controls the slot machine by causing the CPU 71 to execute the game program and the game system program. Needless to say, the processor may alternatively store the game program and the game system program in the ROM 72 instead of the memory card 54.

The RAM 73 stores data and programs which are used in operation of the main CPU 71. For example, when the process of loading the aforementioned game program, game system program or authentication program is executed, the RAM 73 can store the program. The RAM 73 is provided with working areas used for operations in execution of these programs. Examples of the areas include: an area that stores counters for the number of games, the bet amount, the payout amount, the credit amount and the like; and an area that stores symbols (code numbers) randomly determined.

The communication interface 82 is for communicating with the external controller 200 such as a server, through the communication line 301. Further, the motherboard 70 is connected with a later-described door PCB (Printed Circuit Board) 90 and a main body PCB 110 by respective USBs. The motherboard 70 is also connected with a power supply unit 81. When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the main body PCB 110 are connected with input devices such as a switch and a sensor, and peripheral devices the operations of which are controlled by the main CPU 71. The door PCB 90 is connected with a control panel 30, a reverter 91, a coin counter 92C and a cold cathode tube 93.

The control panel 30 includes: a change switch 31S, a cashout switch 32S, a help switch 33S, a 1-bet switch 34S, a 2-bet switch 35S, a 3-bet switch 37S, a 4-bet switch 38S, a 5-bet switch 39S, a play-10-lines switch 40S, a play-20-lines switch 41S, a play-30-lines switch 42S, a play-50-lines switch 43S, a gamble switch 44S, a max-bet switch 45S, and a spin switch 46S, which correspond to the above described buttons, respectively. Each of the switches outputs a signal to the main CPU 71 upon detection of the pressing of the button corresponding thereto by the player.

The coin counter 92C checks whether a coin inserted into the coin receiving slot 36 is genuine in terms of the material, shape, or the like. When determining that the coin is genuine, the coin counter 92C outputs a signal to the main CPU 71. Non-genuine coins are ejected through a coin payout exit 15A.

The reverter 91 operates based on a control signal output from the main CPU 71, and distributes valid coins validated by the coin counter 92C into a hopper 113 or a cash box (not illustrated). That is, coins are distributed into the hopper 113 when the hopper 113 is not filled with coins, while coins are distributed into the cash box when the hopper 113 is filled with coins.

The cold cathode tube 93 functions as a backlight installed on the rear face side of the upper image display panel 131 and the lower image display panel 141, and turns on based on a control signal outputted from the main CPU 71.

To the main body PCB 110 are connected the lamp 111, the speaker 112, a hopper 113, a coin detection unit 113S, the touch panel 114, the bill validator 115, a graphic board 130, a ticket printer 171, a card reader 172, a key switch 173S and the data display 174.

The lamp 111 turns on based on a control signal outputted from the main CPU 71. The speaker 112 outputs sounds such as BGM, based on a control signal outputted from the main CPU 71.

The hopper 113 operates based on a control signal outputted from the main CPU 71, and pays out a designated number of coins from the coin payout exit 15A to the coin tray 18. The coin detection unit 113S outputs a signal to the main CPU 71 upon detection of coins paid out by the hopper 113.

The touch panel 114 detects a place on the lower image display panel 141 touched by the player's finger or the like, and outputs to the main CPU 71 a signal corresponding to the detected place. Upon acceptance of a valid bill, the bill validator 115 outputs to the main CPU 71 a signal corresponding to the face amount of the bill.

The graphic board 130 controls image display executed by the respective upper image display panel 131 and lower image display panel 141, based on a control signal outputted from the main CPU 71. The symbol display region 4 of the lower image display panel 141 displays the five video reels 3 by which the scrolling and stop motions of the symbol columns included in the respective video reels 3 are displayed. The graphic board 130 is provided with a VDP generating image data, a video RAM temporarily storing the image data generated by the VDP, and the like.

The graphic board 130 is provided with the VDP (Video Display Processor) generating image data based on a control signal outputted from the main CPU 71, the video RAM temporarily storing the image data generated by the VDP, and the like. It is to be noted that the image data used in generation of image data by the VDP is included in the game program that has been read from the memory card 54 and stored into the RAM 73.

Based on a control signal outputted from the main CPU 71, the ticket printer 171 prints on a ticket a barcode representing encoded data of the credit amount stored in the RAM 73, date and time, the identification number of the slot machine 1, and the like, and then outputs the ticket as the ticket 175 with a barcode.

The card reader 172 reads data stored in a card inserted into the card slot 176 and transmits the data to the main CPU 71, or writes data into the card based on a control signal outputted from the main CPU 71.

The key switch 173S is provided in the keypad 173, and outputs a predetermined signal to the main CPU 71 when the keypad 173 has been operated by the player.

The data display 174 displays data read by the card reader 172 and data inputted by the player through the keypad 173, based on a control signal outputted from the main CPU 71.

[Arrangement of Symbol Combination Table]

Now, symbol combination tables will be described with reference to FIG. 22 and FIG. 23. FIG. 22 shows a symbol combination table for the normal game of the slot machine of the embodiment of the present invention. FIG. 23 shows a symbol combination table for the free game in the slot machine of the embodiment of the present invention.

The symbol combination tables for the normal game and the free game define the combinations of symbols with which a win (WIN) is achieved and payout amounts. In the slot machine 1, a win is achieved when the scroll of the symbol column of each video reel 3 is stopped and a combination of symbols displayed on an activated payline (see FIG. 5) is identical with a combination of symbols defined in the symbol combination table. In accordance with the type of win, a benefit such as the payout of coins or the start of the free game is awarded to the player. It is noted that a win is not established (i.e. the game is lost) when the combination of symbols displayed on the payline does not match any of the combinations of symbols specified by the symbol combination table.

Basically, in regard to "R_MERMAID (Red Mermaid)", "P_MERMAID (Pink Mermaid)", "Y_MERMAID (Yellow Mermaid)", "G_MERMAID (Green Mermaid)", "B_MERMAID (Blue Mermaid)", "Y_FISH (Yellow Fish)", "O_FISH (Orange Fish)", "B_FISH (Blue Fish)", "S_FISH (Star Fish)", "R_CORAL (Red Coral)", and "Y_CORAL (Yellow Coral)" symbols, a win is established when three, four, or all of five symbols of the same type are displayed on a payline by the video reels 3. In regard to "R_MERMAID (Red Mermaid)", "P_MERMAID (Pink Mermaid)", "Y_MERMAID (Yellow Mermaid)", "G_MERMAID (Green Mermaid)", and "B_MERMAID (Blue Mermaid)" symbols, a win is established when two symbols of the same type are displayed on a payline by the video reels 3. The "WILD" symbol is able to substitute for "R_MERMAID (Red Mermaid)", "P_MERMAID (Pink Mermaid)", "Y_MERMAID (Yellow Mermaid)", "G_MERMAID (Green Mermaid)", "B_MERMAID (Blue Mermaid)", "Y_FISH (Yellow Fish)", "O_FISH (Orange Fish)", "B_FISH (Blue Fish)", "S_FISH (Star Fish)", "R_CORAL (Red Coral)", and "Y_CORAL (Yellow Coral)" symbols.

For example, in the normal game and the free game, when five "R_MERMAID" symbols are displayed on a payline of the symbol display region 4 by all video reels 3, it is determined that the payout amount is "100". Based on the determined payout amount, coins are paid out. The payout of the coins is done by actually ejecting coins through the coin payout exit 15A, making addition to the credit amount, or issuing a ticket with a barcode.

The "FEATURE" symbol used only in the normal game is a symbol triggering the free game. When three "FEATURE" symbols of the video reels 3*a* to 3*e* are displayed on an activated payline in the symbol display region 4, "2" is selected as a payout amount of scatter payment. Then the free game starts at the next game. In the present embodiment, the "FEATURE" symbol is not used in the free game (see FIG. 23).

<Contents of Program>

Now, the program to be executed by the slot machine 1 is described with reference to FIGS. 24 to 26.

(Main Control Process)

Figure 24:
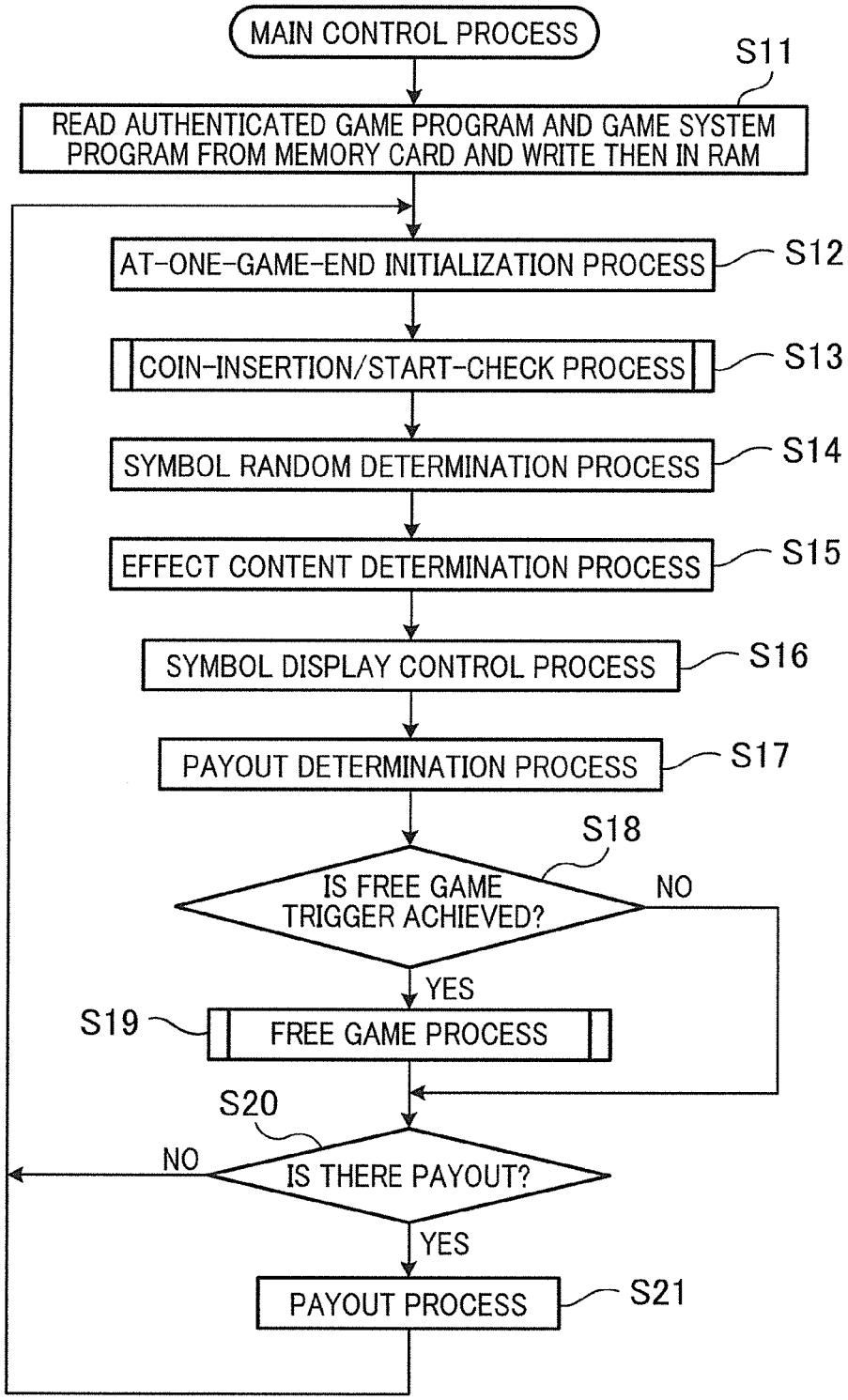
FIG. 24 is a flowchart of a main control process in the slot machine of the embodiment of the present invention.

First, with reference to FIG. 24, a main control process is described.

First, when the slot machine 1 is powered on, the main CPU 71 reads the authenticated game program and game system program from the memory card 54 through the gaming board 50, and writes the programs into the RAM 73 (S11).

Next, the main CPU 71 executes at-one-game-end initialization process (S12). For example, data that becomes unnecessary after each game in the working areas of the RAM 73, such as the bet amount and the symbols randomly determined, is cleared.

The main CPU 71 executes a coin-insertion/start-check process which is described later with reference to FIG. 25 (S13). In this process, an input check or the like is executed for the 1-bet switch 34S, the 2-bet switch 35S, the 3-bet switch 37S, the 4-bet switch 38S, the 5-bet switch 39S, the max-bet switch 45S, the play-10-lines switch 40S, the play-20-lines switch 41S, the play-30-lines switch 42S, the play-50-lines switch 43S, the spin switch 46S, or the like.

The main CPU 71 then executes a symbol random determination process (S14). In the process, to-be stopped symbol is determined based on the random numbers for symbol determination.

Specifically, the main CPU 71 first samples random numbers for symbol determination. The main CPU 71 then randomly determines to-be stopped symbol for the video reels 3. The main CPU 71 executes random determination for each of the video reels 3, and determines any one of the symbols as the to-be stopped symbol. The probabilities of the respective symbols being determined are basically equal. The main CPU 71 stores the determined to-be stopped symbol of each video reel 3 in a symbol storing area in the RAM 73.

The main CPU 71 then executes an effect contents determination process (S15). The main CPU 71 samples an effect-use random number, and randomly selects any of the effect contents from the preset plurality of effect contents.

Next, the main CPU 71 executes the symbol display control process (S16). In the process, the scroll of the symbol column of each video reel 3 is started, and the to-be stopped symbol determined in the symbol random determination process of S14 is stopped at a predetermined position (e.g. the upper area in the symbol display region 4). That is, 20 symbols including the to-be stopped symbol are displayed in the symbol display region 4. For example, when the to-be stopped symbol is the symbol with the code number "10" and this symbol is displayed in the upper stage, the symbols with the code numbers "11", "12", and "13" are displayed in the upper middle stage, the lower middle stage, and the lower stage of the symbol display region 4, respectively.

The main CPU 71 then executes a payout determination process (S17). In this process, the symbol combination table for the normal game (see FIG. 22) stored in the RAM is referred to, and the payout amount is determined based on a combination of the symbols displayed on an active payline, and the payout amount thus determined is stored in the payout amount storage area in the RAM 73.

Next, the main CPU 71 determines whether or not a free game trigger is met (S18). In the present embodiment, the shifting to the free game is triggered when three "FEATURE" symbols are displayed on an activated payline in the symbol display region 4. When the free game trigger has been met (S18: YES), the main CPU 71 executes the later-described free game process (S19).

Thereafter, after the step S19 or when it is determined in the step S18 that the free game trigger is not established (S18: NO), the main CPU 71 determines whether there is a payout (S20). That is to say, whether a payout has been awarded in S17 or S19 is determined. When there is a payout (S20: YES), a payout process is executed (step S21). The main CPU 71 adds the value stored in the payout amount storage area to the value stored in the credit amount storage area provided in the RAM 73. Alternatively, the hopper 113 may be driven based on an input to the collect switch 32S, and coins are discharged to the coin tray 15 according to the value stored in the payout amount storage area. After this process or when it is determined in S20 that there is no payout (S20: NO), the process proceeds to the step S12.

(Coin-Insertion/start-Check Process)

Figure 25:
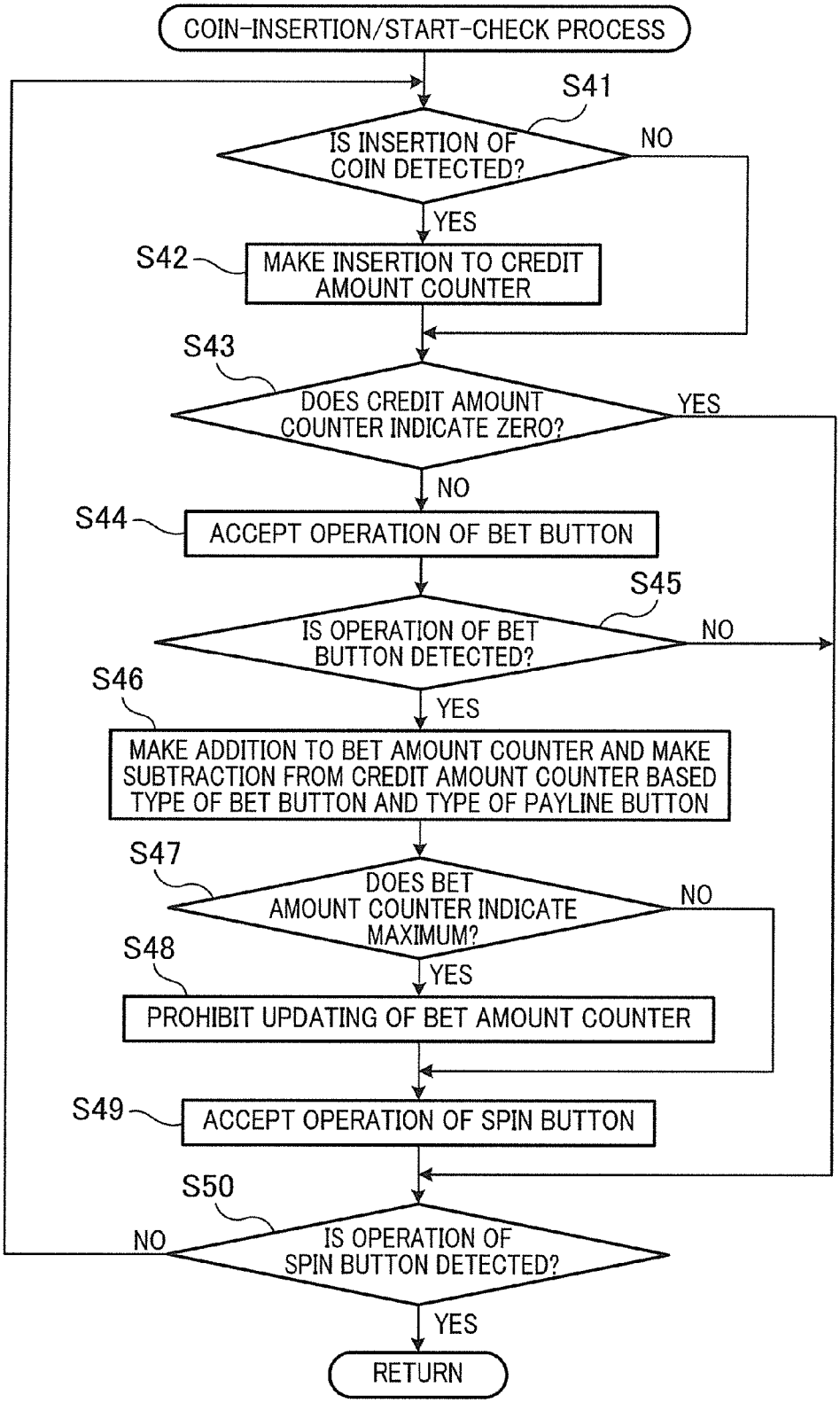
FIG. 25 is a flowchart of a coin-insertion/start-check process of the slot machine of the embodiment.
Figure 26:
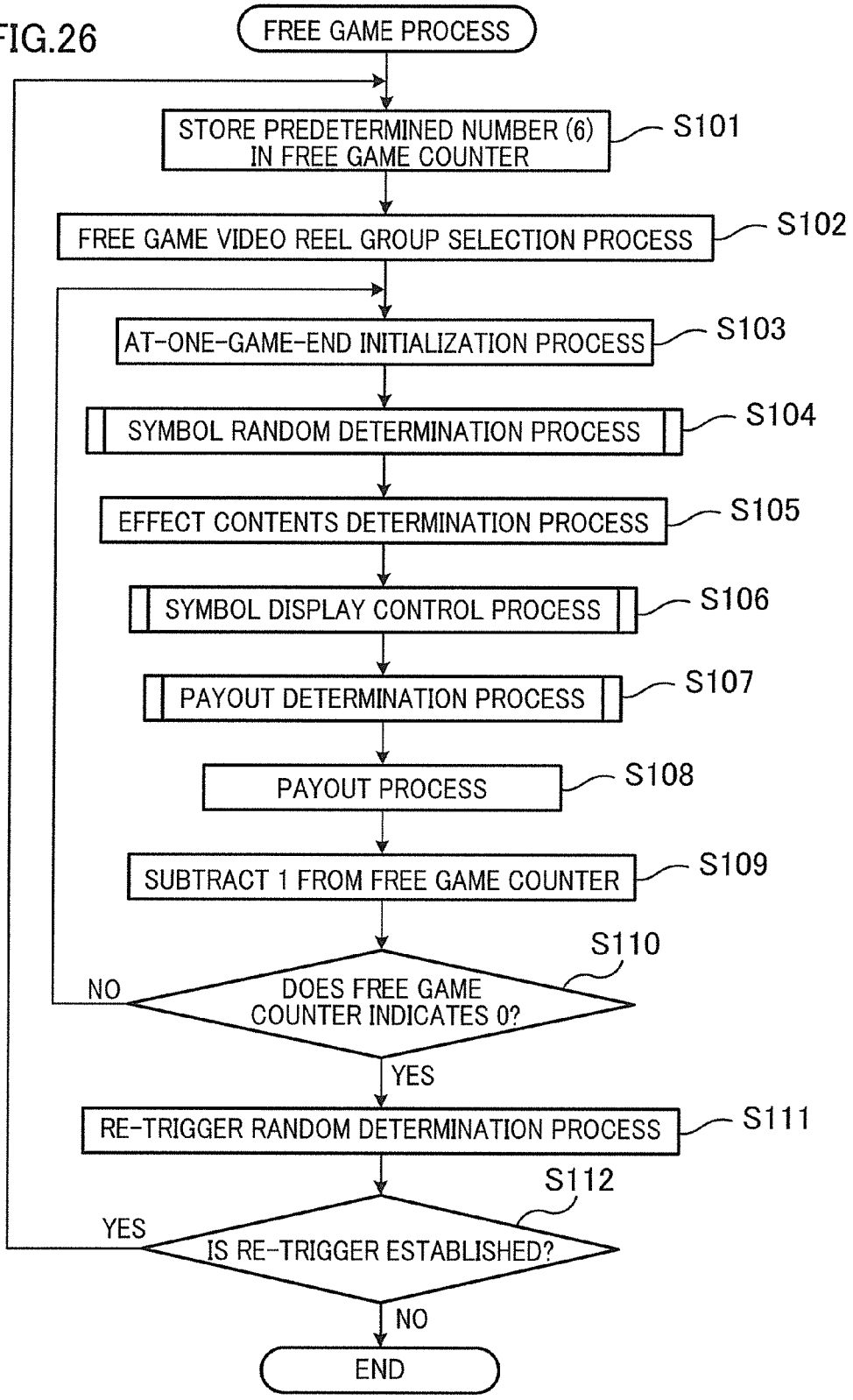
FIG. 26 is a flowchart of a free game process of the slot machine of the embodiment of the present invention.

Next, with reference to FIG. 25, the coin-insertion/start-check process is described.

First, the main CPU 71 determines whether or not insertion of a coin has been detected by the coin counter 92C (S41). When determining that the insertion of a coin has been detected, the main CPU 71 makes addition to the value stored in the credit amount storage area (S42). It is to be noted that the main CPU 71 may determine whether or not insertion of a bill has been detected by the bill entry 115, and when determining that the insertion of a bill has been detected, the main CPU 71 may add a value according to the bill to the value stored in the credit amount storage area.

After S42 or when determining in S41 that the insertion of a coin has not been detected, the main CPU 71 determines whether or not the value stored in the credit amount storage area is zero (S43). When the main CPU 71 determines that the value stored in the credit amount storage area is not zero, the main CPU 71 permits operation acceptance of the bet buttons (1-bet button 34, 2-bet button 35, 3-bet button 37, 4-bet button 38, 5-bet button 39, and max bet button 45) (S44). Note that, in S44, an operation of the payline button (play-10-lines button 40, play-20-lines button 41, play-30-lines button 42, and play-50-lines button 43) is enabled. Operation of the payline button enables activation of a desirable number of paylines (see FIG. 5).

Next, the main CPU 71 determines whether or not operation of any of the BET buttons has been detected (S45). When the main CPU 71 determines that the bet switch (1-bet switch 34S, 2-bet switch 35S, 3-bet switch 37S, 4-bet switch 38S, 5-bet switch 39S, and max-bet switch 45S) has detected the pressing of the BET button by the player, the main CPU 71 makes addition to a value stored in a bet amount storage area provided in the RAM 73 and makes subtraction from the value stored in the credit amount storage area, based on the type of the bet button and the type of the payline button (S46).

The main CPU 71 then determines whether or not the value stored in the bet amount storage area is at its maximum (S47). The main CPU 71, when determining that the value stored in the bet amount storage area is the maximum value, prohibits updating of the value stored in the bet amount storage area (S48). After S48 or when determining in S47 that the value stored in the bet amount storage area is not at its maximum, the main CPU 71 permits operation acceptance of the start button 46 (S49).

After S49, when determining in S45 that the operation of any of the BET buttons has not been detected, or when determining in S43 that the value stored in the credit amount storage area is zero, the main CPU 71 determines whether or not operation of the start button 46 has been detected (S50). The main CPU 71 shifts the process to S41, when determining that no operation of the start button 46 is detected.

When the main CPU 71 determines that the operation of the spin button 46 has been detected, the coin-insertion/start-check process is ended.

<Free Game Process>

Now, referring to FIG. 26, a free game process will be described. FIG. 26 is a flowchart of a free game process of the slot machine of the embodiment of the present invention.

To begin with, when the free game process is executed, the main CPU 71 awards the right to execute the free game for a predetermined number of times (6 in the present embodiment). While in the present embodiment the right to execute the free game for 6 times is always awarded, one of plural numbers of times of execution of the free game, e.g., "5", "10", and "20" may be randomly selected by sampling a random number for selecting the number of times of execution of the free game.

The main CPU 71 then stores the awarded number of times of execution of the free game (6) in a number of times of execution of free game counter provided in the RAM 73 (step S101).

Subsequently, the main CPU 71 executes a free game video reel group selection process (step S102).

Figure 27:
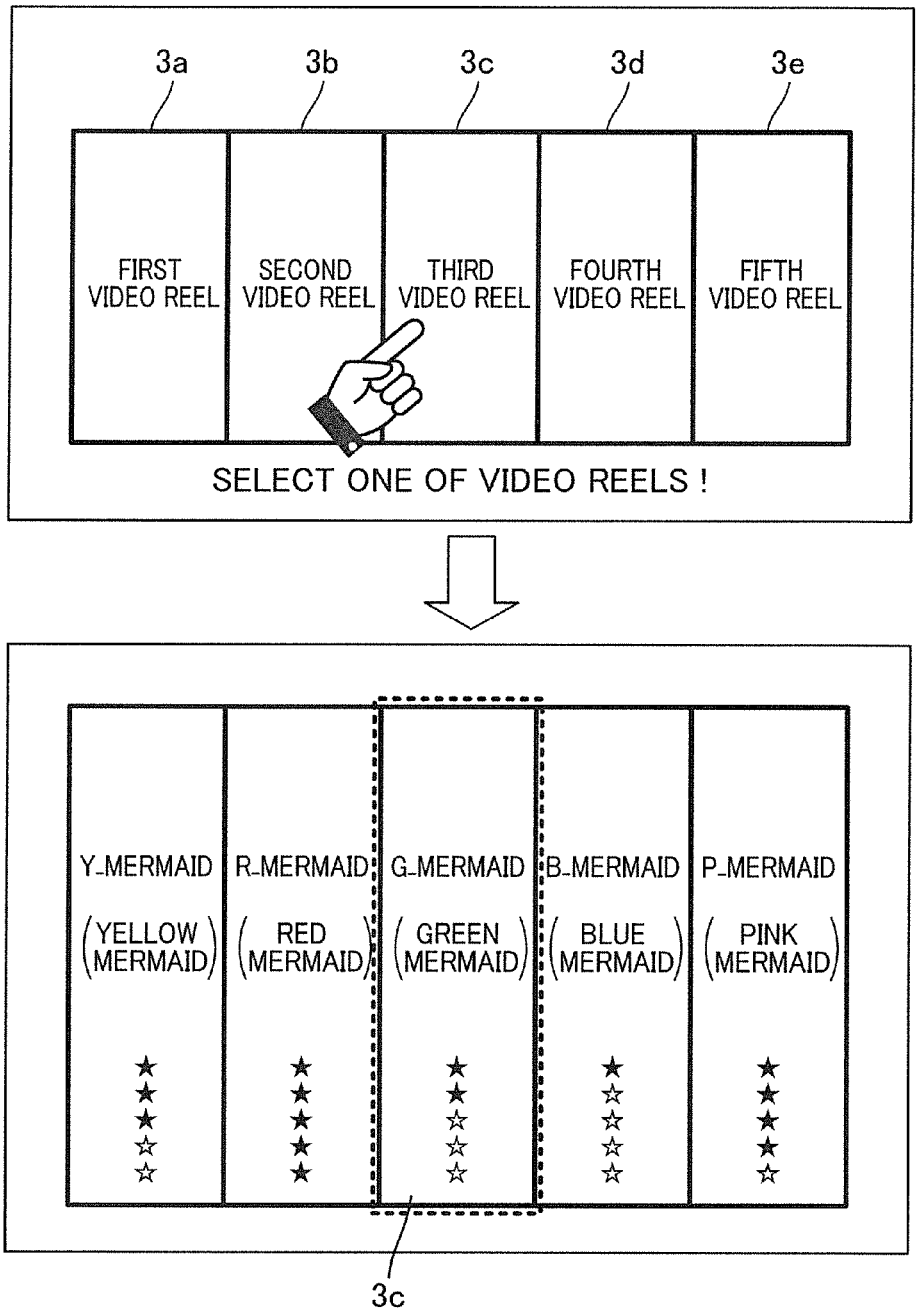
FIG. 27 shows a free game video reel group selection process of the slot machine of the embodiment of the present invention.

In this free game video reel group selection process, to begin with, as shown in FIG. 27, first to fifth video reels 3*a* to 3*e* are displayed on the lower image display panel 141 as five options. Then one of the five free game video reel strips of the types A to E is randomly associated with each of the five video reels 3, i.e., the first to fifth video reels 3*a* to 3*e*.

Subsequently, as shown in FIG. 27, a comment ("Select one of video reels") encouraging the player to select one of the first to fifth video reels 3*a* to 3*e* is displayed on the lower image display panel 141. When one of the first to fifth video reels 3*a* to 3*e* is touched (selected) by the touch panel 114, the video reel strip (of one of the types A to E) associated with the selected video reel 3 is selected as the video reel strip used in the free game.

In so doing, as shown in FIG. 27, an image representing the selected video reel strip is displayed o the selected video reel 3. For example, as shown in FIG. 27, when the player selects the third video reel 3*c*, an image of the "G_MERMAID (Green Mermaid: type D)" associated with the third video reel 3*c* is displayed. Furthermore, images representing the video reel strips associated with the first to fifth video reels 3*a* to 3*e* not selected by the player are also displayed.

In addition to the above, expectations of payouts from video reel strips associated with the first to fifth video reels 3*a* to 3*e*, respectively, are displayed. For example, as shown in FIG. 27, for "R_MERMAID (Red Mermaid: type A)" having the highest expectation of payout, five black stars are displayed (the higher the expectation of payout is, the more the stars are displayed). For "P_MERMAID (Pearl Mermaid: type B)" having the second highest expectation of payout, four black stars are displayed. For "Y_MERMAID (Yellow Mermaid: type C)" having the third highest expectation of payout, three black stars are displayed. For "G_MERMAID (Green Mermaid: type D)" having the fourth highest expectation of payout, two black stars are displayed. For "B_MERMAID (Blue Mermaid: type E)" having the fifth highest expectation of payout, one black star is displayed. The third video reel 3*c* selected by the player is highlighted as shown in FIG. 27.

In regard to the above, the expectation includes not only the expectation of payout from the execution of the free game once using each of the video reel strips of the types A to E but also the prospect of payout resulting from the execution of the free game for the awarded number of times.

For example, provide that the number of times of execution of the free game to be awarded when the trigger of the free game is established is determined randomly or at will, even if the expectation per the execution of the game once is higher in "R_MERMAID (Red Mermaid: type A)" than in "B_MERMAID (Blue Mermaid: type E)", the prospect of payout resulting from the execution of the free game for the awarded number of times may be higher in "B_MERMAID (Blue Mermaid: type E)" than in "R_MERMAID (Red Mermaid: type A)", when the number of times of execution of the free game is larger in the "B_MERMAID (Blue Mermaid: type E)" than in "R_MERMAID (Red Mermaid: type A)". In this case, the number of stars displayed on the lower image display panel 141 is larger in "B_MERMAID (Blue Mermaid: type E)" than in "R_MERMAID (Red Mermaid: type A)". As such, the expectation (stars in the present embodiment) displayed on the lower image display panel 141 encompasses the prospect of payout in consideration of the awarded number of times of execution of the free game. The expectation may be not only clearly notified to the player but also suggested to the player by visual and/or sound effects or the like.

While in the free game video reel group selection process above the player is encouraged to select one of the first to fifth video reels 3*a* to 3*e* and determine the video reel strip used in the free game, the video reel used in the free game may be automatically selected from the video reels of the A to E types, when the right to execute the free game is awarded. The shifting from the normal game to the free game is smoothly done in this case, because the selection by the player is omitted.

Next, the main CPU 71 executes the at-one-game-end initialization process (S103) in the same manner as in the step S12. Subsequently, the main CPU 71 performs the symbol random determination process in the same manner as in S14, based on the video reel strip for the free game selected in S102 (step S104). The main CPU 71 then executes the effect contents determination process (S105) in the same manner as in the step S15. Next, the main CPU 71 executes the symbol display control process (S106) in the same manner as in the step S16. The main CPU 71 then executes the payout determination process (S107) in the same manner as in the step S17.

Subsequently, the main CPU 71 executes a payout process (step S108). In this payout process, the main CPU 71 adds the value stored in a payout counter in the above-described payout determination process in the step S107 to the value stored in a free game payout counter. The free game payout counter is an area where the total payout amount determined during the free game is stored. When the free game process ends, the main CPU 71 adds, in the payout process in the step S21, the value stored in the free game payout counter to a credit amount counter provided in the RAM 73. In other words, the total payout amount determined in the free game is awarded at once. The payout may be awarded by ejecting coins from the coin payout exit 15A or by issuing a ticket with a barcode.

Subsequently, the main CPU 71 subtracts 1 from the number of times of execution of free game stored in the counter (step S109). The main CPU 71 then determines whether the number of times of execution of free game stored in the counter is 0 (step S110). When determining that the number of times of execution of free game stored in the counter is not 0, the main CPU 71 proceeds to the step S103.

In the meanwhile, when the number of times of execution of free game counter is 0 (S110: YES), a re-trigger random determination process is executed (S111). This re-trigger random determination process is a process to determine whether to award the right to execute the free game for the predetermined number of times (6 times) again, based on the above-described re-trigger table shown in FIG. 28.

The main CPU 71 then determines whether the re-trigger is established in S111 (step S112). When the right to execute the free game for the predetermined number of times is awarded again (S112: YES), the main CPU 71 proceeds to S101. In other words, the right to execute the free game for the predetermined number of times (6 times in the present embodiment) is awarded again.

In the meanwhile, when the right to execute the free game for the predetermined number of times is not awarded again (S112: NO), the free game process is terminated. When the free game process is terminated, the processing proceeds to the step S20 having been described with reference to FIG. 24.

According to the arrangement above, when the free game trigger is established (i.e., the right to execute the free game is awarded) in the normal game, the video reel groups of the types A to E for the free game, which are different from one another in the symbol layout, are randomly associated with the first to fifth video reels 3*a* to 3*e* as options, and the player selects one of the first to fifth video reels 3*a* to 3*e* as an option. As such, the video reel group of one type for the free game, which is associated with the selected video reel, is set as the video reel group used in the free game. This process of determining the video reel group used in the free game through the selection by the player is carried out also when the right to execute the free game is awarded again as a result of random determination after the free game is executed for the predetermined number of times (6 times).

This allows the player to enjoy the game with freshness, as the video reel group with a different layout of the symbols is used each time the free game is executed for the predetermined number of times (6 times). The layout of the symbols encompasses the type, total number, and arrangement of the symbols.

Furthermore, before the start of the free game, the player is able to check the expectation of payout of one of the free game video reel groups of the types A to E corresponding to the first to fifth video reels 3*a* to 3*e*, which is an option selected by the player.

[Image Display]

Now, image display by the slot machine 1 will be described with reference to FIG. 29 and FIG. 30.

<Image Display in Normal State>

To begin with, image display in the normal game will be described with reference to FIG. 29. FIG. 29 shows the image display in the normal game in the slot machine of the embodiment of the present invention.

Figure 29:
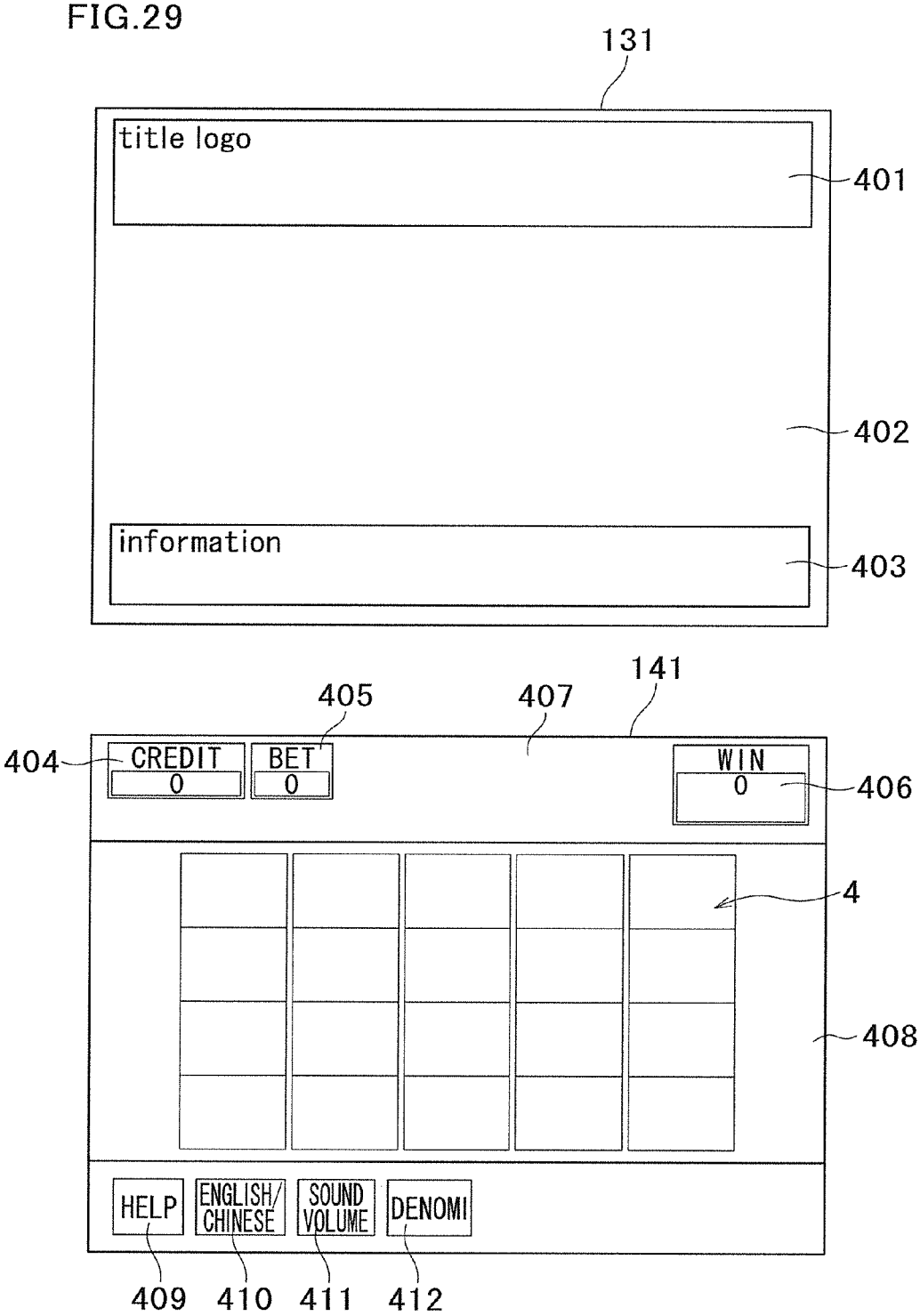
FIG. 29 shows image display on the slot machine of the embodiment of the present invention in a normal state.

As shown in FIG. 29, the upper image display panel 131 in the normal game is provided with a title logo area 401, an image area 402, and an information area 403. In the title logo area 401 is displayed a game title logo. During the free game, the image displayed in this area is the name of the free game. When the display language is switched to English or Chinese, the title is displayed in that language. In the image area 402 is displayed a main image of the game. During the free game, the background of the main image is changed. In the information area 403 is displayed a simple explanation of game rules. The display content therefore varies during the normal game or during the free game. Each text in the display content is displayed in a looped manner at intervals of 10 seconds.

On the lower image display panel 141 in the normal game, in addition to the above-described symbol display region 4, a credit meter 404, a bet meter 405, a win meter 406, a bet information and game state display region 407, a payline number display region 408, a help touch button 409, a language switching touch button 410, a sound volume switching touch button 411, and a denomination display region 412. In the credit meter 404 is displayed a remaining credit amount. The default value is 0. In other words, a credit amount stored in the RAM 73 is displayed. The bet meter 405 displays the total bet amount of the current game (or the final game). The win meter 406 displays the total credit amount of WIN and the detail of the WIN. The win credit amount displayed in the win meter 406 is always an actual obtained credit amount after the multiplication by the bet per line.

In the bet information and game state display region 407 is displayed bet information of the current game (or the final game). In the first line is displayed an amount of bet per line. The image display is in the singular form or plural form in accordance with the bet amount. For example, when the amount of bet per line is "1", the region displays "1 CREDIT PER LINE" and "CREDIT" is displayed in the singular form. When the amount of bet per line is "2", the region displays "2 CREDITS PER LINE" and "CREDITS" is displayed in the plural form. The plural form "CREDITS" is displayed when the amount of bet per line is "3" or more, too. The bet information and game state display region 407 further displays the current game state. The region is not displayed when the current game state is game in progress. When the current game state is game over, "GAME OVER" is displayed. When the current game state is waiting for GAMBLE, "PLAY ON, GAMBLE or TAKE WIN" is displayed.

In the line number display region 408 are displayed payline number of 50 paylines (see the figure). When the player touches the help touch button 409, the first page of the help screen is displayed on the lower image display panel 141. The help touch button 409 is darkened when it is invalidated, e.g., during the rotation of the video reels 3.

As the language switching touch button 410 is touched by the player, the language is switched to English or Chinese. The language switching touch button 410 is activated only during the advertisement, and is darkened when it is invalidated, e.g., during the rotation of the video reels 3. Furthermore, on the language switching touch button 410, the displayed national flags are changed to "U.K./Chine" or "U.S.A./China" in accordance with the setting of the AUDIT. When the language switching is set at "DISABLE", the language switching touch button 410 is changed to a paytable button with which a payout table is displayed on the help screen.

The sound volume switching touch button 411 is used for switching the game sound volume at three stages. Each time the button is touched by the player, the game sound volume is switched such that, for example, from low to middle to high to small to middle. The denomination display region 412 displays current denomination.

<Help Screen Display>

Now, image display in the normal state will be described with reference to FIG. 30. FIG. 30 shows help screen display in the normal state in the slot machine of the embodiment of the present invention.

Figure 30:
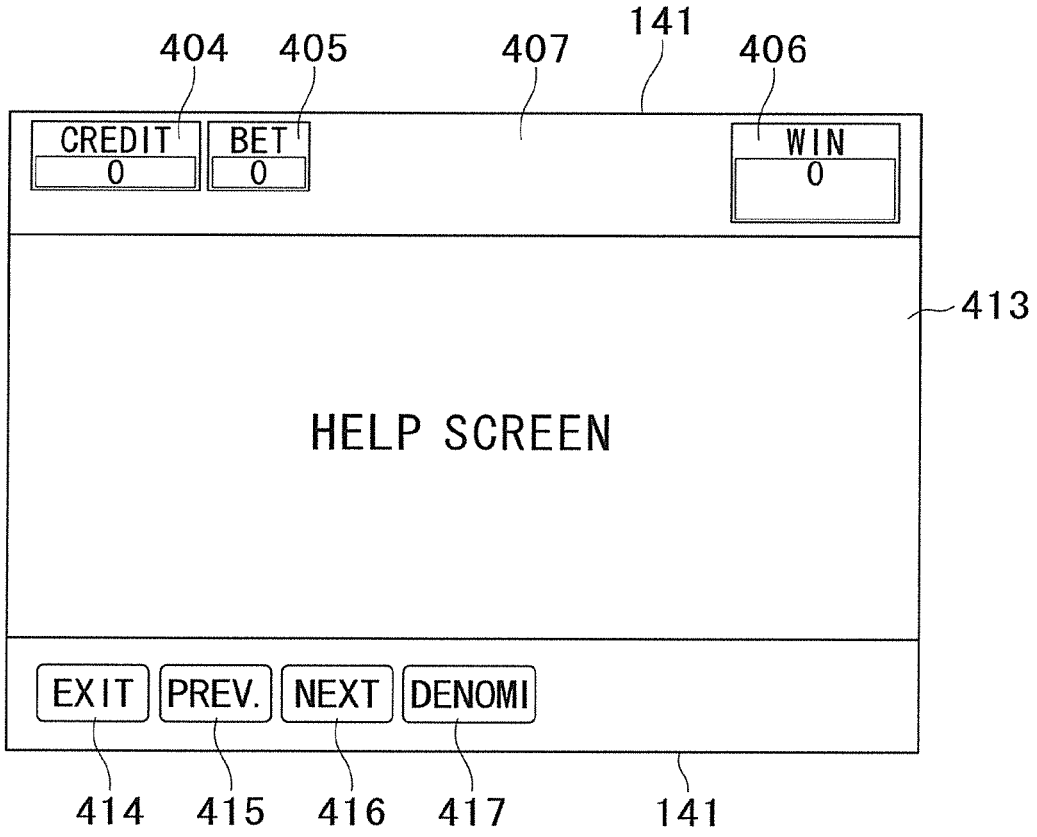
FIG. 30 shows HELP image display on the slot machine of the embodiment of the present invention in the normal state.

As the lower image display panel 141 shown in FIG. 30 indicates, on the help screen display in the normal state, the credit meter 404, the bet meter 405, the win meter 406, the bet information and game state display region 407, and the denomination display region 412 described above are displayed. Furthermore, on the lower image display panel 141, a help screen 413 is provided, and an EXIT touch button 414, a PREV. touch button 415, and a NEXT touch button 416 are further provided.

When the player touches the EXIT touch button 414, the help screen 413 disappears from the lower image display panel 141 and a normal game screen (see FIG. 42) comes back. When the player touches the PREV. touch button 415, the directly preceding page is displayed on the help screen 413. When the player touches the NEXT touch button 416, the next page is displayed on the help screen 413.

[Win Effect]

Now, an win effect in the slot machine 1 will be described with reference to FIG. 31 to FIG. 37.

The win effect is an effect executed when a win is achieved in the normal game or the free game. That is to say, this effect is executed when a combination of symbols displayed on an activated payline is identical with a combination of symbols defined in the symbol combination table shown in FIG. 22 and FIG. 23.

<Flow of Win Effect>

Now, the flow of the win effect will be described with reference to FIG. 31 to FIG. 36. FIG. 31 to FIG. 36 show the flow of the win effect of the slot machine of the embodiment of the present invention.

Figure 31:
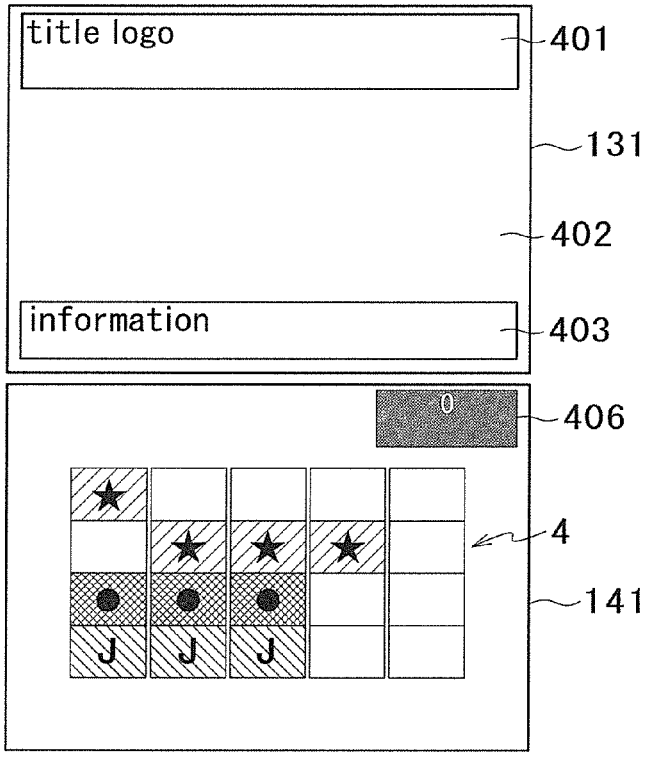
FIG. 31 shows the flow of a win effect of the slot machine of the embodiment of the present invention.

To begin with, as shown in FIG. 31, all reels in the symbol display region 4 on the lower image display panel 141 stop.

Figure 32:
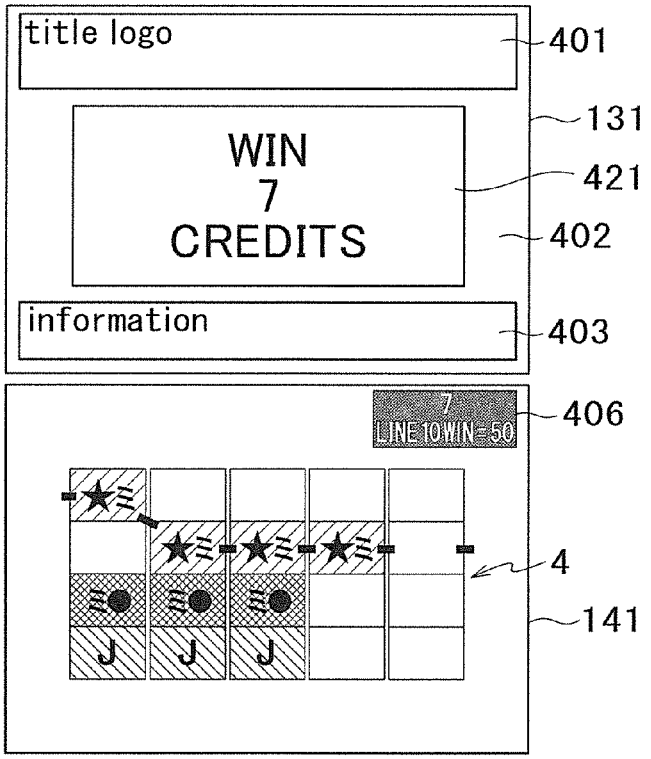
FIG. 32 shows the flow of the win effect of the slot machine of the embodiment of the present invention.

When all reels stop, as shown in FIG. 32, a win signboard 421 is displayed in the image area 402 of the upper image display panel 131. In the win signboard 421, an obtained credit is displayed in an increment manner. The increment display of the obtained credit on the win signboard 421 is linked to the image display on the win meter 406 of the lower image display panel 141.

On the lower image display panel 141, the win effect is performed for the achieved win. The win effect is performed for the payment as a result of the arrangement of three "FEATURE" symbols on an activated payline, and is then performed for the paylines one by one in ascending order of payline numbers. In this regard, for symbols for each of which a win animation is prepared, an animation effect is carried out regardless of the payline number. In the meanwhile, each symbol for which no win animation is prepared (i.e., symbols with a blinking win effect) blinks only when a win is achieved by a combination of symbols including that symbol.

On the win meter 406 of the lower image display panel 141, the total win at the start of the increment in the upper stage is displayed. In the lower stage which displays the details, the payout of the win line currently turned on (LINE 10 WIN=50 in FIG. 32) is displayed. The total win is not displayed.

Figure 33:
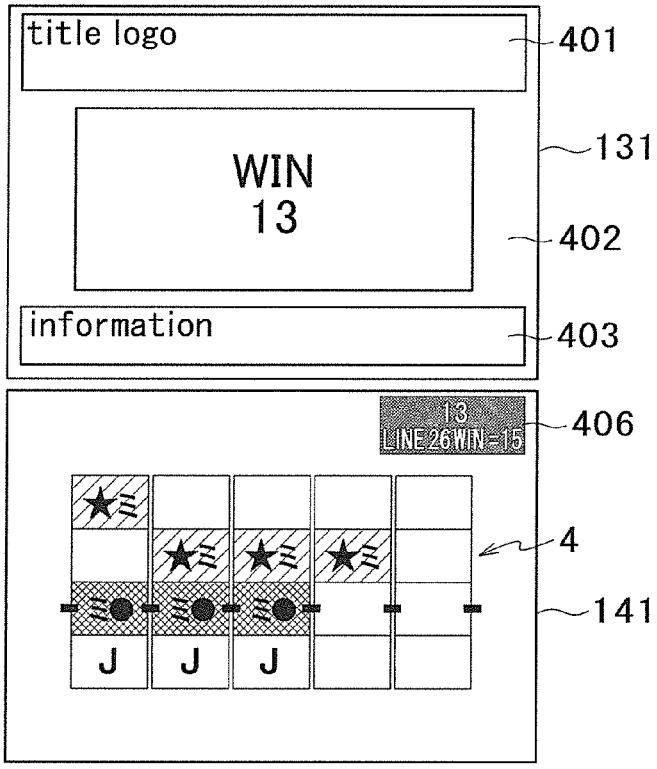
FIG. 33 shows the flow of the win effect of the slot machine of the embodiment of the present invention.

Subsequently, as shown in FIG. 33, on the win signboard 421 displayed on the image area 402 of the upper image display panel 131, the increment display of the obtained credit is continued. On the lower image display panel 141, the display of the win line proceeds to next. In this case, the display of the win line proceeds from the star symbols to the black circle symbols. Because win animations are prepared for both the star symbols and the black circle symbols, animation effects are performed irrespective of the line numbers. In the meanwhile, the "J" symbols are kept in the stop state because the time to display the win line has not come and no win animation is prepared therefor.

On the win meter 406 of the lower image display panel 141, the increment display of the total win is continued in the upper stage. In the lower stage displaying details, the payout of the win line currently turned on (LINE 26 WIN=15 in FIG. 33) is displayed. The total win is not displayed.

Figure 34:
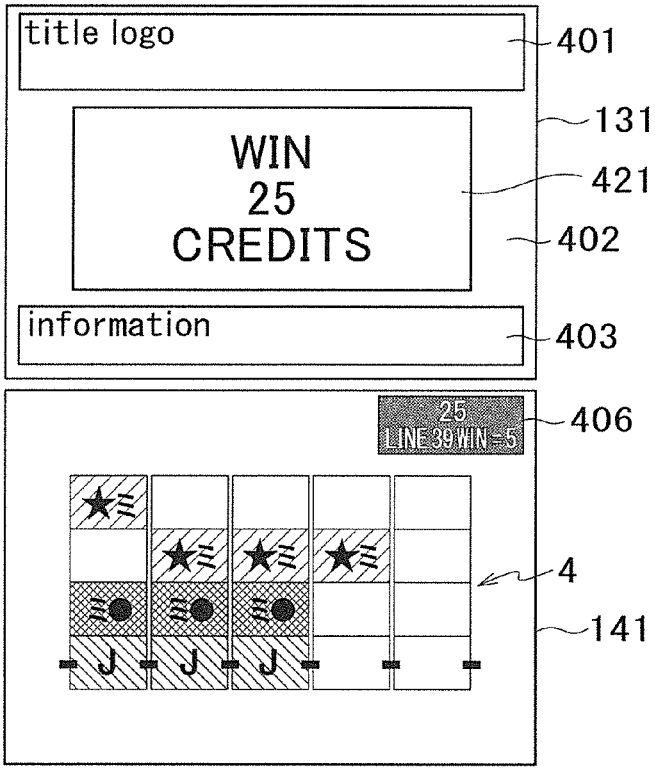
FIG. 34 shows the flow of the win effect of the slot machine of the embodiment of the present invention.

Subsequently, as shown in FIG. 34, the win signboard 421 is displayed in the image area 402 of the upper image display panel 131. On the win signboard 421, the increment display of the obtained credit is continued. The increment display of the obtained credit on the win signboard 421 is linked to the image display on the win meter 406 of the lower image display panel 141.

On the lower image display panel 141, the display of the win line proceeds to next. In this case, the display of the win line proceeds from the black circle symbols to the "J" symbols. Because win animations are prepared for both the star symbols and black circle symbols, animation effects are performed irrespective of the line numbers. In the meanwhile, the "J" symbols blink because the time to display the win line has come but no win animation is prepared therefor.

On the win meter 406 of the lower image display panel 141, the increment display of the total win is continued in the upper stage. In the lower stage where details are displayed, the payout of the win line which is currently turned on (LINE 39 WIN=5 in FIG. 34) is displayed. The total win is not displayed.

Figure 35:
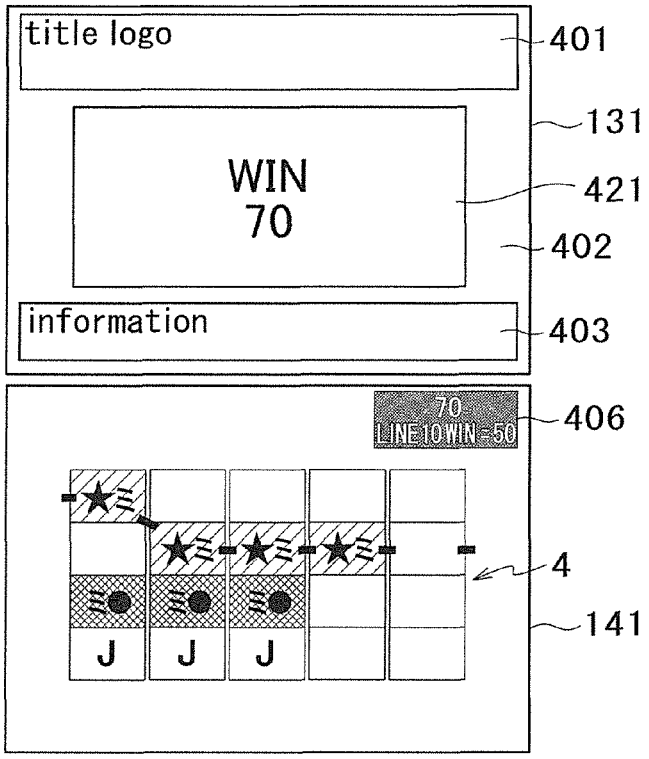
FIG. 35 shows the flow of the win effect of the slot machine of the embodiment of the present invention.

Subsequently, as shown in FIG. 35, the total win is displayed on the win signboard 421 displayed in the image area 402 of the upper image display panel 131. The increment display of the obtained credit is terminated. On the lower image display panel 141, as all of the winning symbols are displayed for once, the symbols are again displayed in a looped manner in an ascending order of payline numbers.

On the win meter 406 of the lower image display panel 141, the increment display of the total win is terminated in the upper stage. The total win is displayed also in the upper stage. In the lower stage displaying details, as all of the winning symbols are displayed for once, the symbols are again displayed in a looped manner in an ascending order of line numbers. In FIG. 35, LINE 10 WIN=50 is displayed again.

Figure 36:
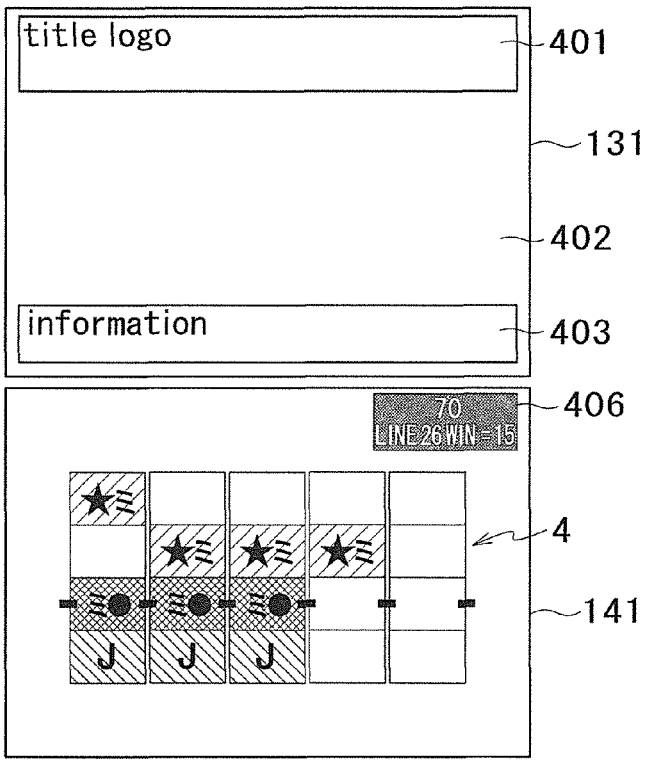
FIG. 36 shows the flow of the win effect of the slot machine of the embodiment of the present invention.

Thereafter, the display state shifts from FIG. 35 to FIG. 36. In this regard, the display state shifts from FIG. 35 to FIG. 36 when GAMBLE is finished or after TAKE WIN if GAMBLE is turned on, or the display states shifts from FIG. 35 to FIG. 36 after five seconds elapses from the finish of the increment display of the total win if GAMBLE is turned off.

As shown in FIG. 35, from the image area 402 of the upper image display panel 131, the win signboard 421 disappears. On the lower image display panel 141, the looped display is continued in an ascending order of payline numbers. On the win meter 406 of the lower image display panel 141, the display of the total win is continued. In the lower stage displaying details, the looped display is continued in an ascending order of line numbers. In FIG. 36, LINE 26 WIN=15 is displayed again.

<Win Signboard>

Figure 37:
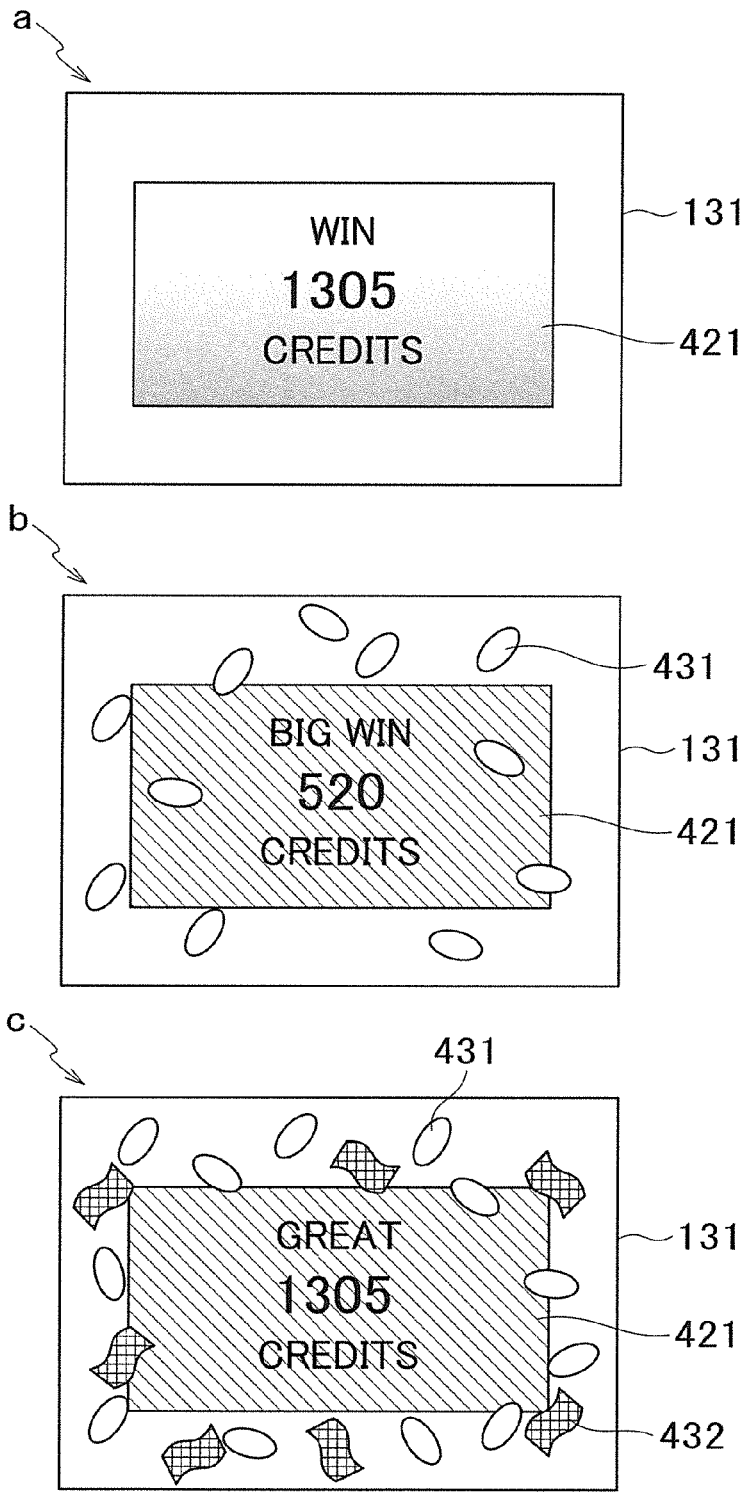
FIG. 37 shows a win signboard of the slot machine of the embodiment of the present invention.

Now, the win signboard will be described with reference to FIG. 37. FIG. 37 shows the win signboard of the slot machine of the embodiment of the present invention.

The total win amount as a result of the current spinning is displayed on a silver signboard 421 shown in (a) in FIG. 37 on the upper image display panel 131, when the total win is less than 15 times as much as the bet amount.

The total win as a result of the current spinning is displayed on a first gold signboard 421 shown in (b) in FIG. 37 on the upper image display panel 131, when the total win is equal to or more than 15 times as much as the bet amount and less than 50 times as much as the bet amount. On the first gold signboard 421, an effect of falling coins 431 is performed.

On the other hand, when the increment amount becomes more than 50 times as much as the bet amount, the first gold signboard 421 shown in (b) in FIG. 37 is changed to a second gold signboard 421 shown in (c) in FIG. 37, on the upper image display panel 131. On the second gold signboard 421 and effect of falling coins 431 and bills 432 is performed. In other words, on the upper image display panel 131, the effect of falling coins 431 is performed first by the first gold signboard 421. Subsequently, in sync with the increment display on the win meter 406, the obtained credit is incremented with the first gold signboard 421. When the increment amount becomes more than 50 times as much as the bet amount, the first gold signboard 421 shown in FIG. 37(*b*) is replaced with the second gold signboard 421 shown in FIG. 37(*c*). On the second gold signboard 421, the effect of falling coins 431 and bills 432 is executed.

<Effect Sound When Three "FEATURE" Symbols Appear>

Figure 38:
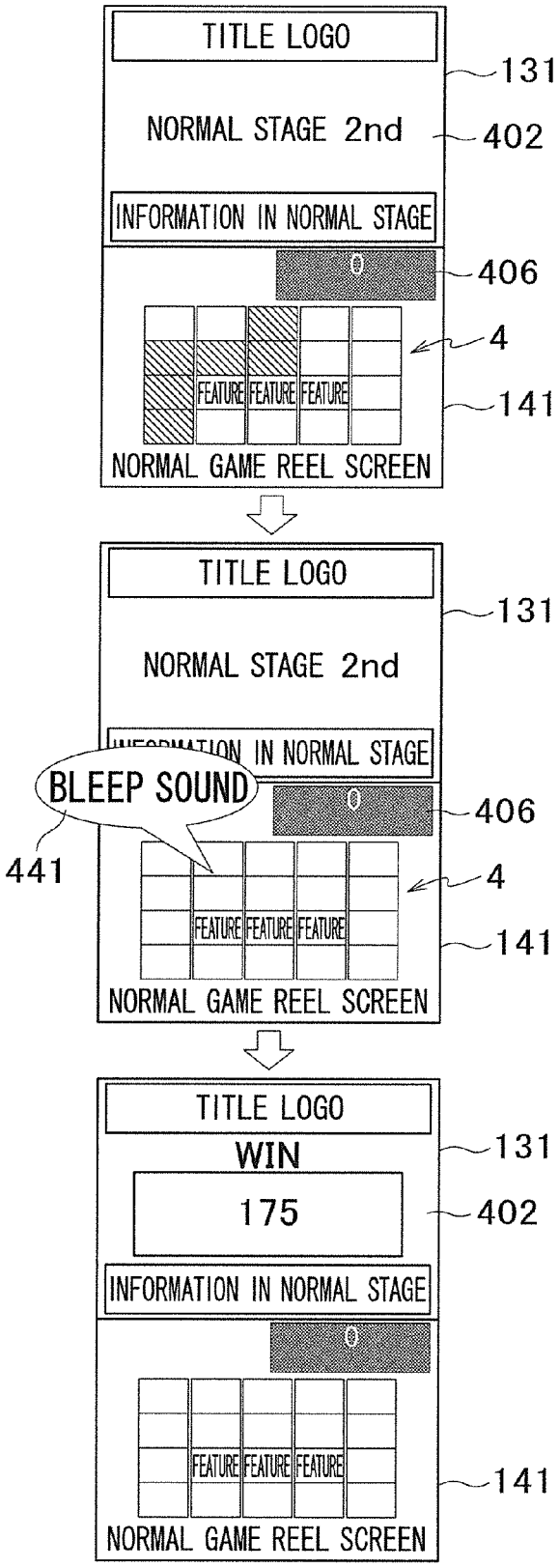
FIG. 38 illustrates effect sound when three feature symbols appear on the slot machine of the embodiment of the present invention.

Now, effect sound when three "FEATURE" symbols appear will be described with reference to FIG. 38. FIG. 38 illustrates the effect sound of the slot machine of the embodiment of the present invention when three "FEATURE" symbols appear.

When three "FEATURE" symbols appear, dedicated bleep sound is reproduced. The sound reproduction starts when all reels stop, and lasts three seconds until the increment starts after 30 frames elapse. During the reproduction of the bleep sound, the symbol animation, the display of the LINE WIN, and the increment display are not performed.

According to the embodiment of the present invention, as shown in FIG. 38, in the symbol display region 4 on the lower image display panel 141, a waiting time as long as 30 frames starts when three "FEATURE" symbols appear on an activated payline at the time of the stop of all reels. After the waiting time as long as 30 frames, as shown in FIG. 38, the bleep sound indicated by a balloon 441 is reproduced for three seconds as the effect sound when three "FEATURE" symbols appear.

After the three seconds, as shown in FIG. 38, the effect of LINE WIN starts in the symbol display region 4 on the lower image display panel 141, and the symbol animation starts. Furthermore, the win signboard 421 is displayed in the image area 402 of the upper image display panel 131. On the win signboard 421, the increment display starts. Simultaneously, the increment display starts on the win meter 406 of the lower image display panel 141. Furthermore, the reproduction of increment sound starts. Then the processing shifts to the above-described flow of the win effect.

<Total Win Signboard After Free Game>

Figure 39:
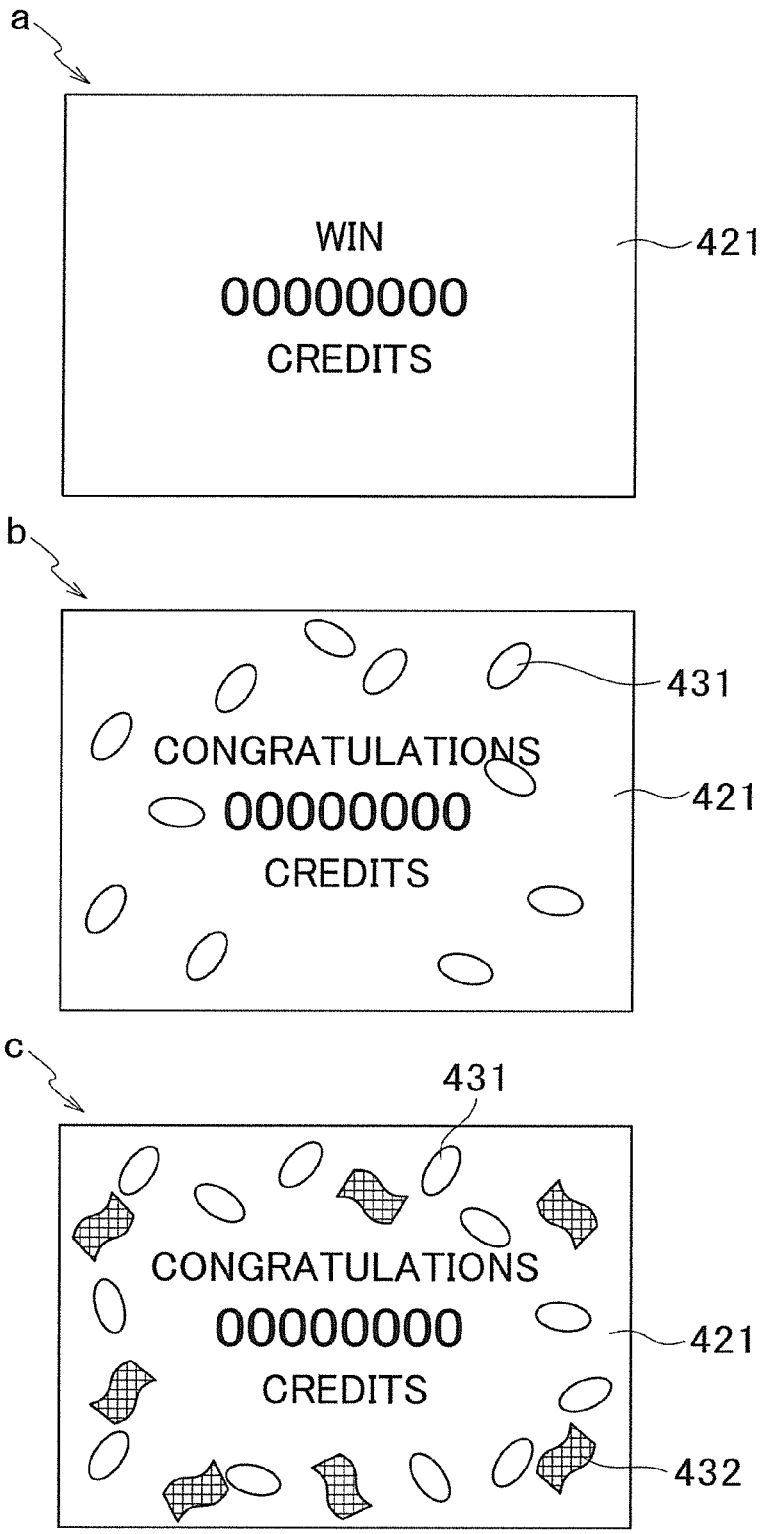
FIG. 39 shows a total win signboard after the free game in the slot machine of the embodiment of the present invention.

Now, the total win signboard after the free game will be described with reference to FIG. 39. FIG. 39 shows the total win signboard after the free game in the slot machine of the embodiment of the present invention.

After the end of the free game, a total obtained credit is displayed on the lower image display panel 141. In accordance with the obtained credit amount (i.e., how many times as much as the total bet), one of three types of effects is used.

When the total obtained credit is less than 20 times as much as the total bet, the silver signboard 421 shown in (a) in FIG. 39 is displayed on the lower image display panel 141 for 3.6 seconds. When the total obtained credit is equal to or more than 20 times as much as the total bet and less than 50 times as much as the total bet, the first gold signboard 421 shown in (b) in FIG. 39 is displayed on the lower image display panel 141 for 6 seconds. On the first gold signboard 421, the effect of falling coins 431 is performed. When the total obtained credit is equal to or more than 50 times as much as the total bet, the second gold signboard 421 shown in (c) in FIG. 39 is displayed on the lower image display panel 141 for 10 seconds. On the second gold signboard 421, the effect of falling coins 431 and bills 432 is performed.

[Free Game Effects]

Now, referring to FIG. 40 to FIG. 55, free game effects of the slot machine 1 will be described.

<Effect at Introduction of Free Game>

Referring to FIG. 40 to FIG. 43, an effect at the introduction of the free game will be described. FIG. 40 to FIG. 43 show the effect at the time of introduction of the free game in the slot machine of the embodiment of the present invention.

Figure 40:
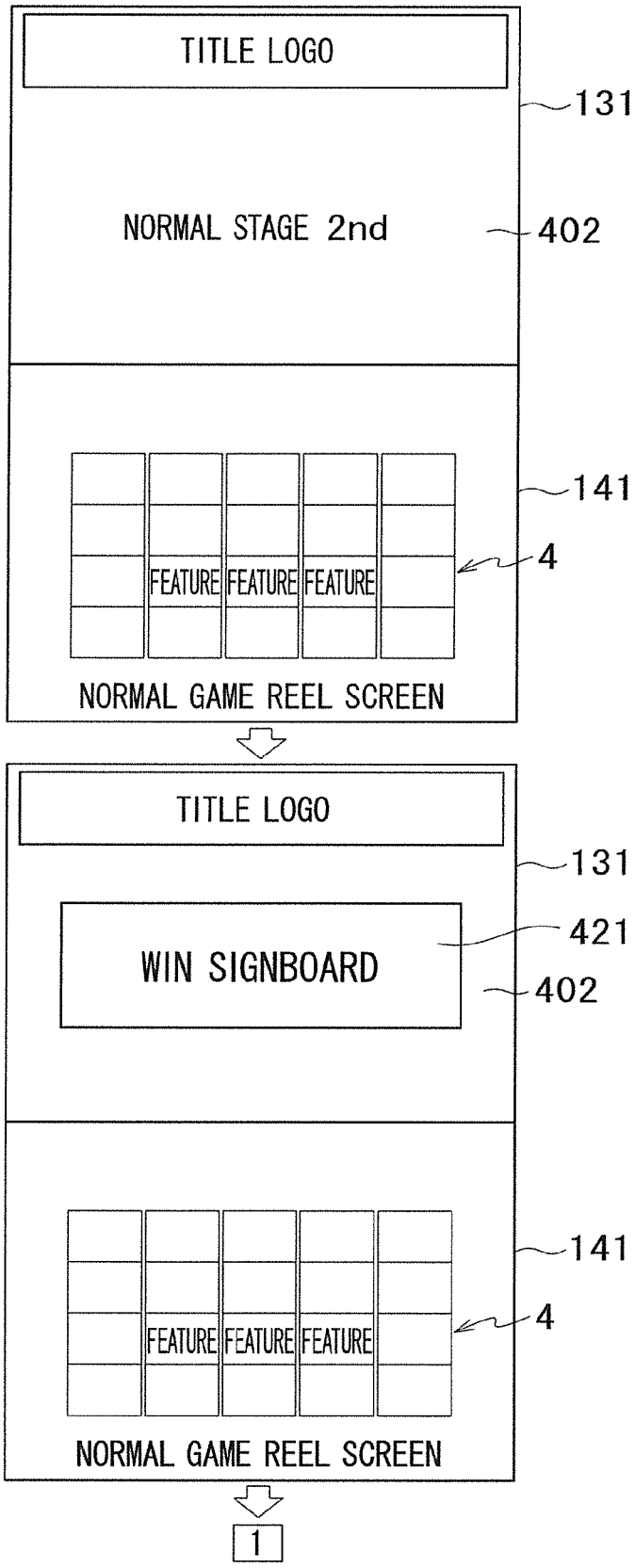
FIG. 40 shows an effect at the time of the introduction of the free game in the slot machine of the embodiment of the present invention.

As shown in FIG. 40, when three "FEATURE" symbols appear in the symbol display region 4 on the lower image display panel 141, as described above, the bleep sound which is effect sound is reproduced. Subsequently, as shown in FIG. 40, the win signboard 421 is displayed in the image area 402 of the upper image display panel 131. On the win signboard 421, the increment display is carried out.

Figure 41:
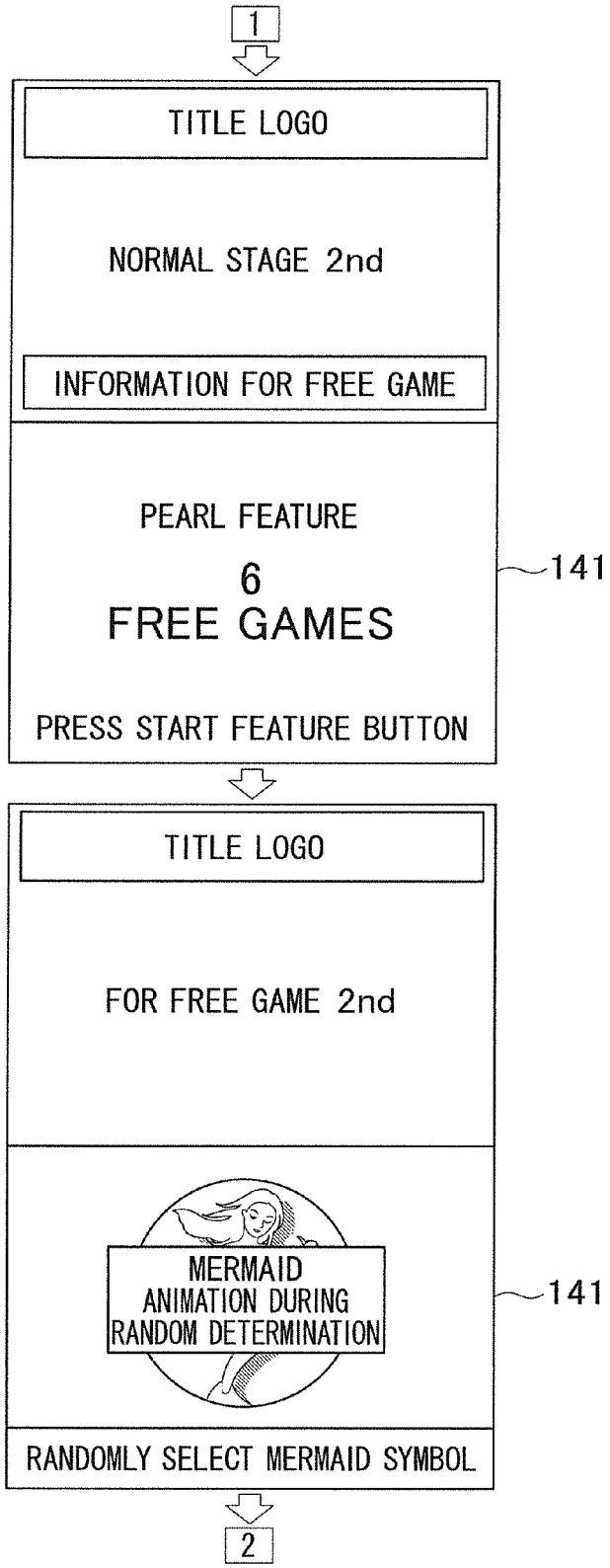
FIG. 41 shows the effect at the time of the introduction of the free game in the slot machine of the embodiment of the present invention.

When the increment display ends or is skipped, the screens on the upper image display panel 131 and the lower image display panel 141 fade out, and the number of times of execution of the free game to be awarded (6 times in the present embodiment) is displayed on the lower image display panel 141, as shown in FIG. 41. Thereafter, the free game video reel group selection process of S102 is executed, and an effect (an animation of mermaid) is performed to notify that the free game video reel group selection process is in progress on the lower image display panel 141.

Figure 42:
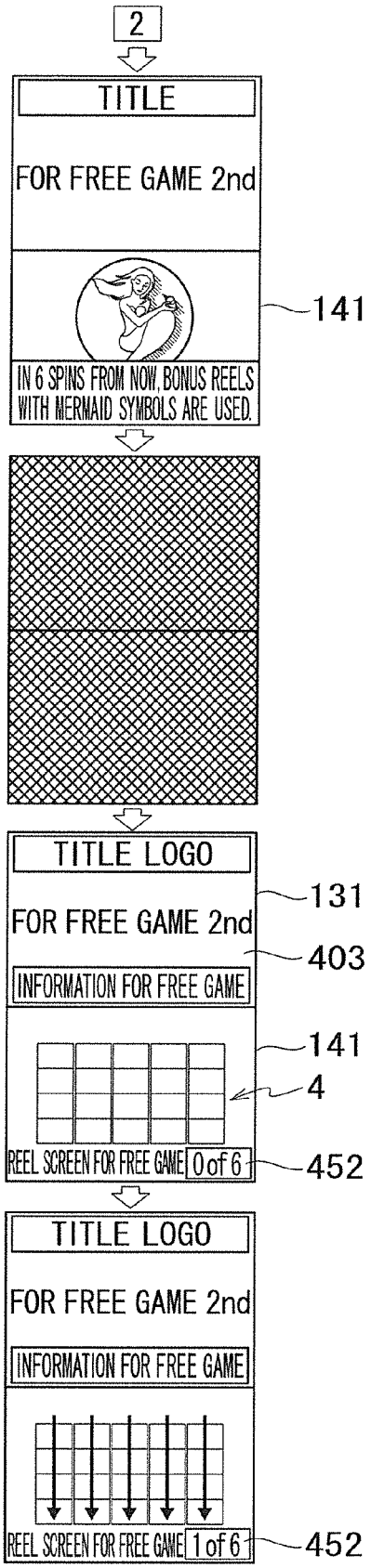
FIG. 42 shows the effect at the time of the introduction of the free game in the slot machine of the embodiment of the present invention.

Subsequently, as shown in FIG. 42, which type of the free game video reel is used in the free game is informed on the lower image display panel 141, and then a dark change image is displayed. When the spin button is pressed, the lower image display panel 141 and the upper image display panel 131 are switched to screens for the free game, as shown in FIG. 42. The information area 403 of the upper image display panel 131 is switched to image display for the free game. Below the symbol display region 4 of the lower image display panel 141, a free game counter 452 is displayed. Furthermore, as shown in FIG. 42, the video reels 3 start to rotate in the symbol display region 4 of the lower image display panel 141. The free game counter 452 on the lower image display panel 141 displays "1 of 6" which indicates that the execution of the free game for the first time has started.

<Effect when Free Game Ends>

Figure 43:
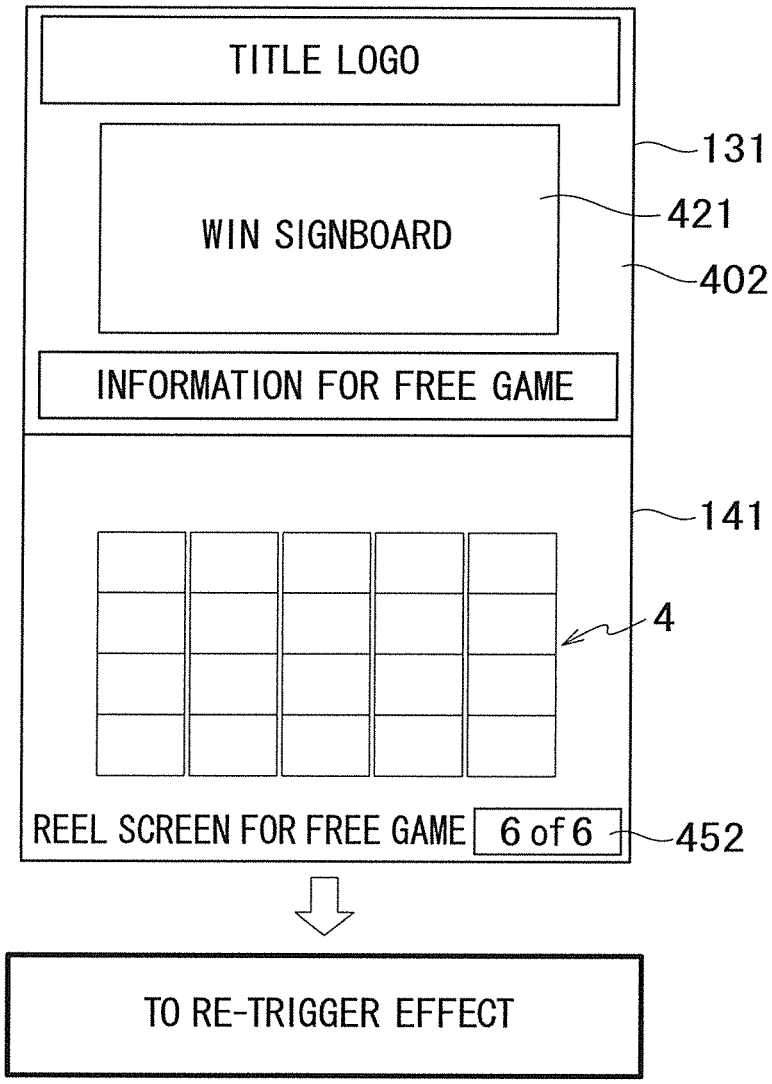
FIG. 43 shows the effect at the time of the introduction of the free game in the slot machine of the embodiment of the present invention.

Now, an effect at the end of the free game will be described with reference to FIG. 43. FIG. 43 shows the effect at the end of the free game in the slot machine of the embodiment of the present invention.

As shown in FIG. 43, when the last spinning finishes in the symbol display region 4 on the lower image display panel 141, the free game counter 452 on the lower image display panel 141 displays "6 of 6" which indicates that the free game has ended. The win signboard 421 is displayed in the image area 402 on the upper image display panel 131. When the obtained credit is zero, the win signboard 421 is not displayed.

When the win signboard 421 disappears from the image area 402 on the upper image display panel 131, a total win signboard shown in FIG. 39 is displayed. The total win signboard displays the obtained credit in the free game. When the obtained credit in the free game is zero, the total win signboard is not displayed.

When the total win signboard disappears from the symbol display region 4 on the lower image display panel 141, the processing proceeds to a later-described re-trigger effect.

<Long Lizhi Effect>

Now, a long lizhi effect executed during the free game will be described with reference to FIG. 44 to FIG. 46.

Figure 44:
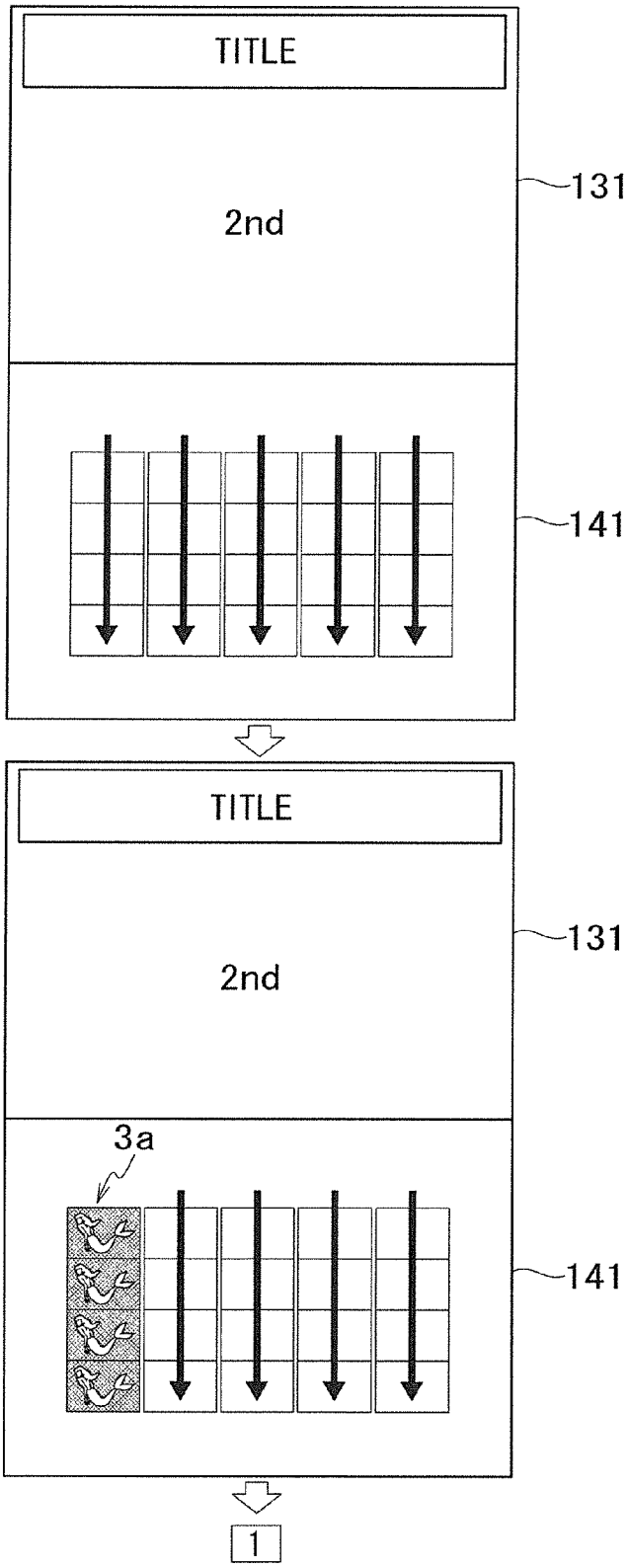
FIG. 44 shows a long lizhi effect in the slot machine of the embodiment of the present invention.

As shown in FIG. 44, when the five video reels 3 scroll in the free game, the first video reel 3*a* stops in the symbol display region 4, and four mermaid symbols are displayed, the second video reel 3*b* will stop in the symbol display region 4. In this regard, as shown in FIG. 45, when no mermaid symbol appears in the symbol display region 4 where the second video reel 3*b* has stopped or four mermaid symbols do not stop in the symbol display region 4 where the second video reel 3*b* has stopped, the subsequent stop of the scroll of the third video reel 3*c*, the stop of the scroll of the fourth video reel 3*d*, and the stop of the scroll of the fifth video reel 3*e* are performed at normal speed and timings.

Figure 45:
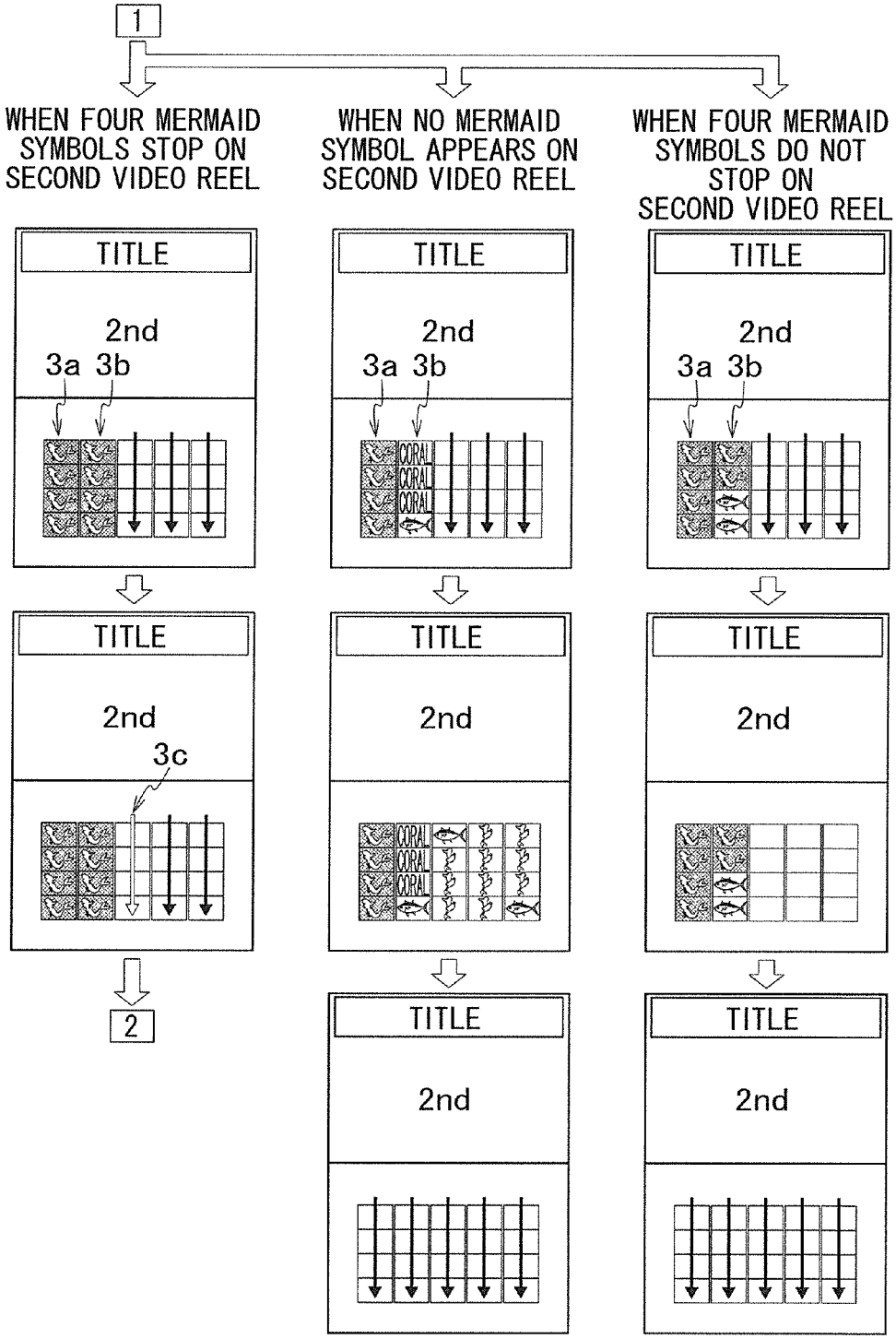
FIG. 45 shows the long lizhi effect in the slot machine of the embodiment of the present invention.

In the meanwhile, as shown in FIG. 45, when four mermaid symbols appear in the symbol display region 4 where the second video reel 3*b* has stopped, a long lizhi effect is carried out so that the speed of the scroll of the third video reel 3*c* becomes lower than the normal speed of the scroll and the time which elapses until the stop is elongated.

Figure 46:
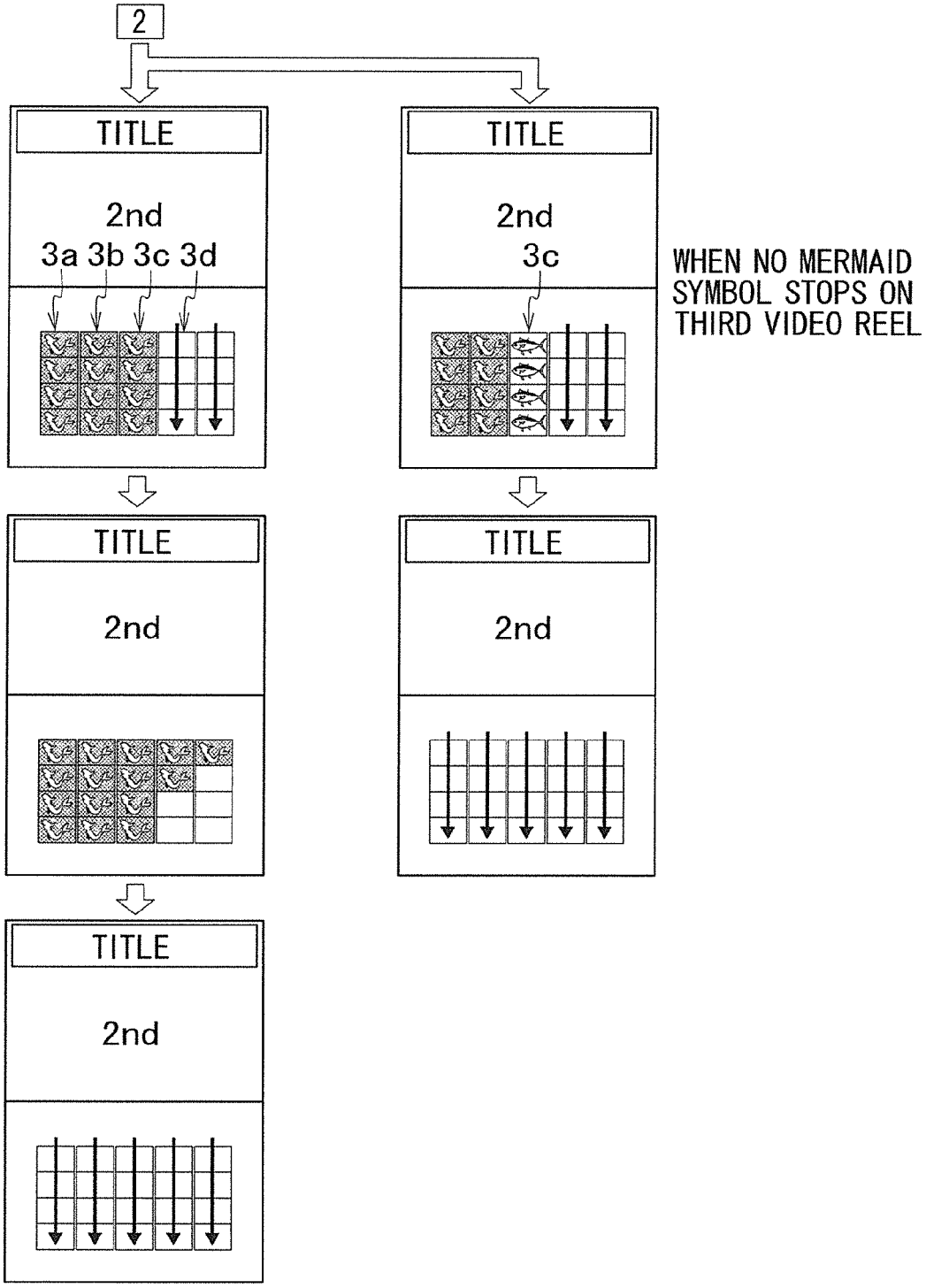
FIG. 46 shows the long lizhi effect in the slot machine of the embodiment of the present invention.

Subsequently, as shown in FIG. 46, after the long lizhi effect, if no mermaid symbol appears in the symbol display region 4 where the third video reel 3*c* has stopped, the subsequent stop of the scroll of the fourth video reel 3*d* and the stop of the scroll of the fifth video reel 3*e* are performed at normal speed and timings.

In the meanwhile, after the long lizhi effect, if a mermaid symbol appears on an activated payline when the third video reel 3*c* stops, the long lizhi effect is carried out so that the speed of the scroll of the fourth video reel 3*d* becomes lower than the normal speed of the scroll and the time which elapses until the stop is elongated.

Similarly, after the long lizhi effect by the fourth video reel 3*d*, if no mermaid symbol appears in the symbol display region 4 where the fourth video reel 3*d* stops, the subsequent stop of the scroll of the fifth video reel 3*e* is performed at normal speed and timing.

In the meanwhile, when the fourth video reel 3*d* stops after the long lizhi effect for the fourth video reel 3*d* and a mermaid symbol appears on an activated payline, a long lizhi effect is carried out so that the speed of the scroll of the fifth video reel 3*e* is lower than the normal speed and the time elapsing until the stop is elongated.

In the long lizhi effect, plural patterns of speeds of the scroll and timings to stop may be provided, and the speed of the scroll and timing to stop of the video reel 3 in the long lizhi effect may be randomly determined.

<Serial Picture Symbol Effect>

Figure 47:
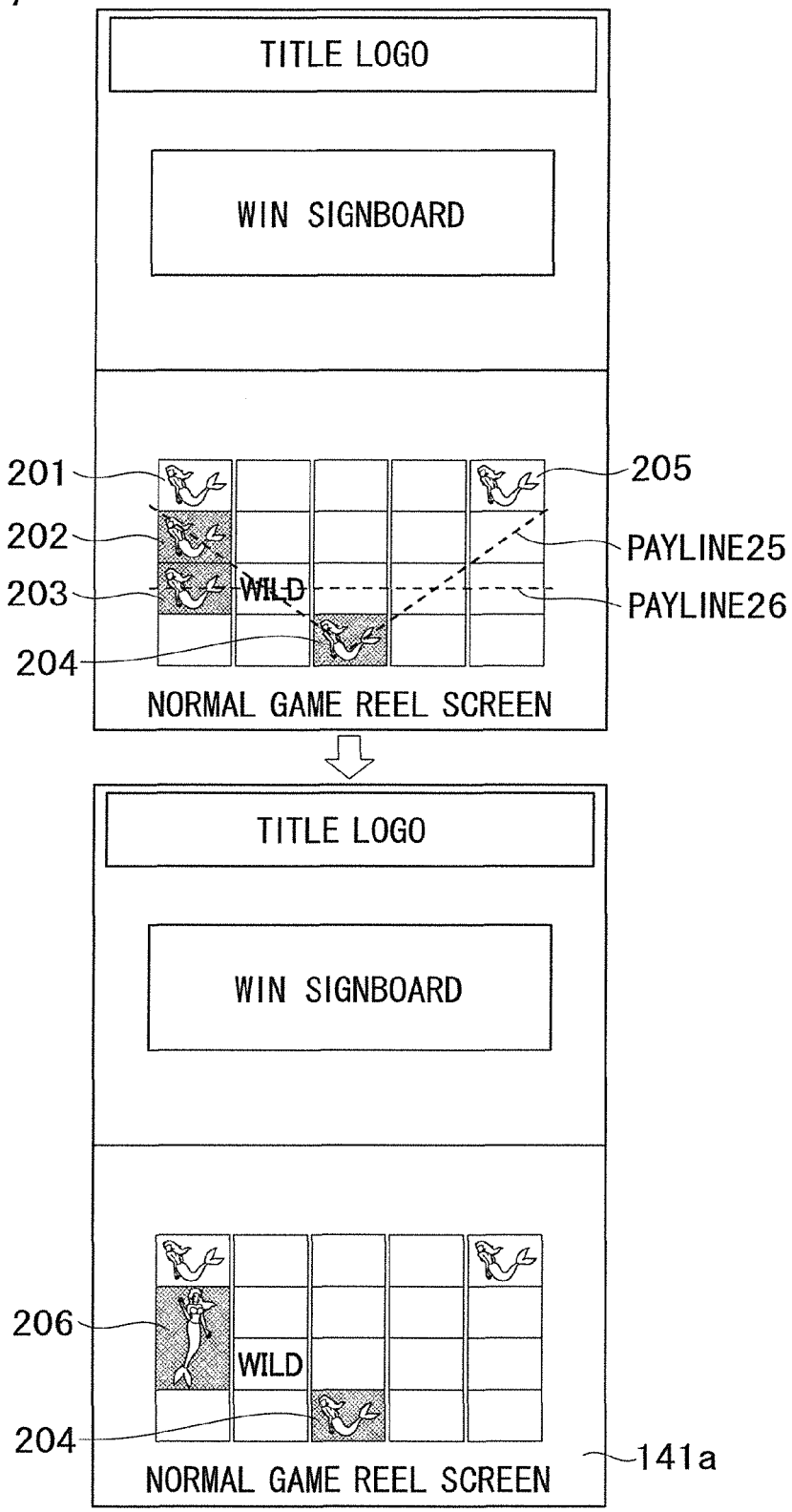
FIG. 47 shows a serial picture symbol effect in the slot machine of the embodiment of the present invention.
Figure 48A:
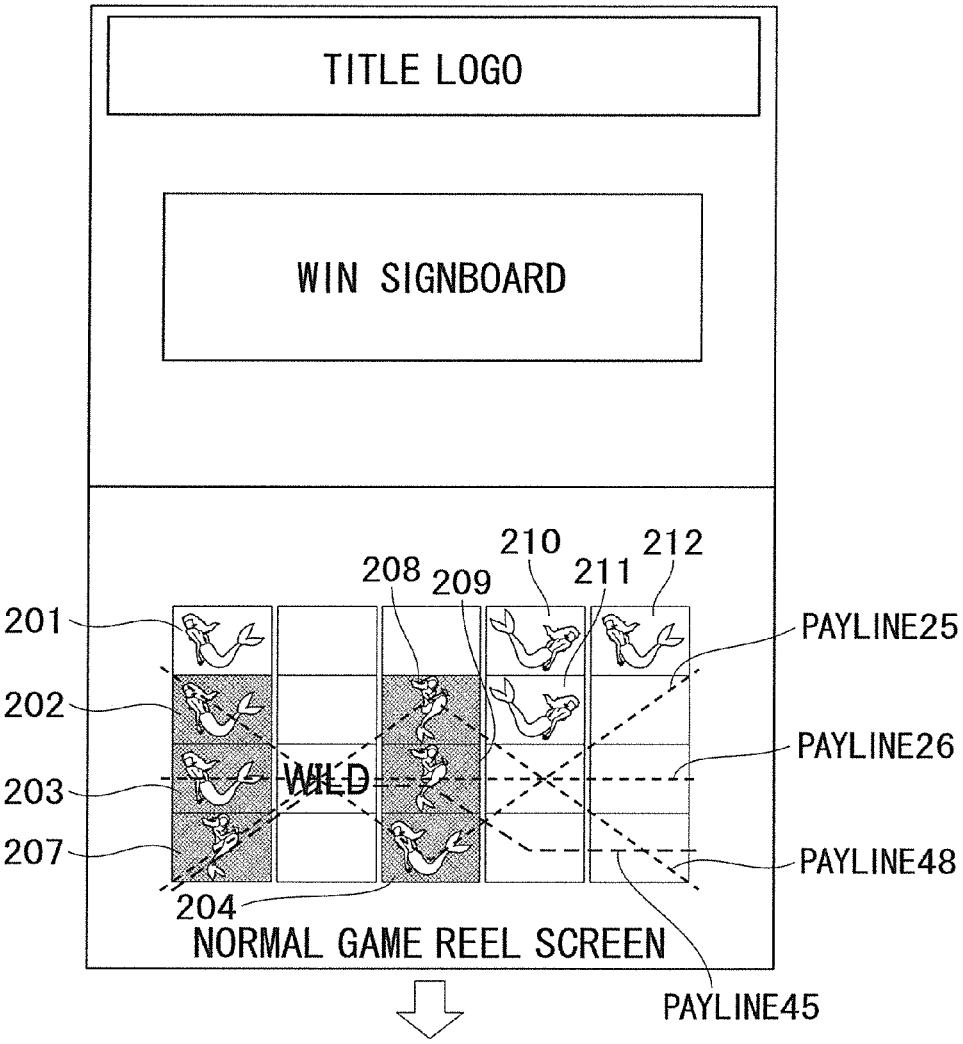
FIG. 48A shows the serial picture symbol effect in the slot machine of the embodiment of the present invention.
Figure 48B:
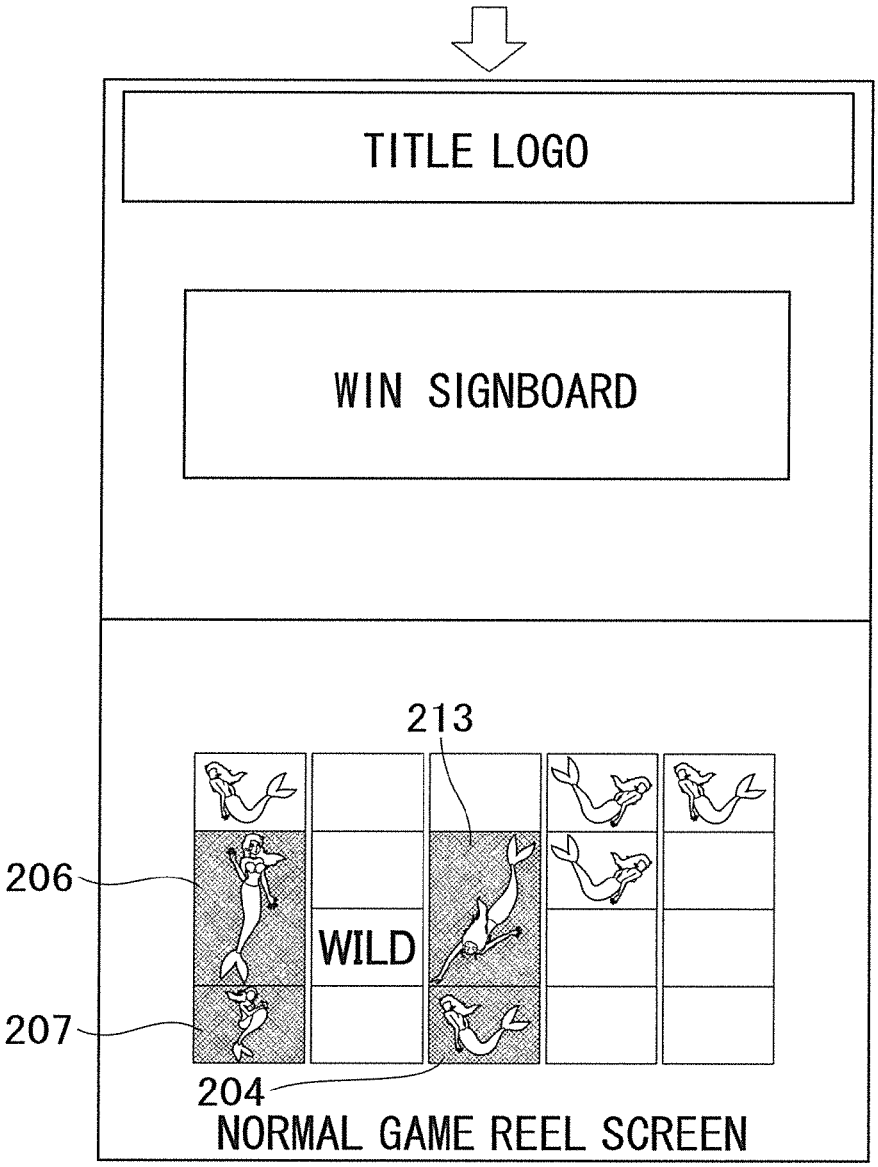
FIG. 48B shows the serial picture symbol effect in the slot machine of the embodiment of the present invention.

Now, referring to FIG. 47 and FIG. 48, the following will describe a serial picture symbol effect which is executed when a win (WIN) is achieved during the normal game or the free game.

For example, when, as shown in FIG. 47, when all video reels 3 stop and "R_MERMAID" symbols 201, 202, 203, 204, and 205 stop in the symbol display region 4, "R_MERMAID" 202, "WILD", and "R_MERMAID" 204 stop on a payline 25, and a win is achieved by three "R_MERMAID" (see FIG. 23 and FIG. 24). Furthermore, "R_MERMAID" 203 and "WILD" stop on a payline 26, and hence a win is achieved by two "R_MERMAID" (see FIG. 23 and FIG. 24). In other words, among the "R_MERMAID" symbols stopping in the symbol display region 4, symbols achieving the win are "R_MERMAID" 202, "R_MERMAID" 203, and "R_MERMAID" 204.

For the "R_MERMAID" symbols achieving the win, an animation effect is carried out. In this regard, when the symbols stop to be vertically lined up as in the case of "R_MERMAID" 202 and "R_MERMAID" 203, the animation effect integrally using (displayed on) two vertical stages of the first video reel 3*a* is performed as in the case of "R_MERMAID" 206 in FIG. 47. While "R_MERMAID" 204 is one of the symbols achieving the win, this symbol is not adjacent to another "R_MERMAID", and hence a single effect is performed therefor. However, the animation effect is carried out in sync with the animation effect for the "R_MERMAID" 206. For "R_MERMAID" 201 and "R_MERMAID" 205, no animation effect is carried out because these symbols are not involved with the achievement of the win. By carrying out such effects, it is possible to clarify for the player that a win with which "R_MERMAID" symbols are involved is achieved.

The following will describe a serial picture symbol effect with reference to another example. As shown in FIG. 48, when all video reels 3 stop and "R_MERMAID" symbols 201, 202, 203, 204, and 205, "P_MERMAID" symbols 207, 208, and 209, and "Y_MERMAID" symbols 210 and 211 stop in the symbol display region 4, "R_MERMAID" 202, "WILD", and "R_MERMAID" 204 stop on a payline 25, and hence three "R_MERMAID" achieve a win (see FIG. 23 and FIG. 24). Furthermore, "R_MERMAID" 203 and "WILD" stop on a payline 26, and hence two "R_MERMAID" achieve a win (see FIG. 23 and FIG. 24). Furthermore, "P_MERMAID" 207, "WILD", and "P_MERMAID" 208 stop on a payline 48, and hence three "P_MERMAID" achieve a win (see FIG. 23 and FIG. 24). Furthermore, "P_MERMAID" 207, "WILD", and "P_MERMAID" 209 stop on a payline 45, and hence three "P_MERMAID" achieve a win (see FIG. 23 and FIG. 24). In other words, among "R_MERMAID" symbols having stopped in the symbol display region 4, "R_MERMAID" 202, "R_MERMAID" 203, and "R_MERMAID" 204 are symbols achieving a win. Furthermore, among "P_MERMAID" symbols having stopped in the symbol display region 4, "P_MERMAID" 207, "P_MERMAID" 208, and "P_MERMAID" 209 are symbols achieving a win. "Y_MERMAID" symbols 210 and 211 are symbols not achieving a win.

For "R_MERMAID" symbols achieving win, an animation effect is carried out. In this regard, when symbols stop to be vertically lined up as in the case of "R_MERMAID" 202 and "R_MERMAID" 203, the animation effect integrally using (displayed on) two vertical stages of the first video reel 3*a* is performed as in the case of "R_MERMAID" 206 in FIG. 47. While "R_MERMAID" 204 is one of the symbols achieving the win, the symbol is not adjacent to another "R_MERMAID", and hence a single effect is performed therefor. However, the animation effect is carried out in sync with the animation effect for the "R_MERMAID" 206. Furthermore, for "P_MERMAID" symbols achieving win, an animation effect is carried out. In this regard, when the symbols stop to be vertically lined up as in the case of "P_MERMAID" 208 and "P_MERMAID" 209, the animation effect integrally using (displayed on) two vertical stages of the third video reel 3*c* is performed as in the case of "P_MERMAID" 213 in FIG. 48. While "P_MERMAID" 207 is one of the symbols achieving the win, the symbol is not adjacent to another "P_MERMAID", and hence a single effect is performed therefor. However, the animation effect is carried out in sync with the animation effect for the "P_MERMAID" 213.

In the serial picture symbol effect described above, when a combination of symbols rearranged on a payline in the symbol display region 4 is a combination with which a payout (benefit) is awarded and the symbols forming the combination with which the payout (benefit) is awarded include symbols of the same type serially rearranged on a video reel, an integral effect is performed on the serially-rearranged symbols. The player enjoys such an effect.

<Re-Trigger Effect>

The following will describe a re-trigger effect executed in the re-trigger random determination process in S111, with reference to FIG. 49 to FIG. 52. FIG. 49 to FIG. 52 show the re-trigger effect in the slot machine of the embodiment of the present invention.

Figure 49:
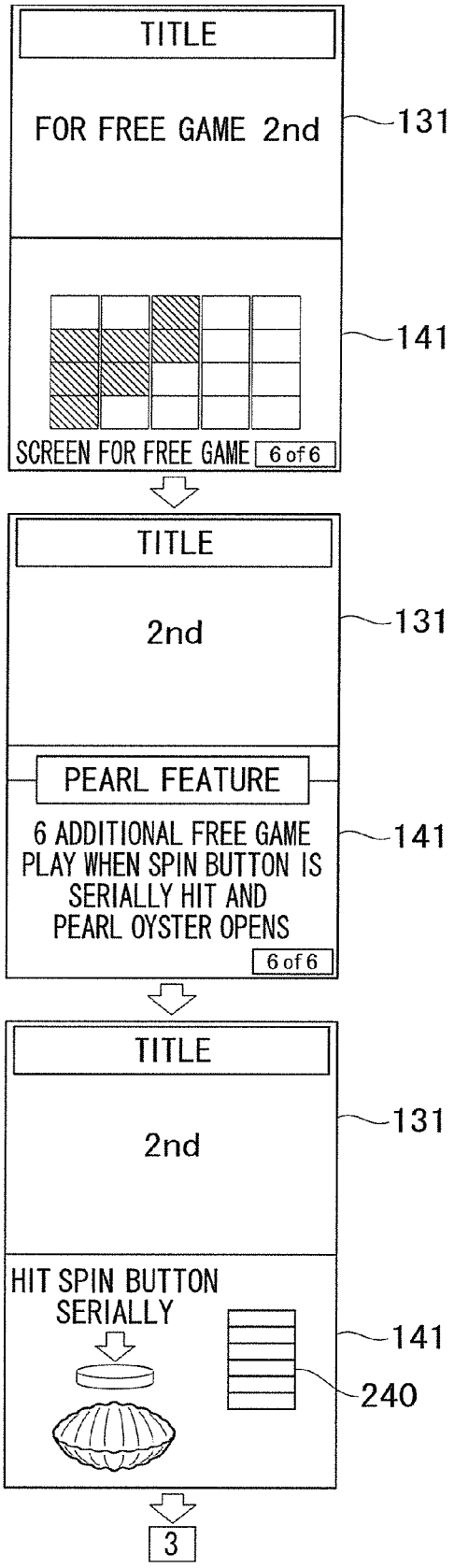
FIG. 49 shows a re-trigger effect in the slot machine of the embodiment of the present invention.
Figure 52:
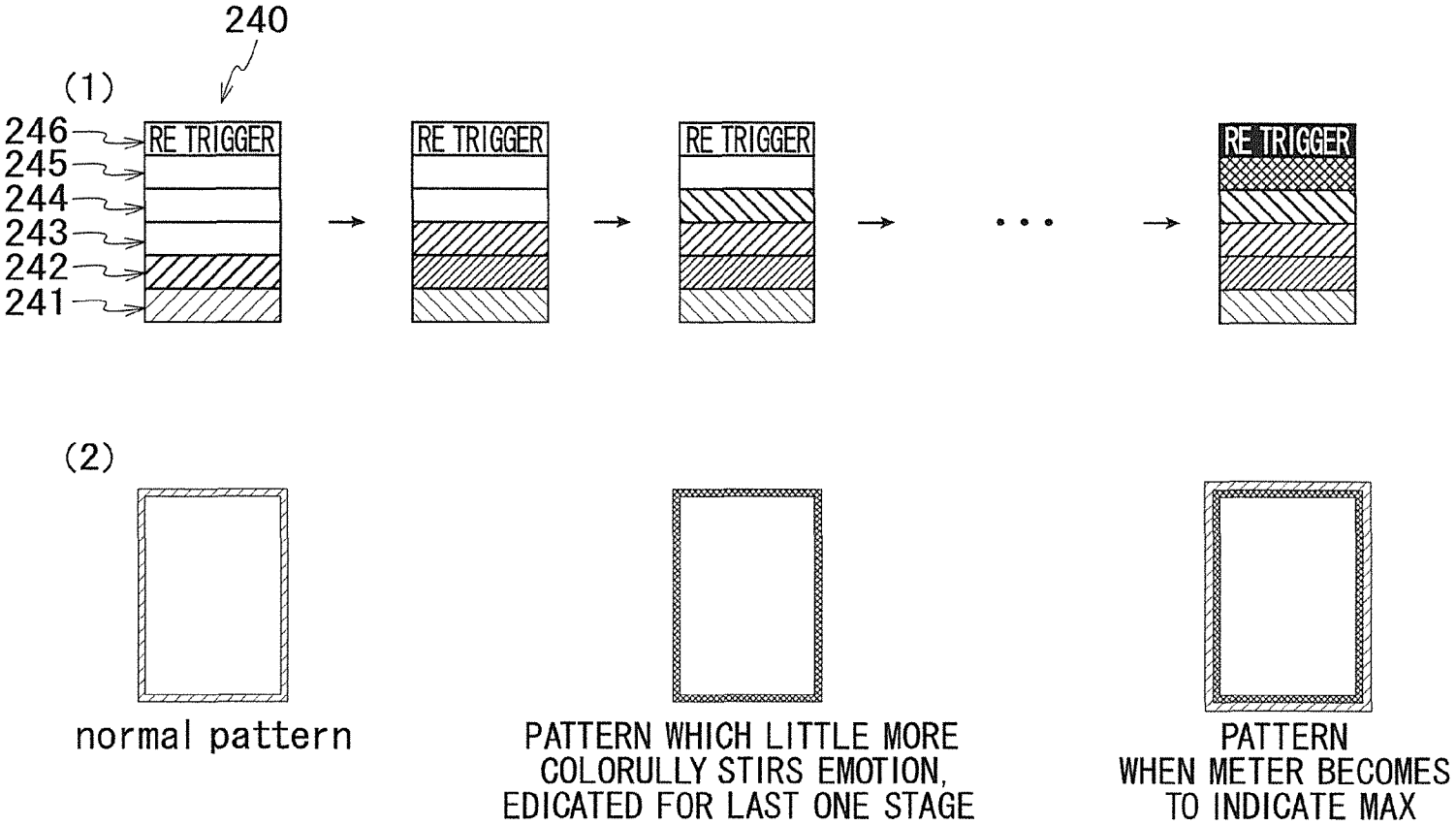
FIG. 52 shows the re-trigger effect in the slot machine of the embodiment of the present invention.

In the free game process, a re-trigger random determination process is executed when the number of times of execution of free game counter indicates "0". In so doing, as shown in FIG. 49, a message signboard which reads "WHEN PEARL OYSTER OPENS AS A RESULT OF SERIAL HITTING OF spin button, FREE GAME ADDITION +6" is displayed on the on the lower image display panel 141. Thereafter, as shown in FIG. 49, an image encouraging the player to serially hit the spin button and a meter 240 are displayed on the lower image display panel 141. In this regard, as shown in FIG. 52, a display region of the meter 240 is divided into 6 stages 241, 242, 243, 244, 245, and 246.

When the re-trigger has been achieved in the re-trigger random determination process (S111), a random determination process is executed so that one of patterns 1 to 15 is selected with reference to an A-table selection rate shown in FIG. 53. In this regard, with reference to a selected pattern and an A-memory increase predetermined frequency table shown in FIG. 54, the level indicated by the meter 240 rises (advances) each time the spin button is pressed for a predetermined number of times. When the level indicated by the meter 240 reaches the sixth stage 246 in the display region, an effect of opening the pearl oyster is carried out.

For example, when the pattern 3 is selected as a result of the random determination process using the A-table selection rate, the following is determined with reference to an A-memory increase predetermined frequency table: the number of hitting of the spin button required to increase the level of the meter 240 to the first stage 241 is 1; the number of hitting of the spin button required to increase the level of the meter 240 to the second stage 242 is 2; the number of hitting of the spin button required to increase the level of the meter 240 to the third stage 243 is 3; the number of hitting of the spin button required to increase the level of the meter 240 to the fourth stage 244 is 3, the number of hitting of the spin button required to increase the level of the meter 240 to the fifth stage 245 is 5; the number of hitting of the spin button required to increase the level of the meter 240 to the sixth stage is 6; and the number of hitting of the spin button required to increase the level of the meter 240 to the highest level is 24 in total.

In the meanwhile, when the re-trigger is not achieved in the re-trigger random determination process (S111), a random determination process of selecting one of patterns 21 to 25 with reference to a B-table selection rate shown in FIG. 53 is executed. In this case, with reference to the selected pattern and a B-memory increase predetermined frequency table shown in FIG. 54, the level indicated by the meter 240 rises (advances) each time the spin button is pressed for a predetermined number of times.

For example, when the pattern 23 is selected as a result of the random determination process using the B-table selection rate, the following is determined with reference to a B-memory increase predetermined frequency table: the number of hitting of the spin button required to increase the level of the meter 240 to the first stage 241 is 1; the number of hitting of the spin button required to increase the level of the meter 240 to the second stage 242 is 2; the number of hitting of the spin button required to increase the level of the meter 240 to the third stage 243 is 3; the number of hitting of the spin button required to increase the level of the meter 240 to the fourth stage 244 is 10; and the number of hitting of the spin button required to increase the level of the meter 240 to the fifth stage 245 is 5. Because the re-trigger is not achieved in this case, the level of the meter 240 does not advance to the sixth stage, and the level of the meter 240 does not reach the highest stage no matter how the spin button is hit over and over again.

Figure 50:
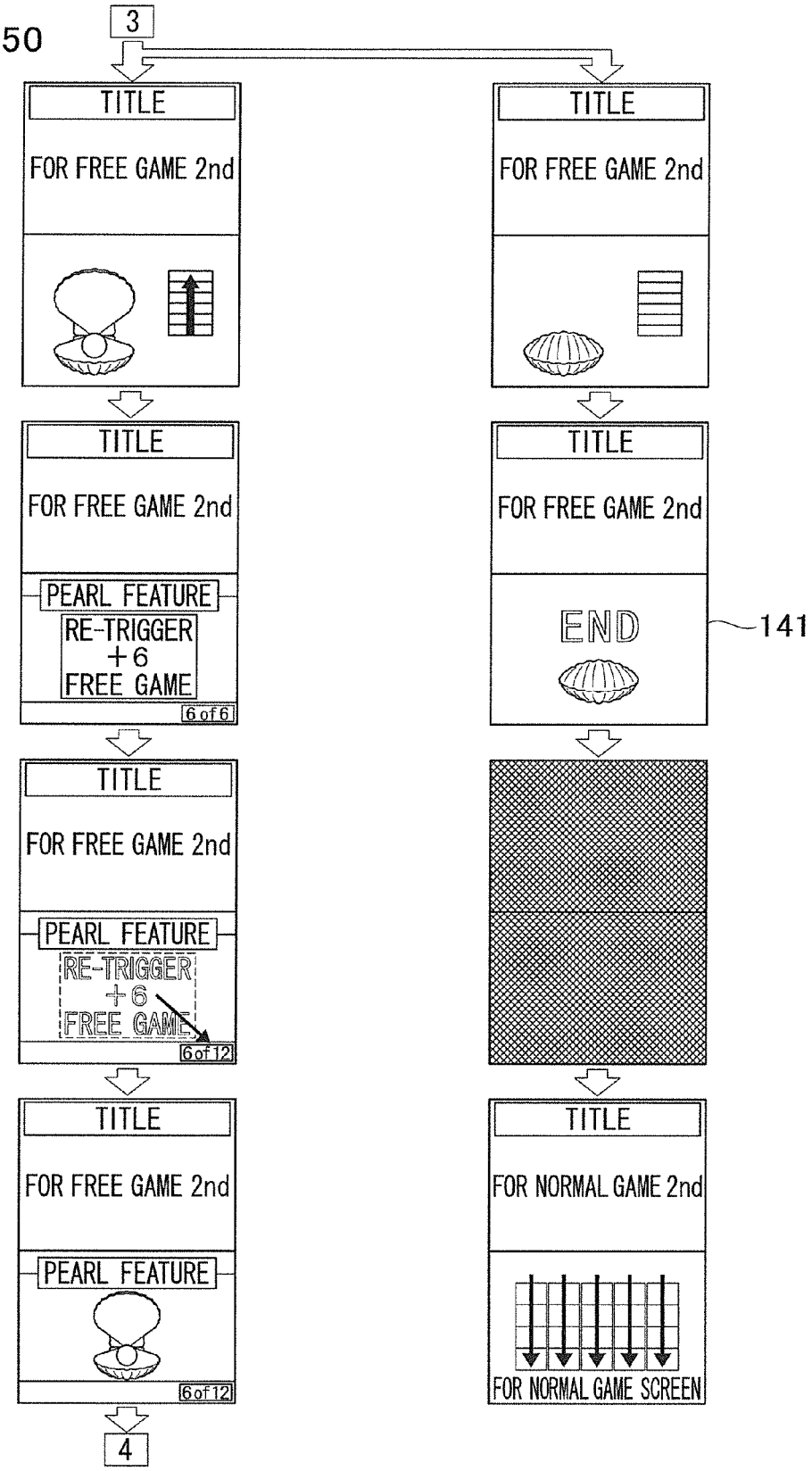
FIG. 50 shows the re-trigger effect in the slot machine of the embodiment of the present invention.

As described above, when the re-trigger is not achieved in the re-trigger random determination process (S111), an image of closed pearl oyster is displayed as shown in FIG. 50, and a text "END" is displayed on the lower image display panel 141. Then dark change is carried out and the screen shifts to the normal game screen.

Figure 51:
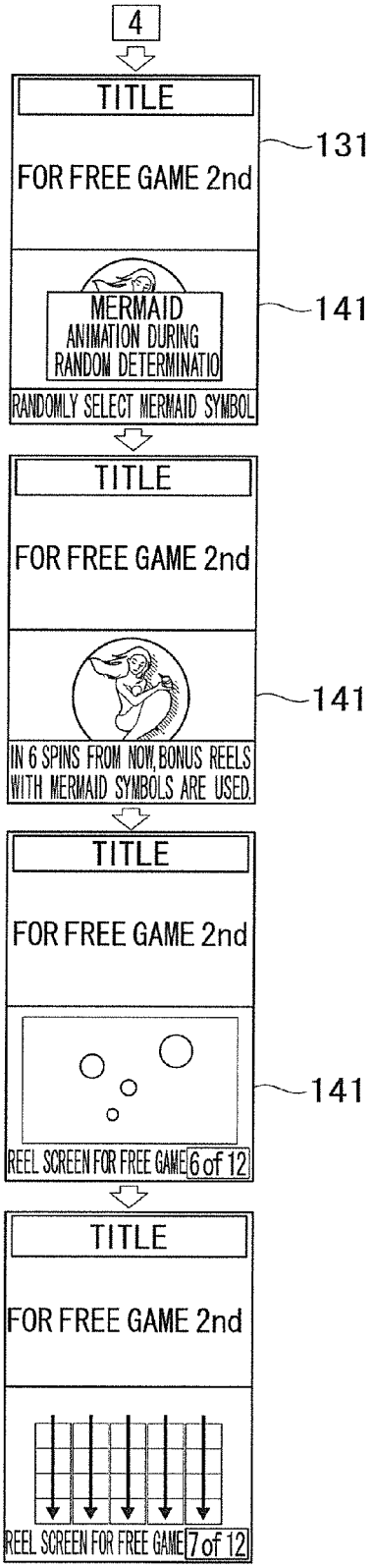
FIG. 51 shows the re-trigger effect in the slot machine of the embodiment of the present invention.

In the meanwhile, when the re-trigger is achieved in the re-trigger random determination process (S111), an image of opened pearl oyster is displayed as shown in FIG. 50, and an image indicating that the re-trigger is achieved and the number of times of execution of the free game is increased by 6 is displayed. Thereafter, as shown in FIG. 51, an animation image notifying that the free game video reel group selection process (S102) is in progress is displayed, the type of the free game video reel used in the free game is notified, and then a dark change image (image of bubbles) is displayed. Subsequently, the free game is executed.

It is noted that the frame of the meter 240 blinks each time the spin button 46 is pressed. The blinking operation includes normal blinking in which the stages 241 to 245 blink and lizhi blinking in which rapid blinking is performed at the time of whether to increase to the last stage 246 is indeterminate. When the re-trigger is achieved in the re-trigger random determination process (S111), the level of the meter 240 eventually reaches the stage 246 even if the number of times of hitting of the spin button does not reach the predetermined number. Alternatively, a function similar to the pressing of the spin button 46 may be achieved by touching, smoothing, or tapping the closed pearl oyster through the touch panel 114 of the lower image display panel 141.

In the re-trigger effect, in the re-trigger random determination process (S111), the meter 240 which includes plural stages 241 to 246 (which are display regions of different levels) and on which the level indicated by the meter advances to the stages 241 to 246 one by one as a predetermined time elapses or in response to an input by the spin button 46 of the touch panel 114 (input device) is displayed on the lower image display panel 141 (display device), an effect in which the level indicated by the meter advances to the stages 241 to 246 one by one as a predetermined elapses or in response to an input by the spin button 46 of the touch panel 114 (input device) is executed, and in the re-trigger random determination process (S111), when the re-trigger is achieved (i.e., the right to execute the free game is to be awarded), an effect in which the level indicated by the meter 240 advances to the stage 246 (i.e., the meter 240 becomes to indicate MAX) is executed, and an effect in which the pearl oyster opens and the free game is awarded is executed.

In this regard, when the free game is repeated for the predetermined number of times (6 times) and the re-trigger random determination process (random determination of whether to award the right to execute the free game) is executed again, an effect in which the level indicated by the meter 240 advances to the stages 241 to 246 in the display region one by one in response to an input of the player to the spin button 46 or the touch panel 114 is executed.

This provides the player with a vivid sensory perception of as if he/she actually participates in the re-trigger random determination process.

<Screens During Free Game>

Figure 55:
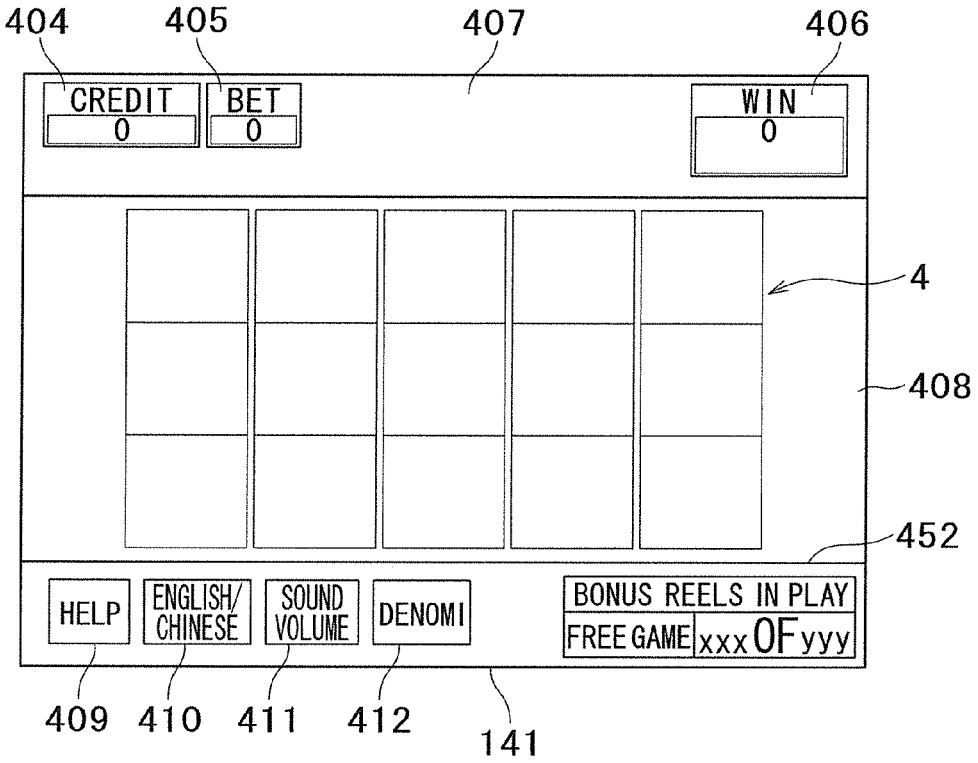
FIG. 55 shows a screen during the free game of the slot machine of the embodiment of the present invention.

Now, referring to FIG. 55, screens during the free game will be described. FIG. 55 shows a screen during the free game in the slot machine of the embodiment of the present invention.

As shown in FIG. 55, being similar to the lower image display panel 141 in the normal state shown in FIG. 29, the lower image display panel 141 in the free game is provided with, in addition to the symbol display region 4, a credit meter 404, a bet meter 405, a win meter 406, a bet information and game state display region 407, a line number display region 408, a help touch button 409, a language switching touch button 410, a sound volume switching touch button 411, and a denomination display region 412.

Furthermore, immediately after the introduction of the free game, a free game counter 452 is displayed to the lower right of the symbol display region 4 of the lower image display panel 141. The free game counter 452 displays a text "BONUS REELS IN PLAY". The text "BONUS REELS IN PLAY" is displayed in the free game because video reel strips different from those in the normal game are used. This text "BONUS REELS IN PLAY" may be hidden under the free game counter 452 or a symbol animation.

The free game counter 452 further displays a text "FREE". The text "FREE" indicates that the free game is in progress, and is enlarged at the start of the spinning in the symbol display region 4 of the lower image display panel 141.

The free game counter 452 further displays a text "xxx OF yyy". In the free game counter 452, the total number of times of execution of the free game and the current number of times of execution of the game are displayed. The part "xxx" is enlarged at the start of the spinning in the symbol display region 4 of the lower image display panel 141. This part "xxx" notifies the player that the execution of the game advances one by one. The part "xxx" displayed "0" before the start of the free game. At the same time as the reels start to rotate in the symbol display region 4 of the lower image display panel 141, the part which displays "xxx" before the start of the free game becomes "+1", and the number is enlarged at the same time as the reproduction of voice. The part "yyy" displays the total number of times of execution of the free game.

[Button Prereading]

Now, button prereading in the slot machine 1 will be described with reference to FIG. 56. FIG. 56 illustrates the button prereading in the slot machine of the embodiment of the present invention. The button prereading is a function in the normal game to receive an input to a spin/max bet button for the next game even immediately before the end of the rotation of the reels, in order to smoothly start the next game.

Figure 56A:
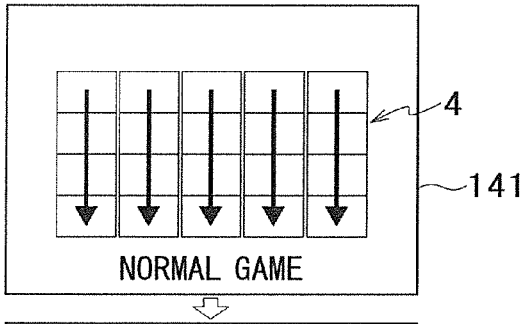
FIG. 56A shows button prereading in the slot machine of the embodiment of the present invention.
Figure 56B:
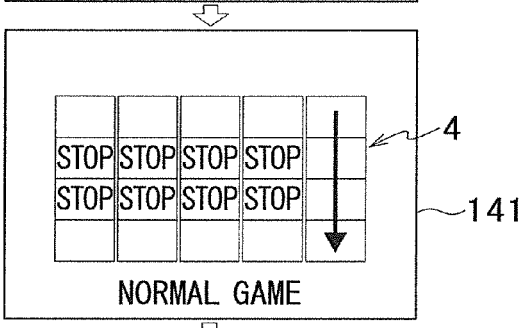
FIG. 56B shows button prereading in the slot machine of the embodiment of the present invention.
Figure 56C:
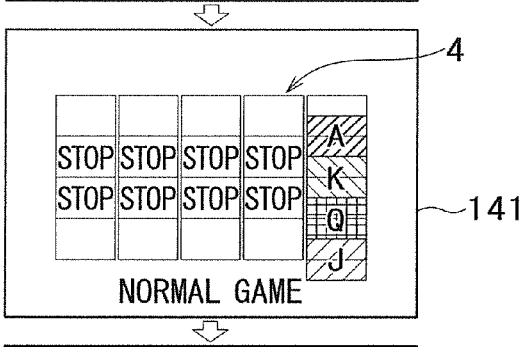
FIG. 56C shows button prereading in the slot machine of the embodiment of the present invention.
Figure 56D:
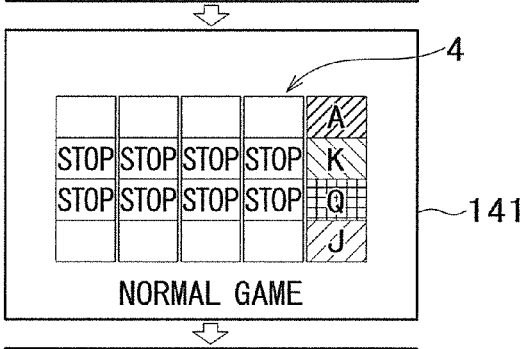
FIG. 56D shows button prereading in the slot machine of the embodiment of the present invention.
Figure 56E:
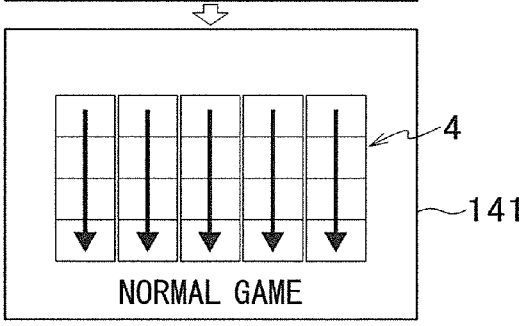
FIG. 56E shows button prereading in the slot machine of the embodiment of the present invention.

In the button prereading function, the symbol display region 4 of the lower image display panel 141 changes as shown in FIGS. 56A to 56E. To begin with, the first to fourth reels of the rotating reels as indicated by the symbol display region 4 of the lower image display panel 141 in FIG. 56A stop as indicated by the symbol display region 4 of the lower image display panel 141 shown in FIG. 56B. Subsequently, as indicated by the symbol display region 4 of the lower image display panel 141 shown in FIG. 56C, the player presses the spin button or the max bet button after the fifth reel completely sinks and before the bounding ends. In this case, when the fifth reel stops in the symbol display region 4 of the lower image display panel 141 as shown in FIG. 56D, the spinning immediately starts in the symbol display region 4 of the lower image display panel 141 as shown in FIG. 56E. In the normal game, the button prereading is active only in the game in which no win (WIN) is achieved. The prereading is activated or disabled by setting the AUDIT.

[Win Meter Information Display]

Figure 57:
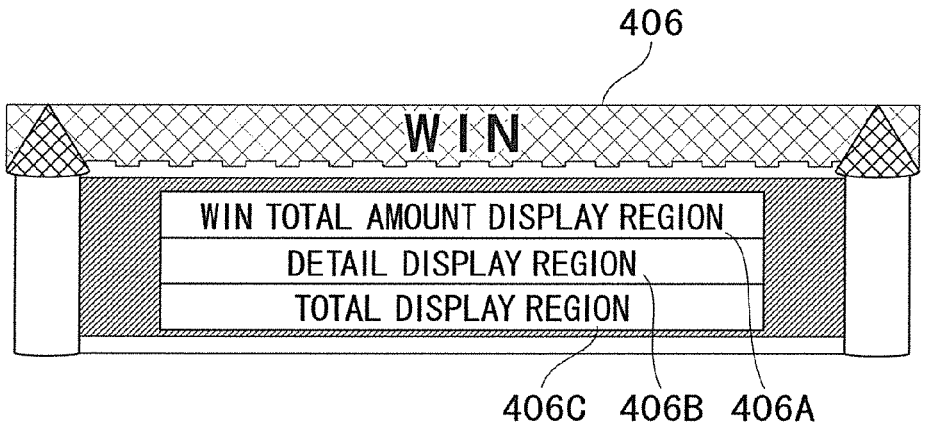
FIG. 57 illustrates win meter information display of the slot machine of the embodiment of the present invention.

Now, win meter information display of the slot machine 1 will be described with reference to FIG. 57. FIG. 57 illustrates the win meter information display of the slot machine of the embodiment of the present invention.

As shown in FIG. 57, a win meter 406 is provided with a win total amount display region 406A, a detail display region 406B, and a total display region 406C.

The win total amount display region 406 displays a win credit and a money amount. Increment display is performed based on a win increment speed sheet, when performed. More specifically, the win total amount display region 406A displays a credit amount obtained in the current game cycle (or in the previous game cycle). When a credit is obtained more than once in one game cycle, the credit is added each time it is obtained. For example, when the free game is triggered in the normal game and the player obtains LINE WIN 20 and SCATTER WIN 100, the image display is incremented from "0" to "120". Thereafter, when a payout amount of 200 is obtained in the free game, the increment display is conducted from 120 to 320. 0 is displayed either when the next game cycle starts or when lost in GAMBLE. In the meanwhile, when a win is achieved in GAMBLE, no increment is carried out and the displayed amount is immediately doubled.

The detail display region 406 relates to a win in the normal game and the free game. After the fifth reel stops, the number of the win line and the win credit are displayed. When more than one line payout simultaneously occurs, the line payouts are displayed one by one at intervals of 0.5 second. The payouts are serially displayed from the one having the smallest payline number, and the one having the smallest number is displayed again after the one having the largest payline number is displayed. In other words, the detail display region 406 displays the details of the credit obtained by the spinning in this time. When there are plural elements (e.g., another line or scatter), the elements are switched at intervals of 0.5 second. The order of switching of image display is from scatter payout to normal payout (from the smallest payline number to the largest payline number).

The total display region 406C displays the total credits of the detail display region 406 when the increment in the win total amount display region 406A is completed. The region is not displayed until the increment in the win total amount display region 406A is completed. In other words, the total display region 406C displays the total credits obtained in the spinning in this time. In this regard, the total credits are displayed after the increment in the win total amount display region 406A is finished.

[GAMBLE]

Now, the GAMBLE in the slot machine 1 will be described with reference to FIG. 58 to FIG. 64. Each of FIG. 58 to FIG. 64 illustrates GAMBLE in the slot machine of the embodiment of the present invention.

Figure 58:
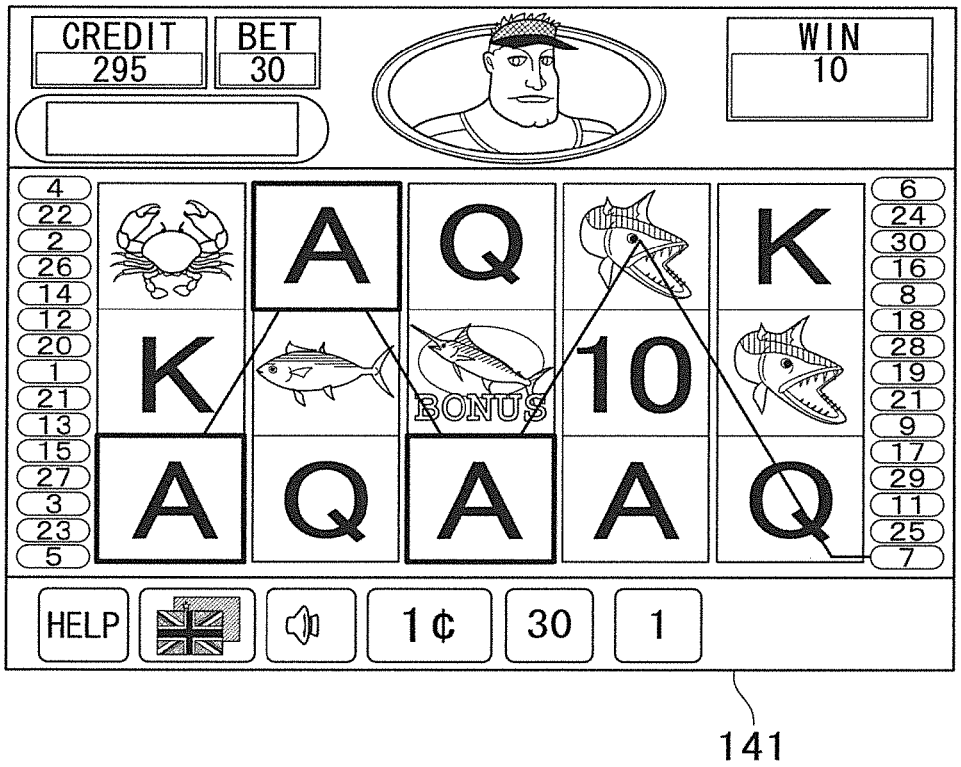
FIG. 58 illustrates GAMBLE in the slot machine of the embodiment of the present invention.
Figure 59:
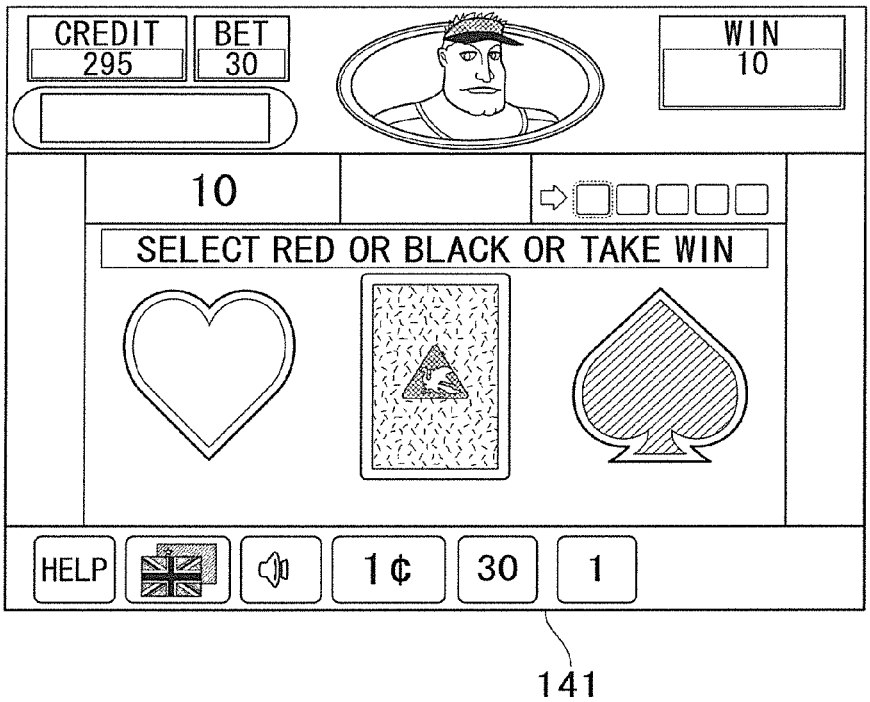
FIG. 59 illustrates GAMBLE in the slot machine of the embodiment of the present invention.

To begin with, when a win (WIN) is achieved, the lower image display panel 141 shown in FIG. 58 is changed to the lower image display panel 141 shown in FIG. 59. In other words, a GAMBLE screen is displayed whereas the message "PLAY ON, GAMBLE or TAKE WIN" is deleted from the lower image display panel 141. In the meanwhile, a message "SELECT RED OR BLACK OR TAKE WIN" is displayed on the lower image display panel 141.

Figure 60:
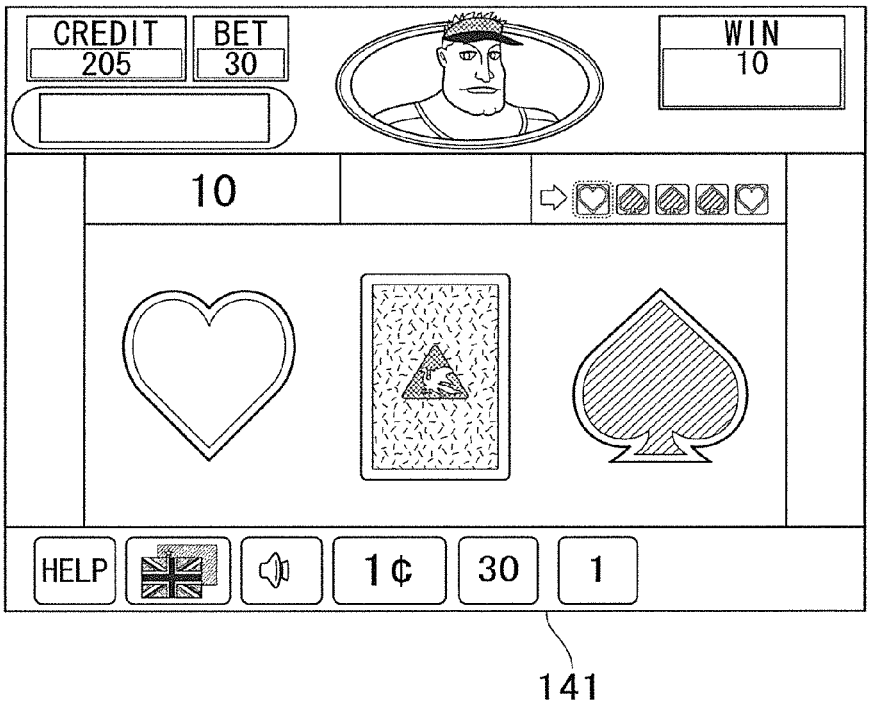
FIG. 60 illustrates GAMBLE in the slot machine of the embodiment of the present invention.

Subsequently, on the lower image display panel 141 shown in FIG. 60, a betted amount is displayed on the lower image display panel 141 as "GAMBLE AMOUNT". The player selects "RED" or "BLACK". When the player succeeds in the selection, the lower image display panel 141 is changed to the later-described lower image display panel 141 shown in FIG. 63. In the meanwhile, when the player fails in the selection, the lower image display panel 141 is changed to the lower image display panel 141 shown in FIG. 61. When the player selects "TAKE WIN", the amount of win is immediately added to the credits on the lower image display panel 141 and the idle state returns.

Figure 61:
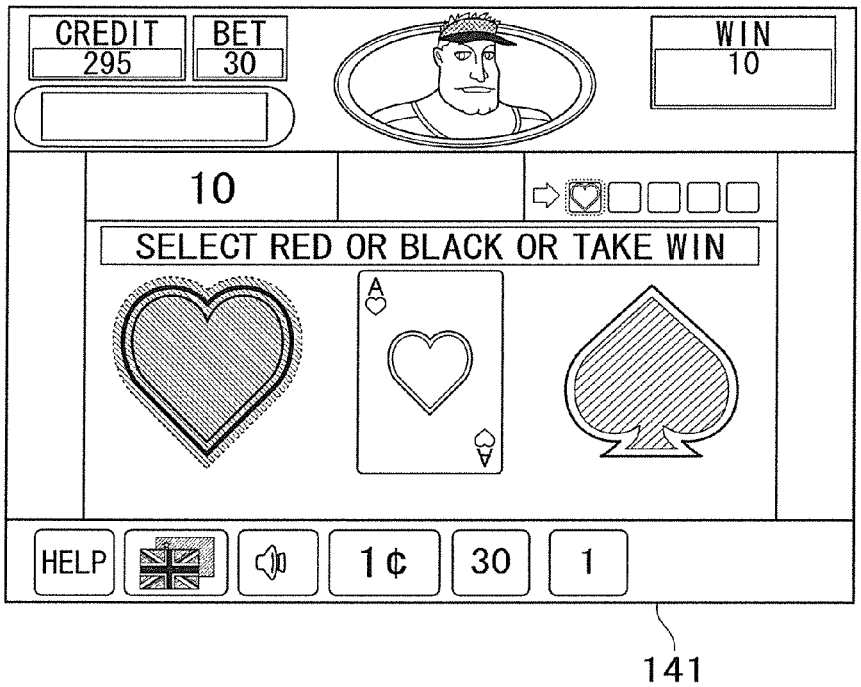
FIG. 61 illustrates GAMBLE in the slot machine of the embodiment of the present invention.
Figure 62:
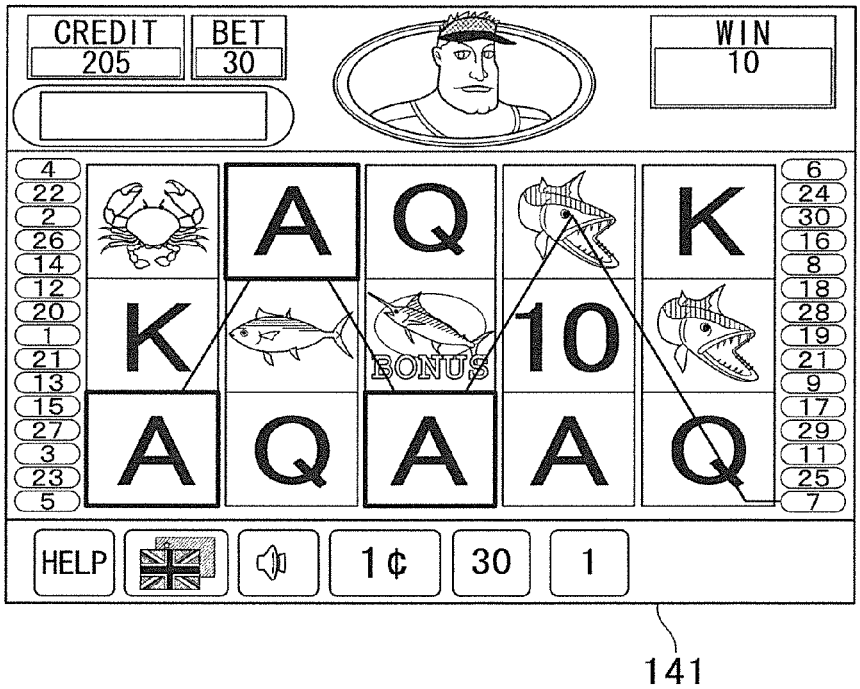
FIG. 62 illustrates GAMBLE in the slot machine of the embodiment of the present invention.

When the player fails in the selection, the option ("RED" or "BLACK") which is not selected is darkened on the lower image display panel 141 shown in FIG. 61. On the lower image display panel 141 shown in FIG. 61, the history of card selection is immediately displayed at the leftmost part of the "GAMBLE HISTORY". When there is previous history of card selection, that previous history is moved to the immediate right. The trace of the movement is not illustrated in animation, and hence the history is rewritten at once. Furthermore, the result of the central card is immediately displayed. At this stage, however, neither the win meter nor the gamble amount meter changes. Then failure sound is reproduced, and after 1.2 seconds elapse after the sound reproduction, the screen is switched to a main game screen as indicated by the lower image display panel 141 shown in FIG. 62. At the same time as the switching to the main game screen, "0" is displayed on the win meter.

Figure 63:
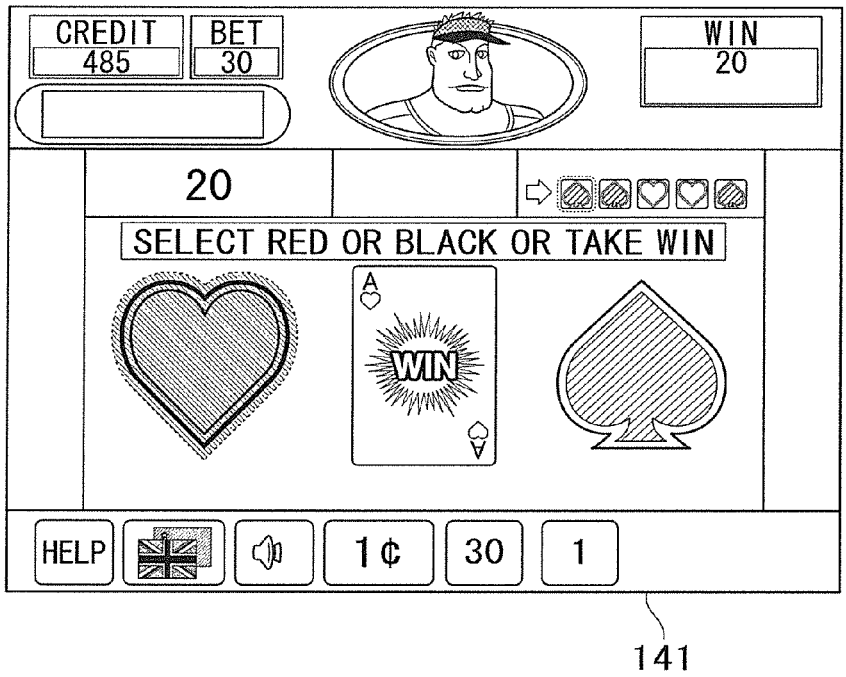
FIG. 63 illustrates GAMBLE in the slot machine of the embodiment of the present invention.
Figure 64:
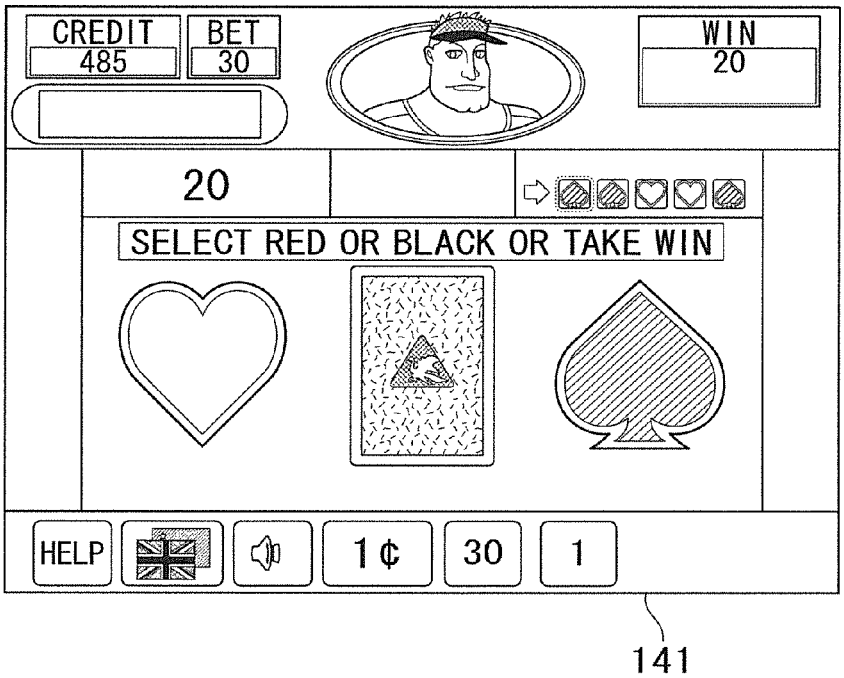
FIG. 64 illustrates GAMBLE in the slot machine of the embodiment of the present invention.

When the player succeeds in the selection, the option ("RED" or "BLACK") which is not selected is darkened on the lower image display panel 141 shown in FIG. 63. On the lower image display panel 141 shown in FIG. 63, the history of card selection is immediately displayed at the leftmost part of the "GAMBLE HISTORY". When there is previous history of card selection, that previous history is moved to the immediate right. The trace of the movement is not illustrated in animation, and hence the history is rewritten at once. Furthermore, as the central card, a normal card and a card with WIN text are alternately displayed for each frame, and success sound is reproduced for 1.2 seconds. To the win meter, the amount increased by the result of GAMBLE is immediately added. At this stage, however, the gamble amount meter does not change.

When GAMBLE is played until reaching the upper limit number of times, the value of win is added to the credit at once and the idle state returns. In the meanwhile, the number of times of playing the GAMBLE has not reached the upper limit, the lower image display panel 141 is changed to the lower image display panel 141 shown in FIG. 64. On the lower image display panel 141 shown in FIG. 64, the central card is overturned. Thereafter, the lower image display panel 141 is changed to the lower image display panel 141 shown in FIG. 60.

[RESIDUAL GAMBLE]

Figure 65:
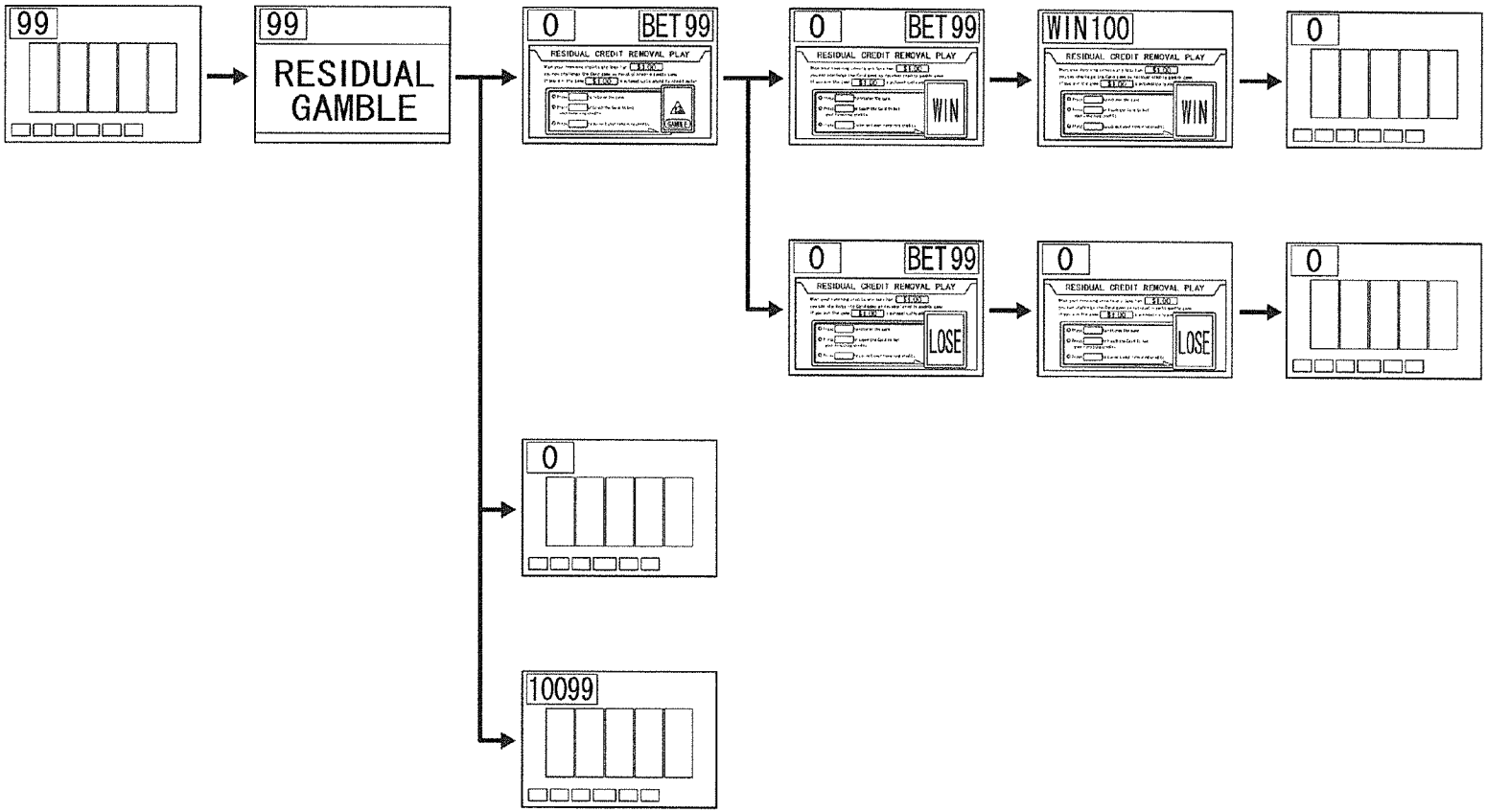
FIG. 65 illustrates RESIDUAL GAMBLE in the slot machine of the embodiment of the present invention.
Figure 67:
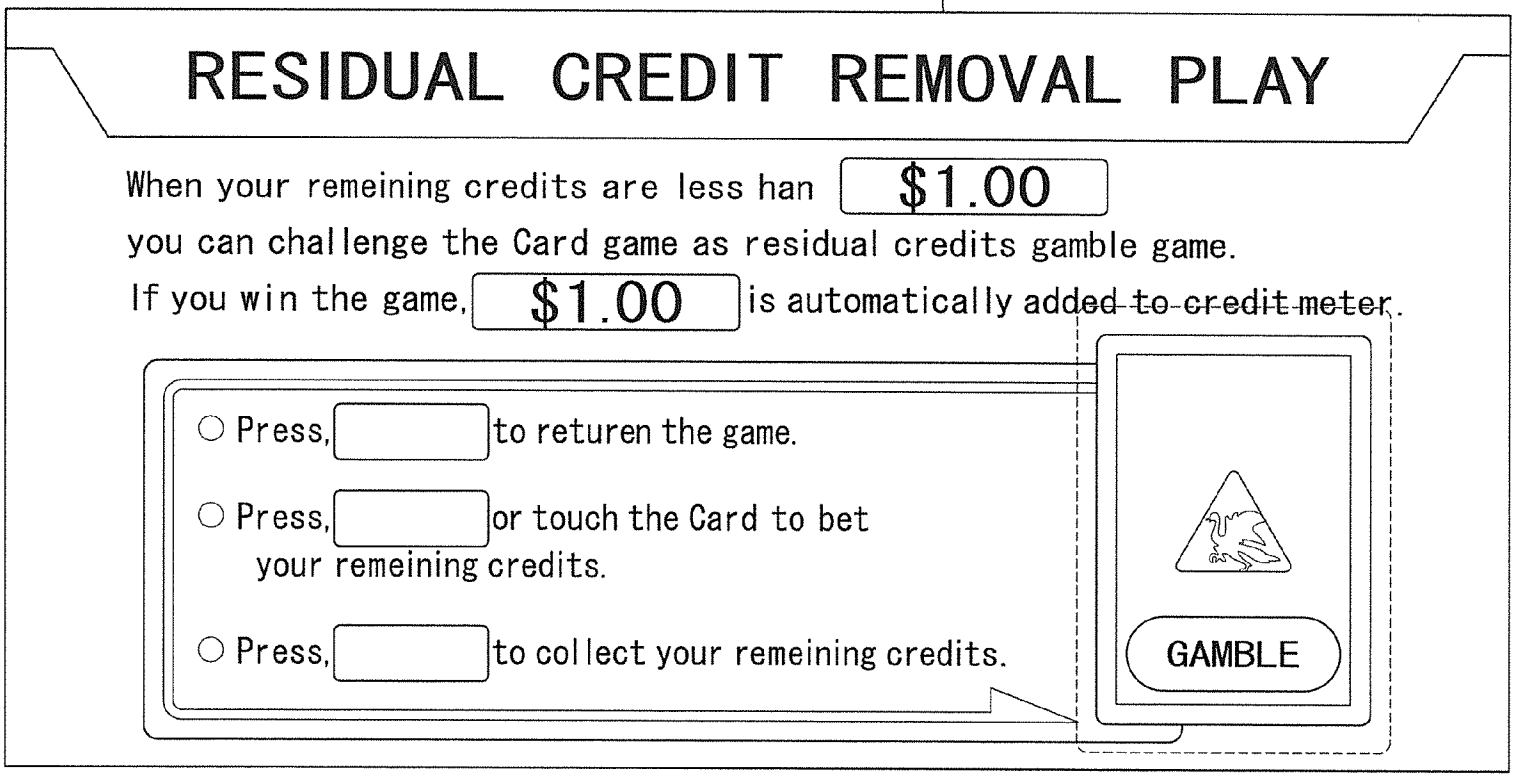
FIG. 67 illustrates RESIDUAL GAMBLE in the slot machine of the embodiment of the present invention.

Now, RESIDUAL GAMBLE of the slot machine 1 will be described with reference to FIG. 65 to FIG. 67. Each of FIG. 65 to FIG. 67 illustrates RESIDUAL GAMBLE in the slot machine of the embodiment of the present invention. RESIDUAL GAMBLE is executed in line with the flow shown in FIG. 65, by using a table shown in FIG. 66. In this connection, in a stage in the RESIDUAL GAMBLE, an image 501 shown in FIG. 67 is displayed on the lower image display panel 141.

[System Font Display Region]

Figure 68:
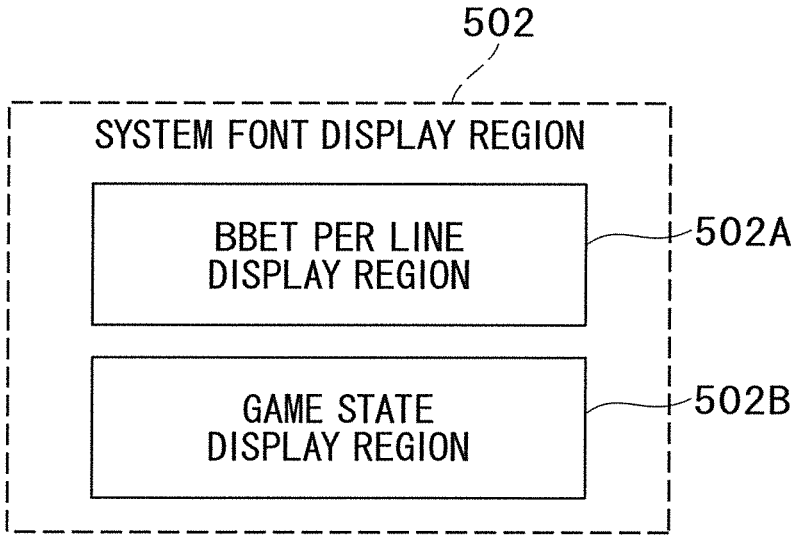
FIG. 68 shows a system font display region of the slot machine of the embodiment of the present invention.

Now, a system font display region of slot machine 1 will be described with reference to FIG. 68. FIG. 68 shows the system font display region of the slot machine of the embodiment of the present invention. The system font display region 502 shown in FIG. 68 is provided with a bet per line display region 502A and a game state display region 502B. The system font display region 502 is provided in the bet information and game state display region 407 on the lower image display panel 141 (see FIG. 29).

[HELP]

Figure 69:
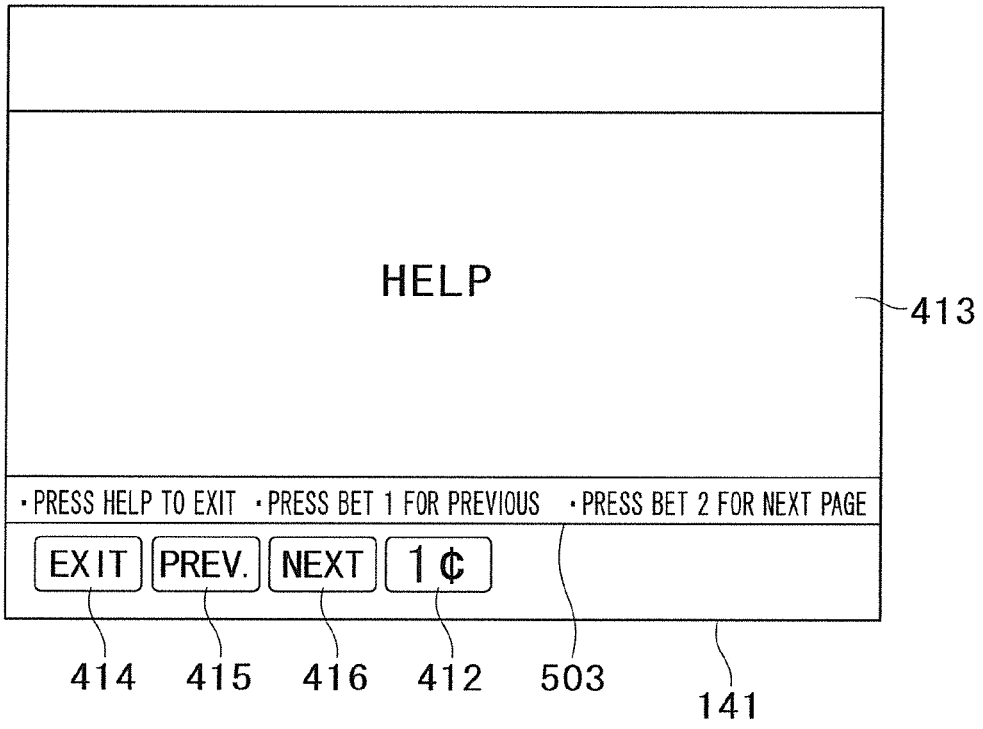
FIG. 69 illustrates HELP in the slot machine of the embodiment of the present invention.

Now, HELP of the slot machine 1 will be described with reference to FIG. 69 and FIG. 70. FIG. 69 and FIG. 70 explain HELP in the slot machine of the embodiment of the present invention. As shown in FIG. 69, on the lower image display panel 141 in HELP, a help screen 413 and a message region 503 are provided, and an EXIT touch button 414, a PREV. touch button 415, a NEXT touch button 416, and a denomination display region 412 are displayed.

The message region 503 is displayed with system fonts. This region is linked with the control panel 30 or the control panel 460. For this reason, when another pattern is used and the number is changed, the image display on the region is changed to the correct one in accordance with the change.

As indicated in the table shown in FIG. 70, when the player touches or presses the EXIT touch button 414 or the help button on the control panel, the lower image display panel 141 in HELP is changed to the normal screen. When the player touches or presses the PREV. touch button 415 or a BET×1 button on the control panel, the lower image display panel 141 in HELP is changed to the preceding HELP page. When the player touches or presses the NEXT touch button 416 or a BET×2 button on the control panel, the lower image display panel 141 in HELP proceeds to the next HELP page.

[Layout of Screen Touch Buttons]

Now, the following will describe the layout of the screen touch buttons in the slot machine 1, with reference to FIG. 71 to FIG. 73. Each of FIG. 71 to FIG. 73 illustrates the layout of screen touch buttons in the slot machine of the embodiment of the present invention.

Figure 71A:
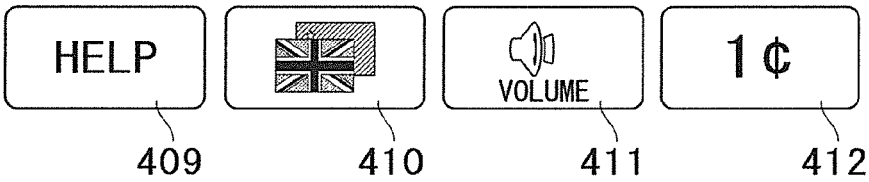
FIG. 71A illustrates the layout of screen touch buttons in the slot machine of the embodiment of the present invention.
Figure 71B:
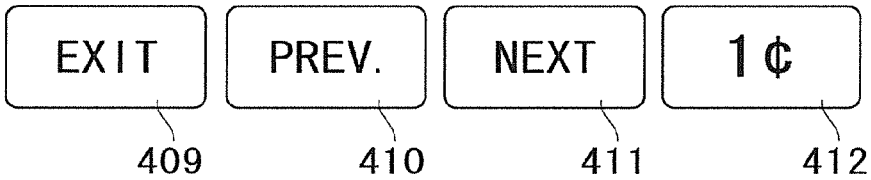
FIG. 71B illustrates the layout of screen touch buttons in the slot machine of the embodiment of the present invention.
Figure 71C:
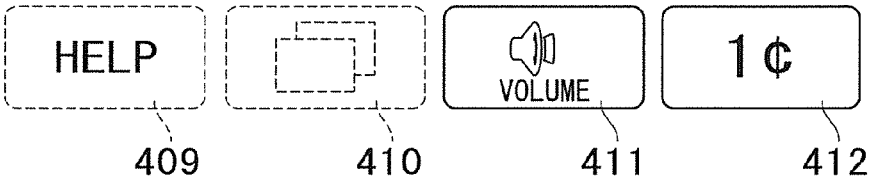
FIG. 71C illustrates the layout of screen touch buttons in the slot machine of the embodiment of the present invention.
Figure 71D:
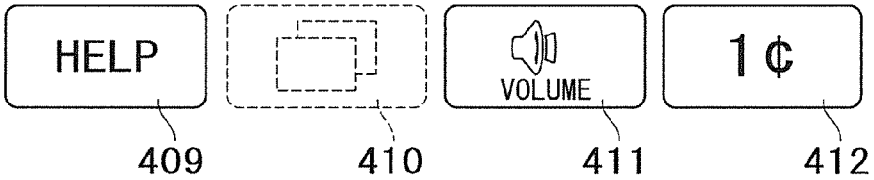
FIG. 71D illustrates the layout of screen touch buttons in the slot machine of the embodiment of the present invention.
Figure 72A:
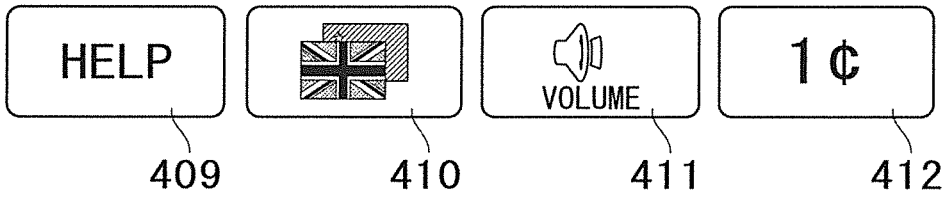
FIG. 72A illustrates the layout of screen touch buttons in the slot machine of the embodiment of the present invention.
Figure 72B:
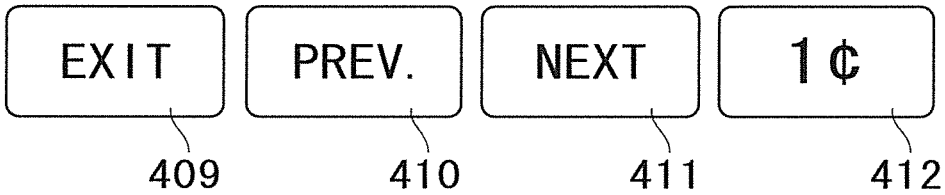
FIG. 72B illustrates the layout of screen touch buttons in the slot machine of the embodiment of the present invention.
Figure 72C:
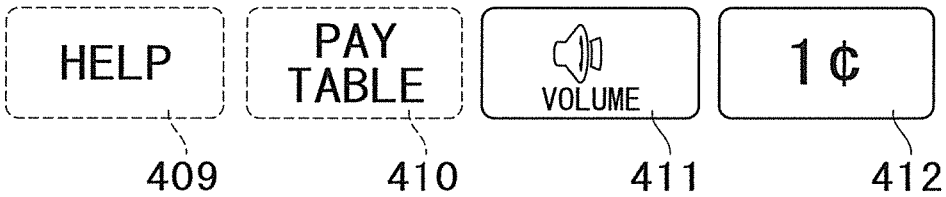
FIG. 72C illustrates the layout of screen touch buttons in the slot machine of the embodiment of the present invention.
Figure 72D:
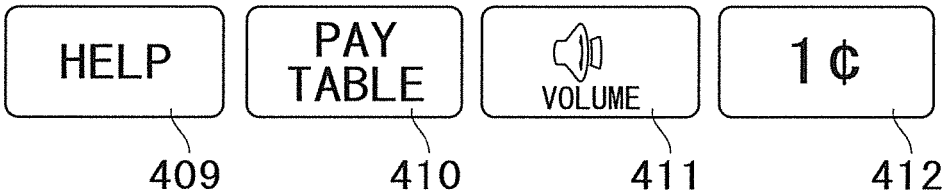
FIG. 72D illustrates the layout of screen touch buttons in the slot machine of the embodiment of the present invention.

FIG. 71A shows the layout of the screen touch buttons during IDLE. FIG. 71B shows the layout of the screen touch buttons in HELP. FIG. 71C shows the layout of the screen touch buttons while the game is in progress. FIG. 71D is the layout of the screen touch buttons in the state of GAMBLE or TAKE WIN. FIG. 72A shows the layout of the screen touch buttons in IDLE (language switching disabled). FIG. 72B shows the layout of the screen touch buttons in HELP (language switching disabled). FIG. 72C shows the layout of the screen touch buttons during the game (language switching disabled). FIG. 72D shows the layout of the screen touch buttons in the state of GAMBLE or TAKE WIN (language switching disabled).

In the layout of the screen touch buttons in the slot machine 1, a help touch button 409, a language switching touch button 410, a sound volume switching touch button 411*a* denomination display region 412, an EXIT touch button 414, a PREV. touch button 415, or NEXT touch button 416 is provided. In particular, when the language switching is disabled and the game is in progress or the state is in GAMBLE or TAKE WIN, as shown in FIGS. 72C and 72D, a paytable touch button 504 is provided. These touch buttons are active when turned on and inactive when turned off as shown in FIG. 73.

[Sound Volume Switching Touch Button]

Figure 74:
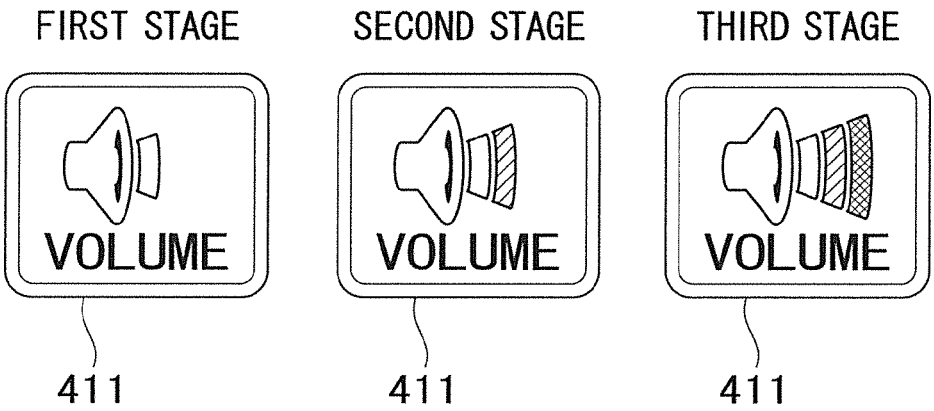
FIG. 74 illustrates a sound volume switching touch button of the slot machine of the embodiment of the present invention.
Figure 75:
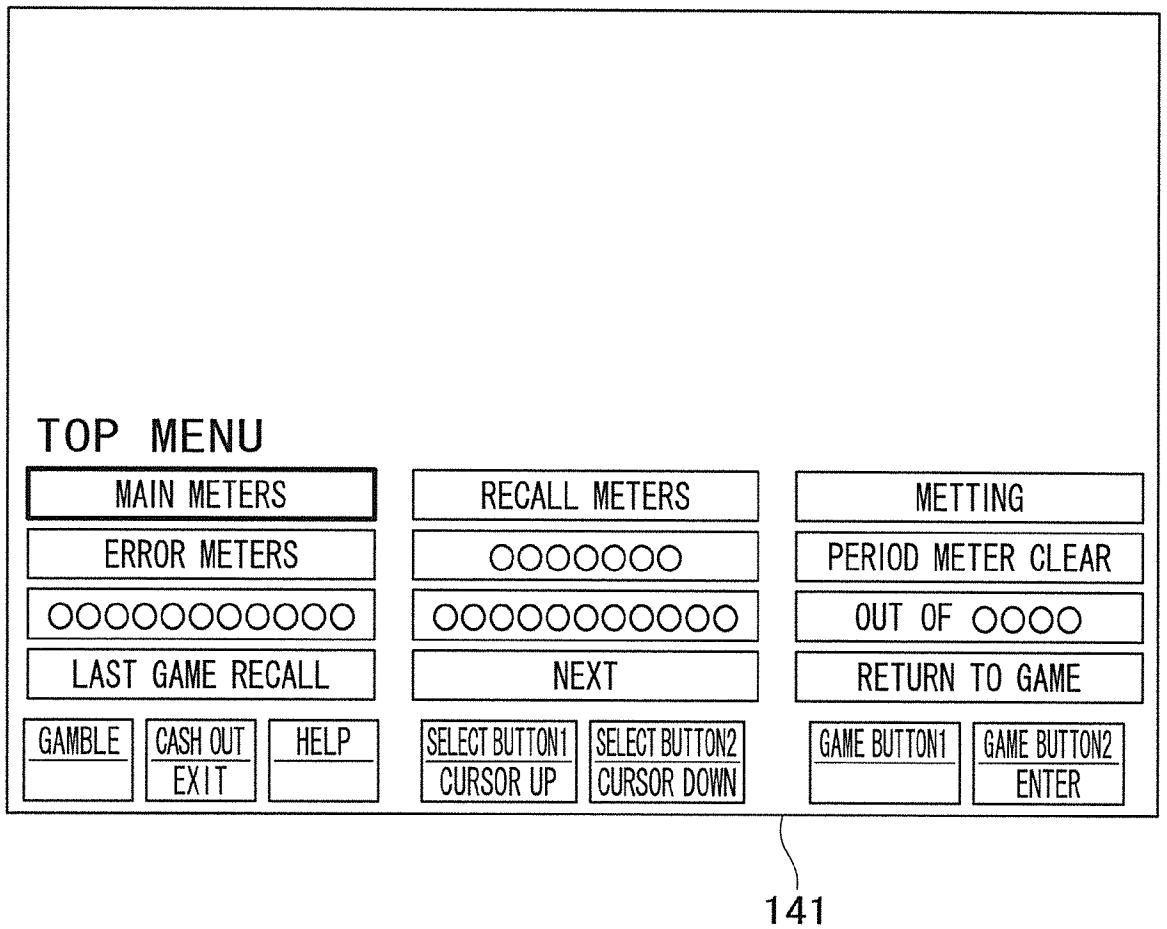
FIG. 75 shows AUDIT national flag switch setting in the slot machine of the embodiment of the present invention.
Figure 76:
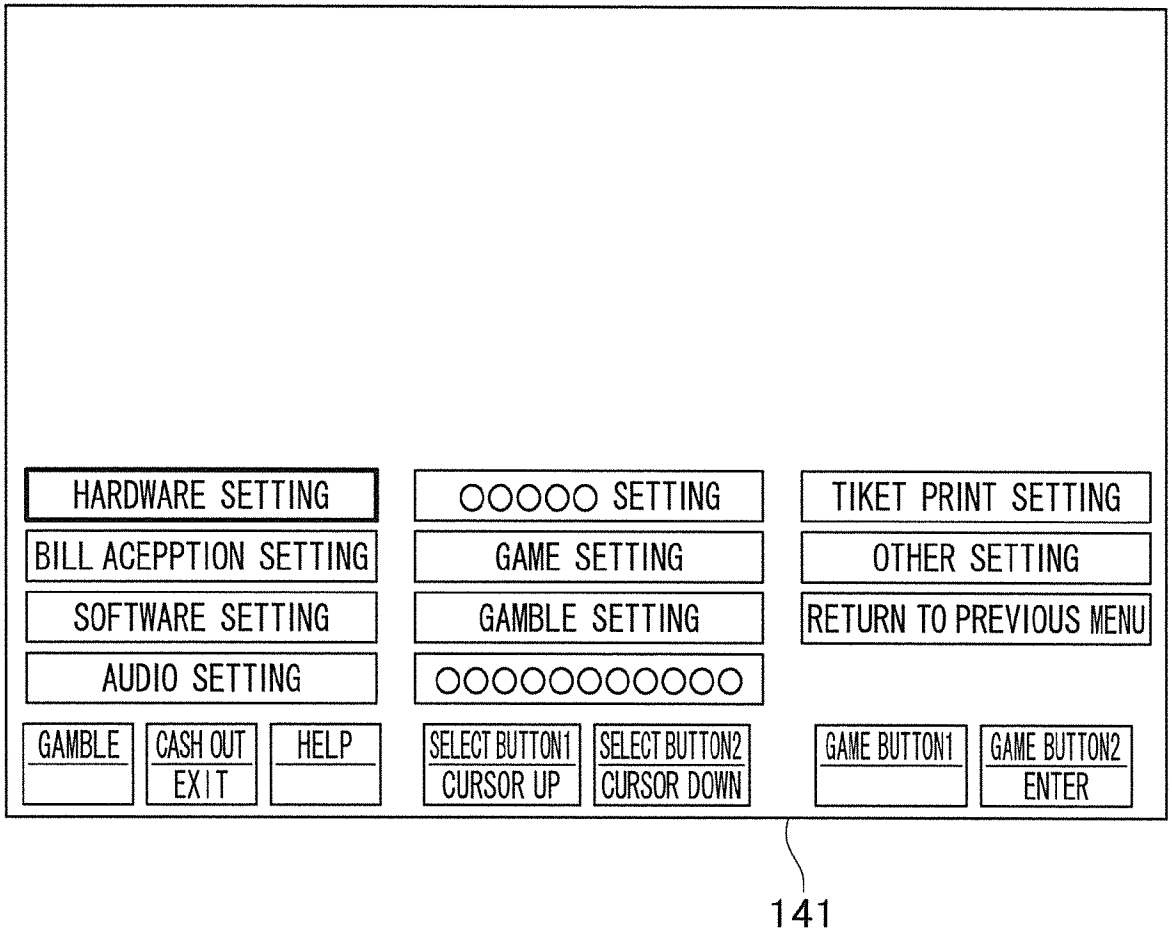
FIG. 76 shows the AUDIT national flag switch setting in the slot machine of the embodiment of the present invention.
Figure 77:
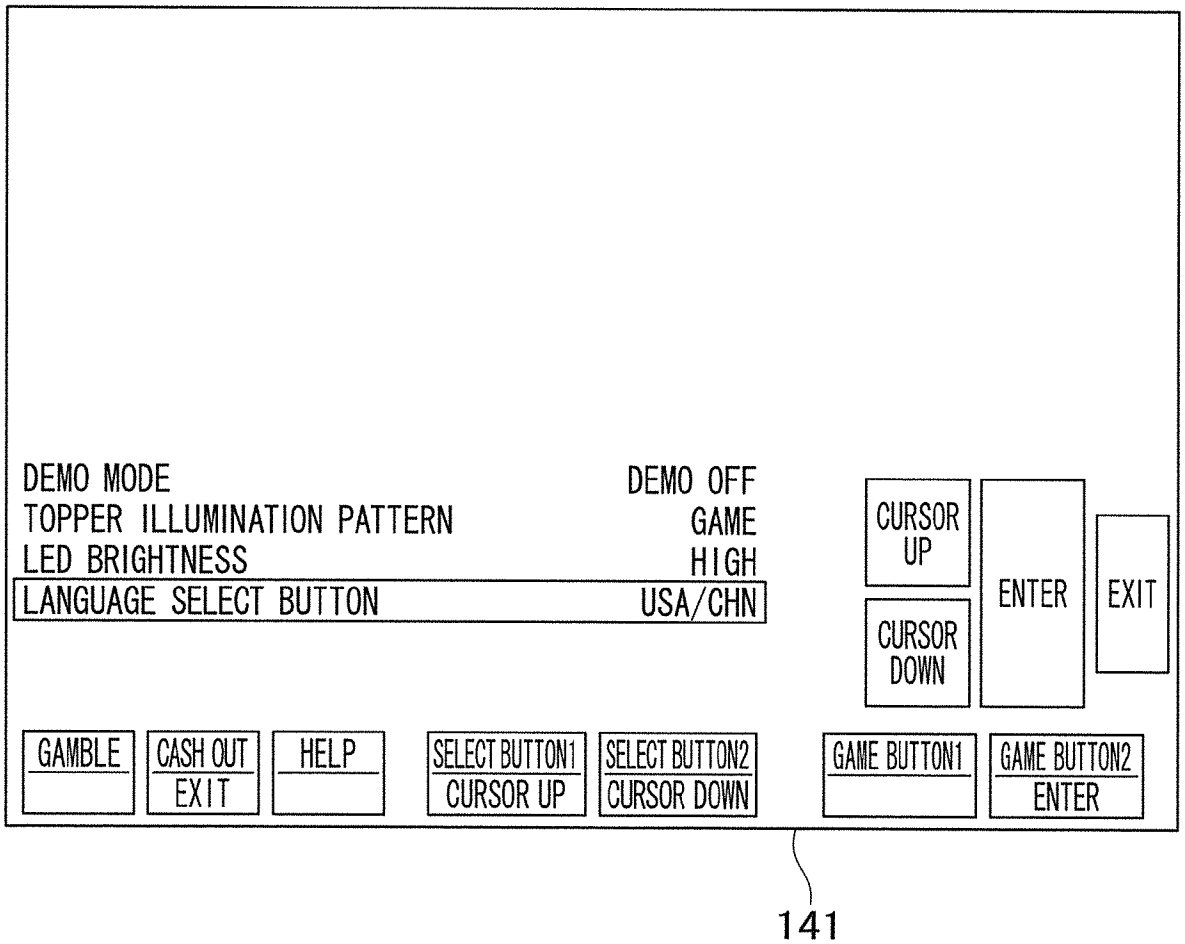
FIG. 77 shows the AUDIT national flag switch setting in the slot machine of the embodiment of the present invention.
Figure 78:
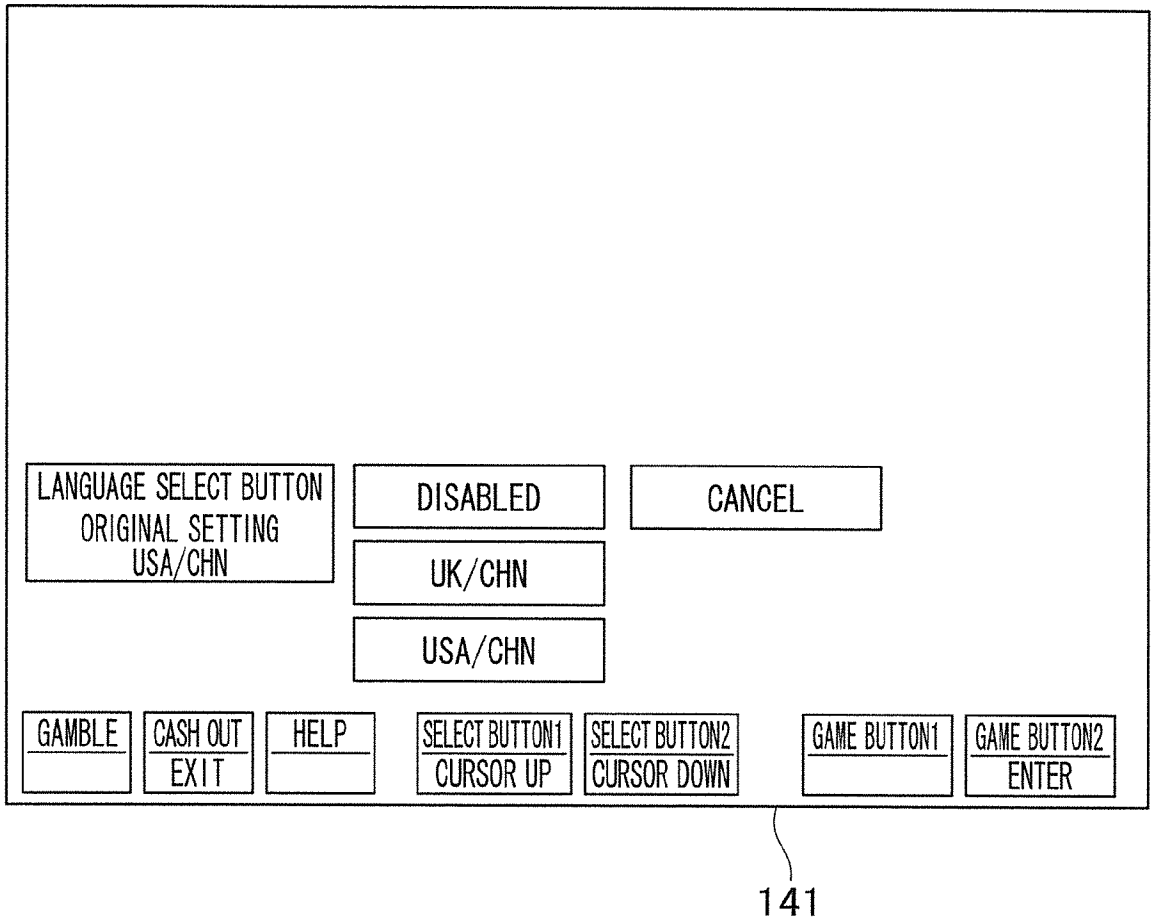
FIG. 78 shows the AUDIT national flag switch setting in the slot machine of the embodiment of the present invention.

Now, referring to FIG. 74, the following will describe the sound volume switching touch button 411 of the slot machine 1. FIG. 74 illustrates the sound volume switching touch button of the slot machine of the embodiment of the present invention. As shown in FIG. 74, the sound volume switching touch button 411 is used for selecting one of the first-stage minimum volume, second-stage intermediate volume, and third-stage maximum volume. The sound volume is set at the first-stage minimum volume in the initial setting. Each time the player touches the sound volume switching touch button 411, the sound volume is changed to the second-stage intermediate volume, to the third-stage maximum volume, to the first-stage minimum volume, and to the second-stage intermediate volume, in a looped manner.

[AUDIT National Flag Switch Setting]

Now, referring to FIG. 75 to FIG. 78, AUDIT national flag switch setting of the slot machine 1 will be described. Each of FIG. 75 to FIG. 78 shows the AUDIT national flag switch setting in the slot machine of the embodiment of the present invention. On the lower image display panel 141 shown in FIG. 75 to FIG. 78, the AUDIT national flag switch setting of the slot machine of the embodiment of the present invention makes it possible to specify, by the AUDIT MENU, the "national flag" displayed on the language switching touch button 410 when switching the language. The "national flag" displayed on the language switching touch button 410 is one of the national flags, of U.S.A., U.K., and China.

[Outline of Gaming Machine of Another Embodiment]

This gaming machine is arranged to execute a winning line emphasizing process which is arranged such that, when a result of a game of rearranging symbols is a win, the combination of the positions of the rearranged symbols achieving the win is set as a winning line region, and this winning line region is emphasized as compared to the other regions.

Figure 79:
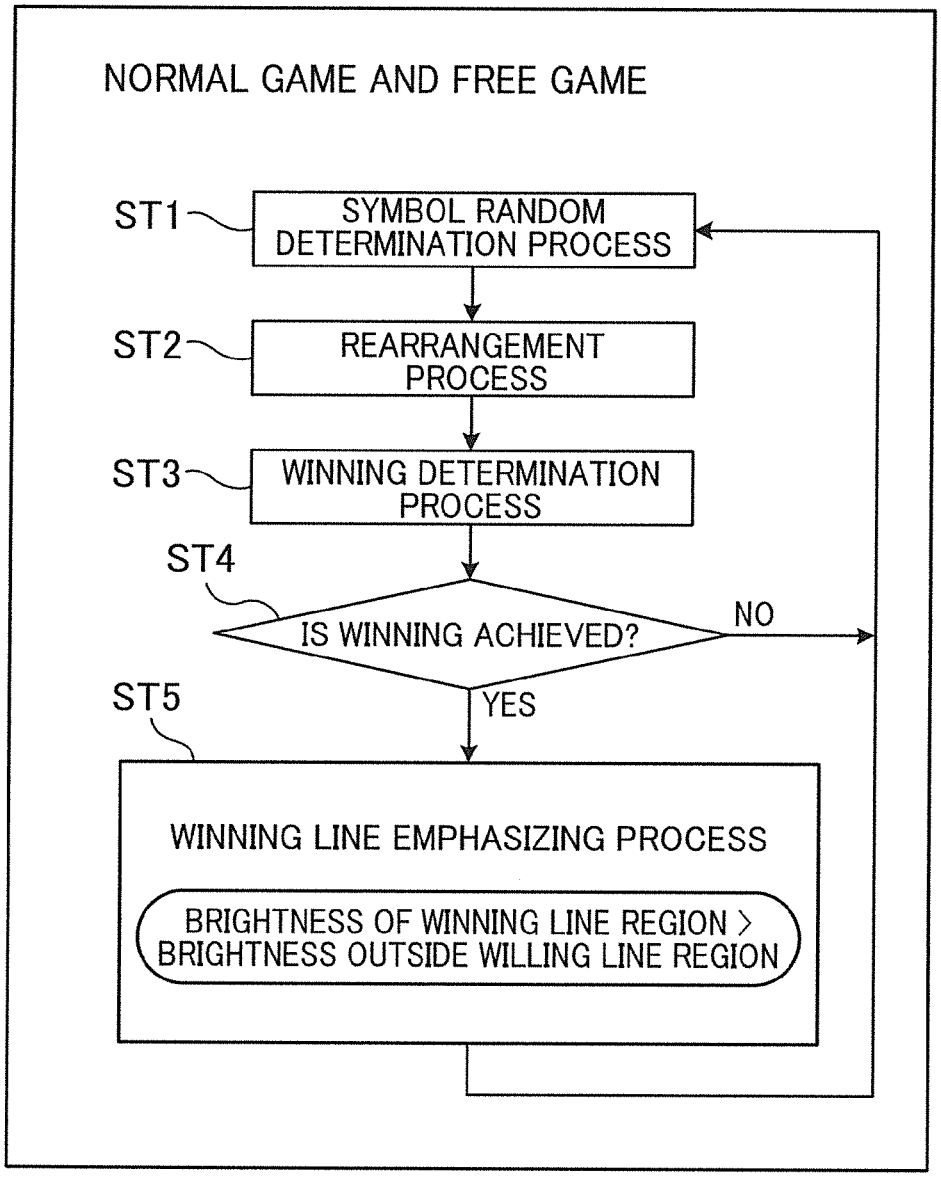
FIG. 79 is a flowchart showing the steps of a winning line emphasizing process of the slot machine of the embodiment of the present invention.

More specifically, as shown in FIG. 79, in the normal game or the free game, which symbols are rearranged is determined in a symbol random determination process (ST1), the symbols are rearranged (ST2), and whether a game result is winning is determined (ST3). When the game result is a win (ST3: YES), the winning line emphasizing process is executed (ST5). That is to say, in ST5, the combination of the positions of the rearranged symbols achieving the win is set as a winning line region, and this winning line region is emphasized as compared to the other regions.

More specifically, the gaming machine includes a symbol display device which is configured to display a result of a game of rearranging plural symbols and a controller which is programmed to execute the following steps (A1) to (A4). The step (A1) is a step of randomly determining symbols to be rearranged on the symbol display device. The step (A2) is a step of rearranging the symbols determined in (A1) on the display device, and determining whether a result of the game is winning, based on the combination of the positions of the rearranged symbols. The step (A3) is a step for, when the game result is a win in (A2), setting the combination of the symbols related to the win, as the winning line region. The step (A4) is a step for relatively decreasing the brightness of a symbol rearranged outside the winning line region as compared to the brightness of the symbols rearranged in the winning line region in the step (A3).

To put it differently, the gaming machine may be operated by the control method below. That is to say, the control method includes the steps of: (A1) randomly determining symbols to be rearranged on a symbol display device; (A2) rearranging the symbols determined in the step (A1) on the symbol display device and determining whether a result of a game is winning, based on a combination of positions of the rearranged symbols; (A3) when the result of the game is a win in the step (A2), setting the combination of the positions of the rearranged symbols achieving the win, as a winning line region; and (A4) relatively decreasing the brightness of a symbol rearranged outside the winning line region as compared to the symbols rearranged in the winning line region in the step (A3).

The feature "relatively decreasing the brightness of a symbol rearranged outside the winning line region" may be achieved by decreasing the brightness of the symbol outside the winning line region to be lower than the brightness at the start of the game or by increasing the brightness of the symbols in the winning line region to be higher than the brightness at the start of the game. The brightness may be increased or decreased in the entirety of the winning line region or in the entirety of the outside of the winning line region, or may be increased or decreased in each position of the rearranged symbol.

As such, the gaming machine realizes a new way of winning notification which is arranged in such a way that a combination of symbols achieving winning is easily recognizable for the player as the brightness of a symbol provided outside the winning line region is relatively lowered as compared to the brightness of symbols rearranged in the winning line region.

In addition to the above, the controller of the gaming machine is programmed to further execute the following step (A5). The step (A5) is a step of, when it is determined in the step (A2) that the result of the game is plural times of win, executing the steps (A3) and (A4) at different timings for the win of the respective times.

With this arrangement, the gaming machine realizes a new way of winning notification which is arranged in such a way that each combination of symbols achieving a win is easily recognizable for the player as the step of relatively decreasing the brightness of a symbol provided outside the winning line region as compared to the brightness of symbols rearranged in the winning line region is executed at different timings for the win of the respective times.

In addition to the above, the gaming machine includes a storage storing a winning line region constituted by a combination of positions of rearranged symbols with which the result of the game is a win and a winning line number associated with the winning line region, and the controller is programmed to further execute the step (A6) below. The step (A6) is arranged in such a way that, when it is determined in the step (A2) that the result of the game is plural times of win, the winning line number which has been associated with the winning line region in (A3) is read from the storage for the win of each time, and the step (A4) is executed for the respective winning line numbers in descending order or ascending order.

With this arrangement, the gaming machine realizes a new way of winning notification which is arranged in such a way that each combination of symbols achieving a win is easily recognizable for the player as the step of relatively decreasing the brightness of a symbol provided outside the winning line region as compared to the brightness of the symbols rearranged in the winning line region is executed for the respective winning line numbers in descending order or ascending order, and because the order of display is associated with the ascending order or descending order of the winning line numbers, each state of the combinations of the symbols achieving the win can be easily remembered.

In addition to the above, in the step (A6), the gaming machine changes the timing of switching each time the step (A4) is executed. This arrangement allows the gaming machine to provide an effect which is arranged such that the timing of switching of the winning line numbers in the ascending order or descending order is unexpected for the player as the timing is changed each time.

In addition to the above, in the step (A4), the gaming machine differentiates the display state of the symbols rearranged in the winning line region from the display state of the symbol rearranged outside the winning line region. In this connection, the display state is a combination of at least one of color, blinking, shape, and mark display.

On this account, the gaming machine realizes a new way of winning notification which is arranged in such a way that, in addition to the relative decrease in the brightness of a symbol provided outside the winning line region as compared to the brightness of the symbols rearranged in the winning line region, the state of the combination of the symbols achieving the win is further easily recognizable for the player, as the display state of the symbols in the winning line region is differentiated from the display state of the symbol outside the winning line region.

<Winning Line Emphasizing Process 1>

Figure 80:
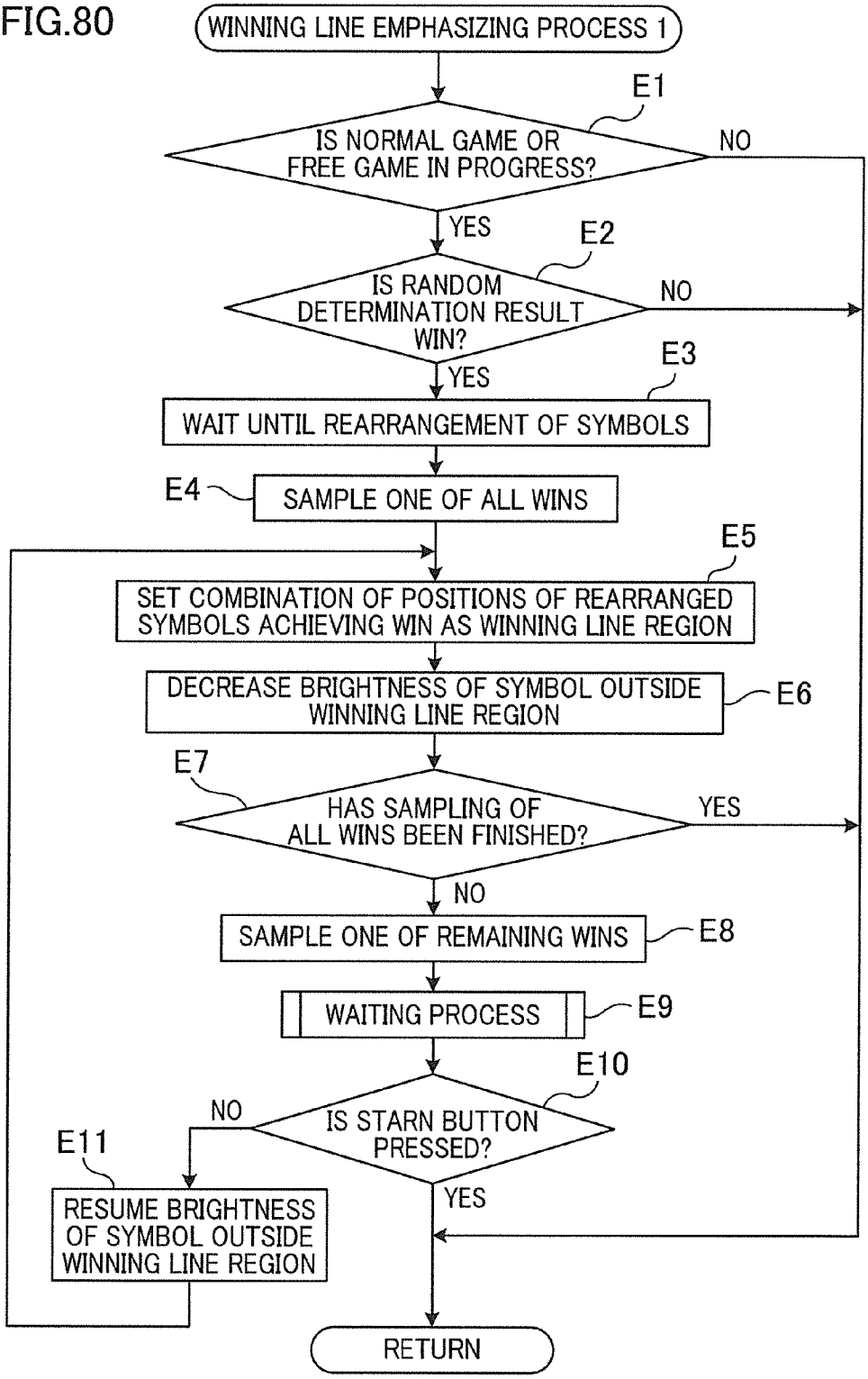
FIG. 80 is a flowchart of a winning line emphasizing process 1 of the slot machine of the embodiment of the present invention.

The steps (A1) to (A5) described in the outline of the gaming machine will be detailed. When the gaming machine is powered on and the initial setting is completed, a winning line emphasizing process 1 shown in FIG. 80 is executed in an interrupting manner at regular intervals, during the game or when waiting for the start of the game.

To begin with, whether the normal game or the free game is in progress is determined (i.e., whether a game is in progress is determined) (E1). When no game is in progress (E1: NO), the routine is terminated. In the meanwhile, when a game is in progress (E1: YES), whether a result of random determination is winning (i.e., whether a combination of symbols rearranged on a payline in the symbol display region 4 is identical with a combination with which a benefit is awarded) is determined (E2). When the result of random determination is not a win (E2: NO), the routine is terminated. On the other hand, when the result of random determination is a win (E2: YES), the rearrangement of symbols is waited for (E3). Then one of the all wins is sampled (E4).

Subsequently, the combination of the positions of the rearranged symbols achieving the win is set as a winning line region (E5). The brightness of a symbol outside the winning line region is lowered (E6). Whether all wins have already been sampled is determined (E7). When the sampling is completed (E7: YES), the routine is terminated. When not completed (E7: NO), one of the remaining winnings is sampled (E8). As the elapse of the predetermined time is waited in the waiting process, the state of emphasizing the winning line region by changing the brightness in E6 is continued (E9).

Thereafter, whether the start button is pressed is determined (E10). When the start button is pressed (E10: YES), the routine is terminated. On the other hand, when the start button is not pressed (E10: NO), the brightness of the symbol outside the winning line region is restored (E11), and the process is executed again from E5.

Figure 84A:
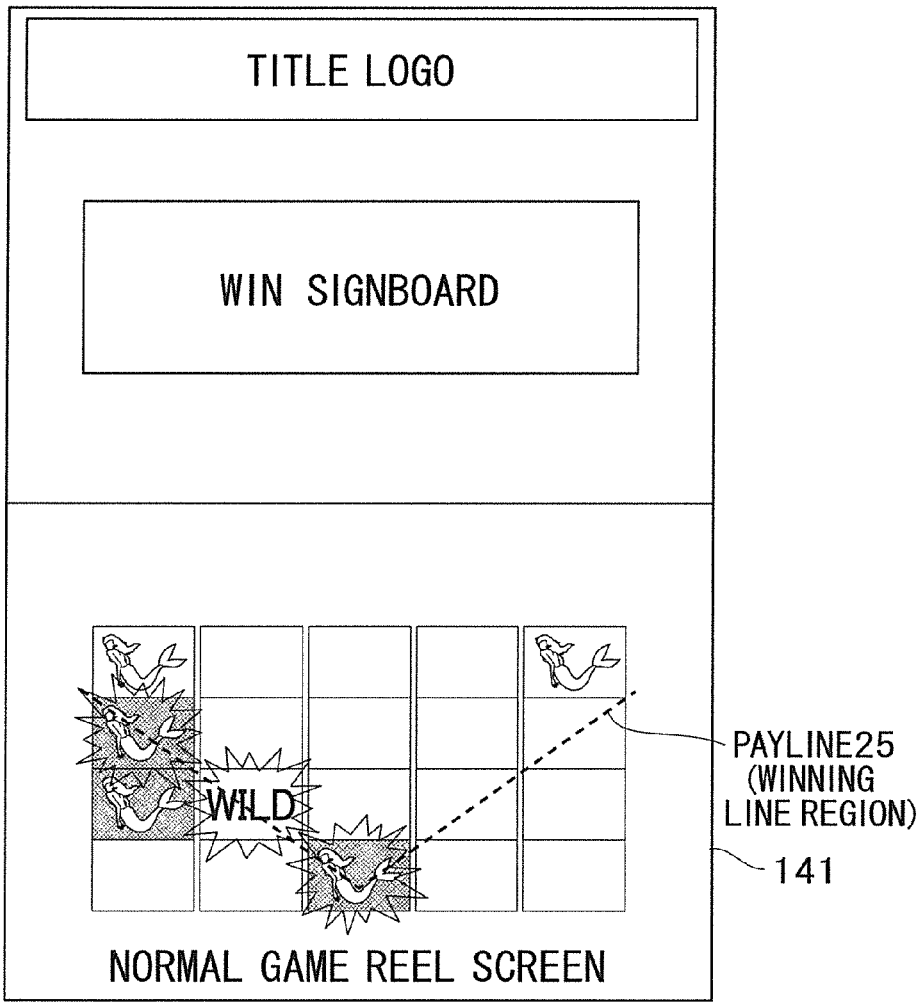
FIG. 84A illustrates the display state of the winning line region of the slot machine of the embodiment of the present invention.
Figure 84B:
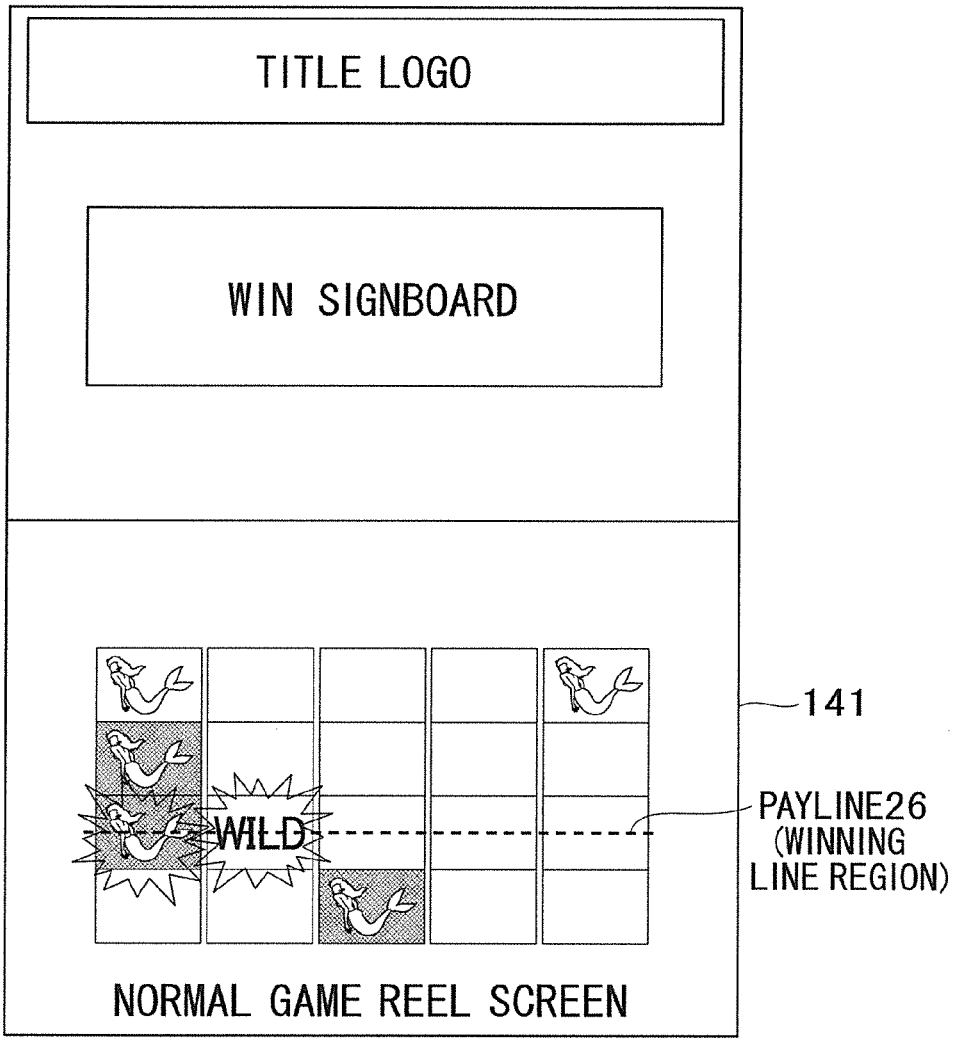
FIG. 84B illustrates the display state of the winning line region of the slot machine of the embodiment of the present invention.

Therefore, when, for example, two wins simultaneously occur as in FIG. 84A and FIG. 84B, as the brightness of one winning line region is arranged to be relatively higher than the brightness of the other winning line region, a first emphasizing effect of emphasizing the one winning line region and a second emphasizing effect of emphasizing the other winning line region are alternated at predetermined intervals. As a result, even when plural serial symbols are regarded as a single serial symbol, the player is able to recognize which serial symbol is in the winning line region or outside the winning line region. In other words, the player can easily recognize which part of the serial symbols achieve the win. It is noted that the stars in the figures indicate relatively high brightness.

Figure 81:
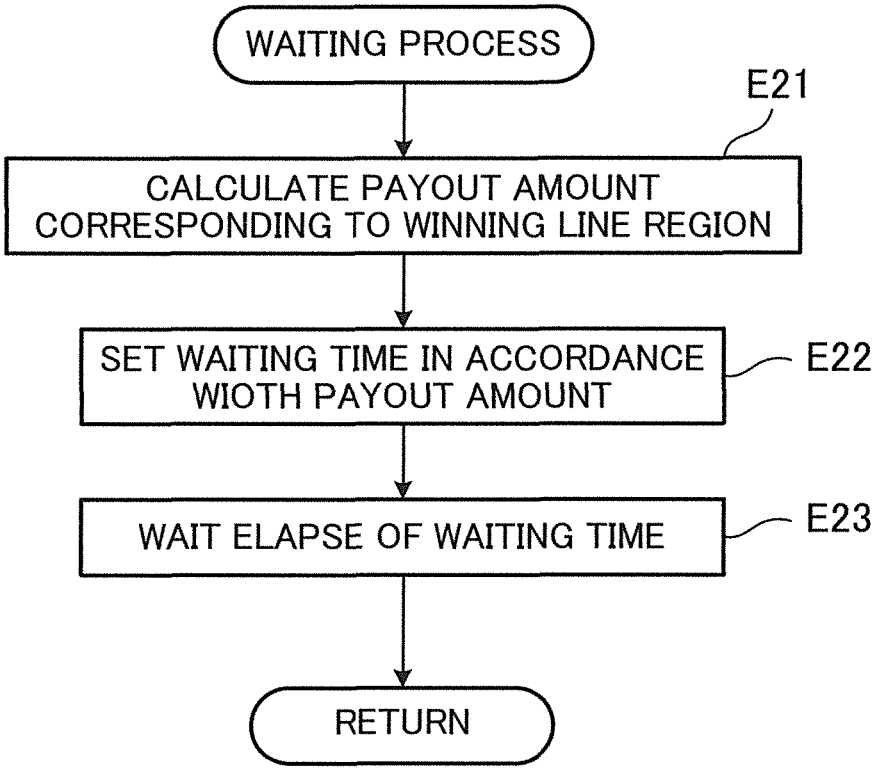
FIG. 81 is a flowchart of a waiting process of the slot machine of the embodiment of the present invention.

The waiting time in the waiting process may be a predetermined time or may be randomly determined each time the waiting process starts. The waiting time may be determined in accordance with the payout amount corresponding to the winning line region. That is to say, as shown in FIG. 81, after the payout amount corresponding to the winning line region is calculated (E21), the waiting time corresponding to this payout amount is set (S22). Then the process is on standby until this waiting time elapses (E23). In this case, for example, when the payout amount is arranged to be in proportion to the waiting time, the player is able to easily recognize which winning results in the largest payout among plural winnings, with reference to the time of emphasizing each winning line region.

Furthermore, in addition to the difference between the winning line region and the outside of the winning line region in brightness, a display state indicated by a combination of at least one of color, blinking, and mark display may be changed in accordance with the payout amount of the winning line region.

<Winning Line Emphasizing Process 2>

Figure 82:
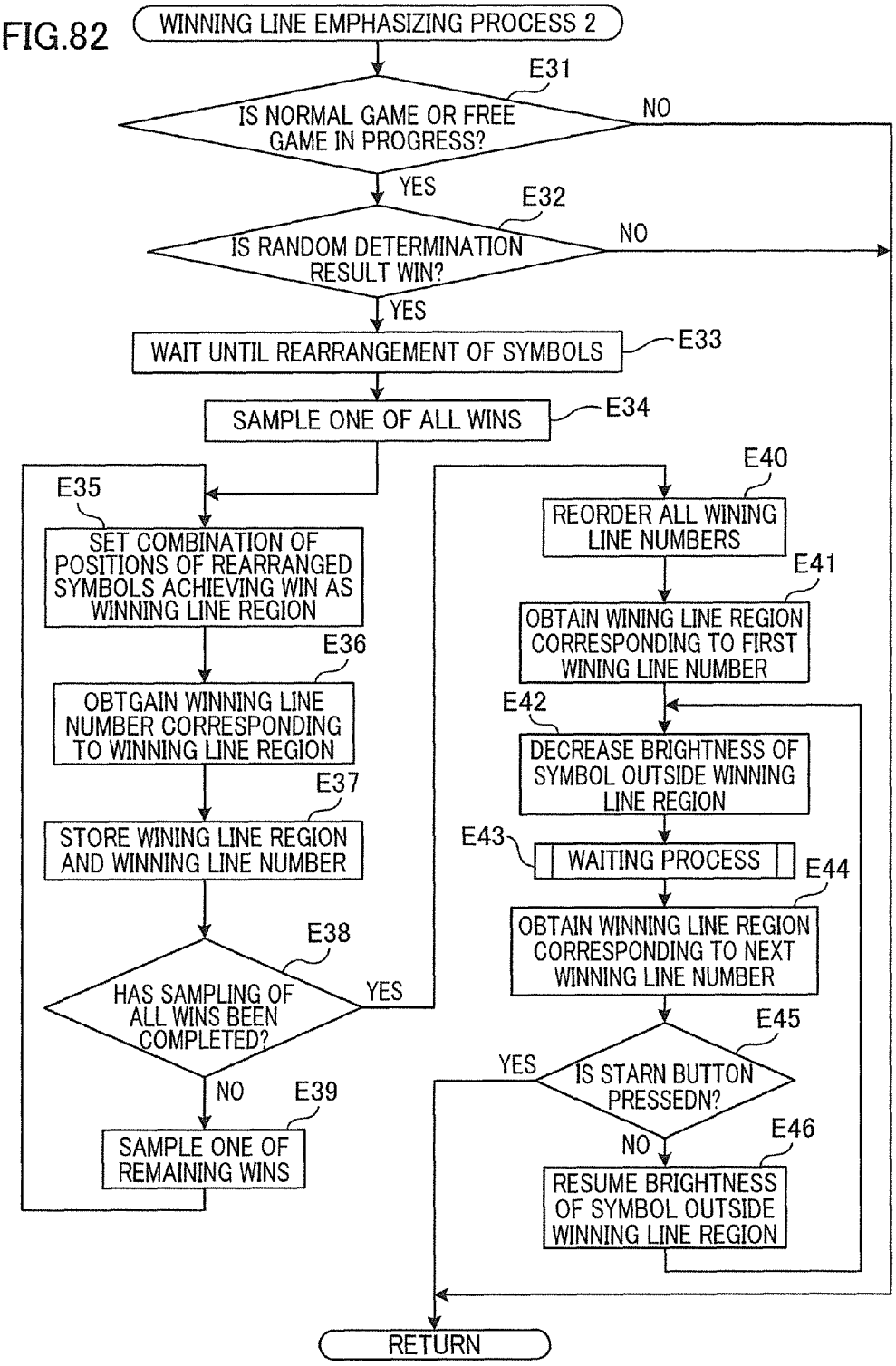
FIG. 82 is a flowchart of a winning line emphasizing process 2 of the slot machine of the embodiment of the present invention.

Now, the steps (A1) to (A4) and (A6) mentioned in the outline of the gaming machine will be detailed. As the gaming machine is powered on and the initial setting is completed, a winning line emphasizing process 2 shown in FIG. 82 is executed in an interrupting manner at regular intervals, during the game or when waiting for the start of the game.

To begin with, whether one of the normal game and the free game is in progress is determined (E31). When no game is in progress (E31: NO), the routine is terminated. In the meanwhile, when a game is in progress (E32: YES), whether a result of random determination is a win is determined (E32). When the result of random determination is not a win (E32: NO), the routine is terminated. In the meanwhile, when the result of random determination is a win (E32: YES), the rearrangement of symbols is waited for (E33). Then one of all wins is sampled (E34).

Subsequently, the combination of the positions of the rearranged symbols achieving the winning is set as a winning line region (E35). Then a winning line number corresponding to the winning line region is obtained based on a later-described winning line table shown in FIG. 83 (E36). The winning line region and the winning line number are stored (S37). Whether the sampling of all wins has already been completed is determined (E38). When not completed (E38: NO), one of the remaining wins is sampled (E39), and the process is executed again from E35.

When the sampling of all wins has been completed (E38: YES), all winning line numbers are re-ordered in an ascending order or a descending order (E40). Then the winning line region corresponding to the first winning line number is obtained (E41), and the brightness of the symbol outside this winning line region is lowered (E42). As the elapse of the predetermined time is waited in the waiting process, the state of emphasizing the winning line region is continued (E43).

Then whether the start button is pressed is determined (E45). When the start button is pressed (E45: YES), the routine is terminated. On the other hand, when the start button is not pressed (E45: NO), the brightness of the symbol outside the winning line region is resumed (E46), and the process is executed again from E42.

Figure 85A:
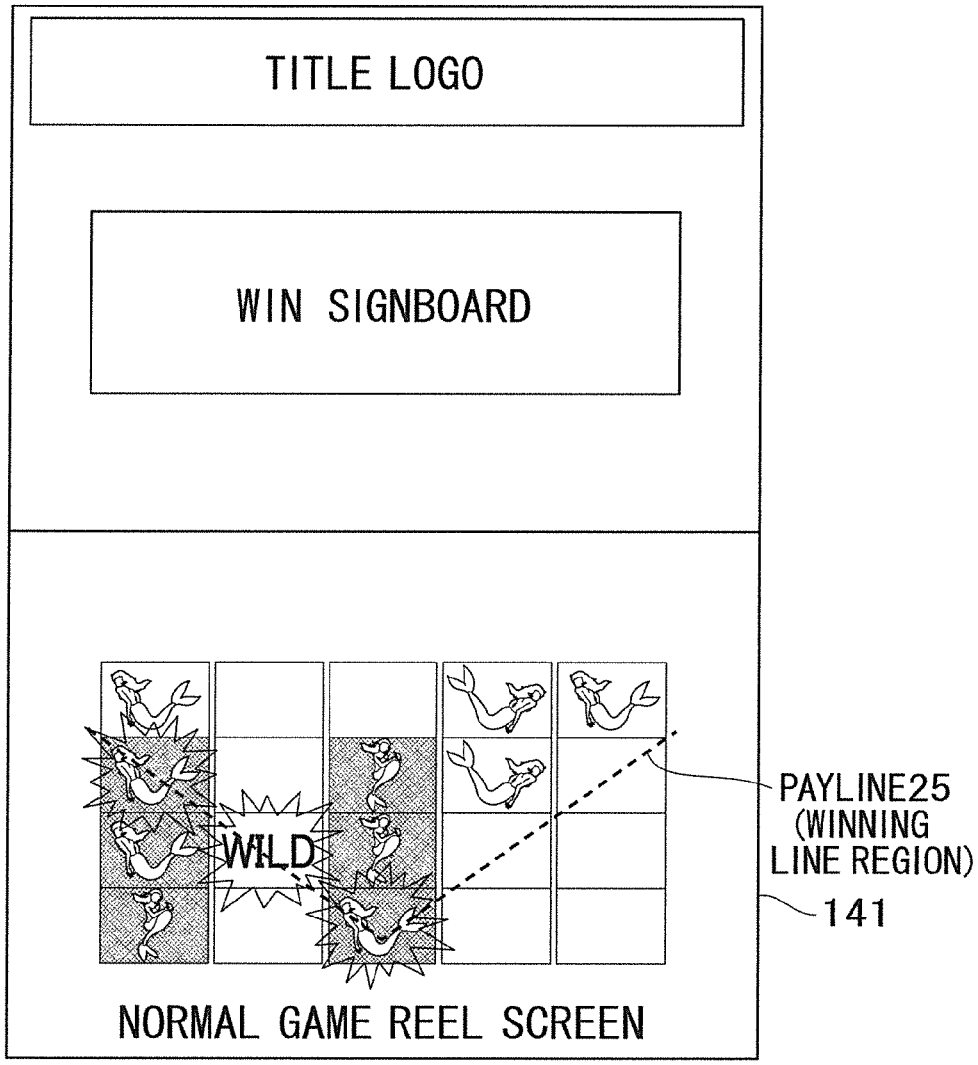
FIG. 85A illustrates the display state of the winning line region of the slot machine of the embodiment of the present invention.
Figure 85B:
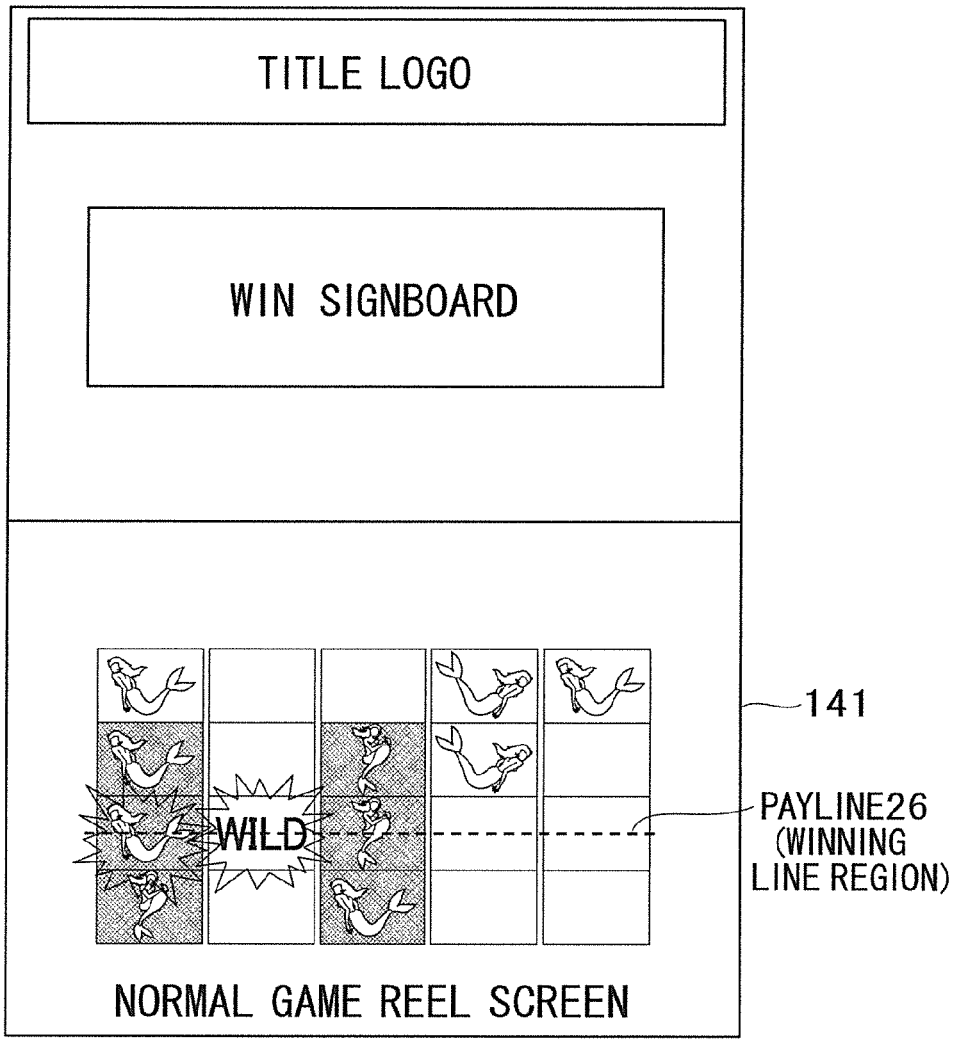
FIG. 85B illustrates the display state of the winning line region of the slot machine of the embodiment of the present invention.
Figure 85C:
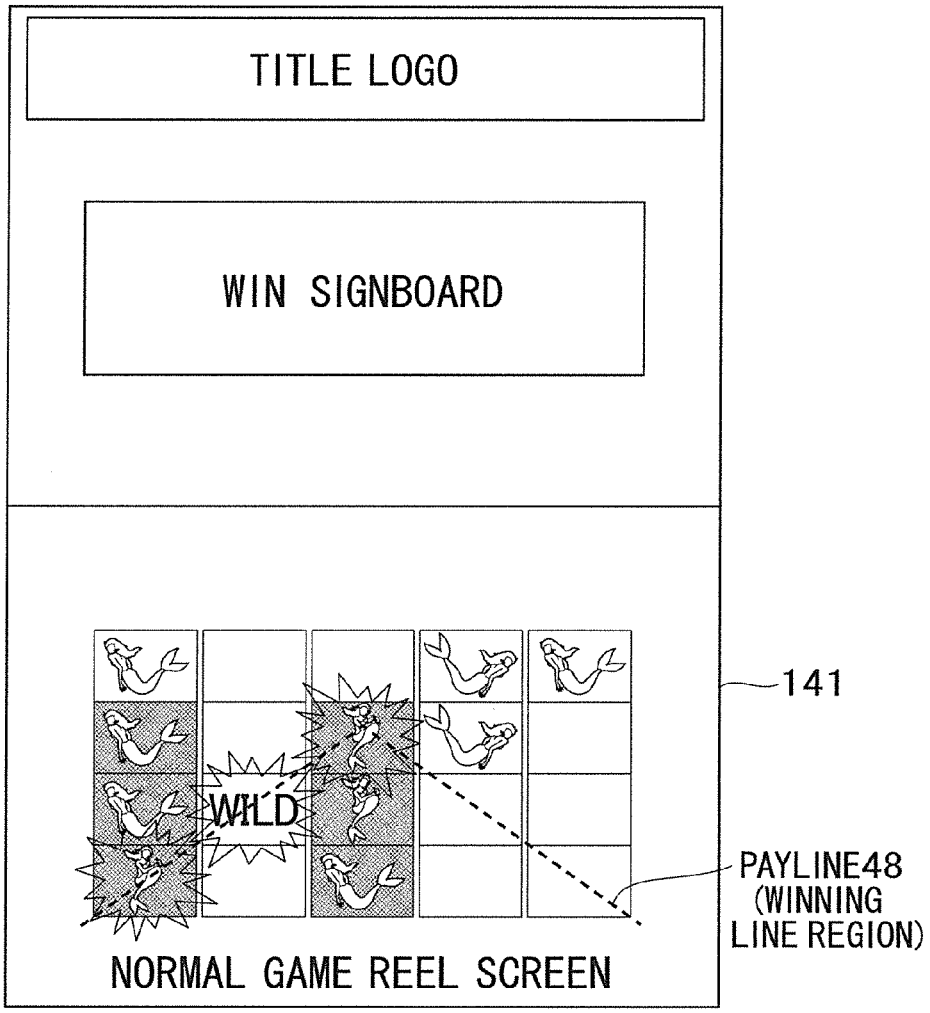
FIG. 85C illustrates the display state of the winning line region of the slot machine of the embodiment of the present invention.
Figure 85D:
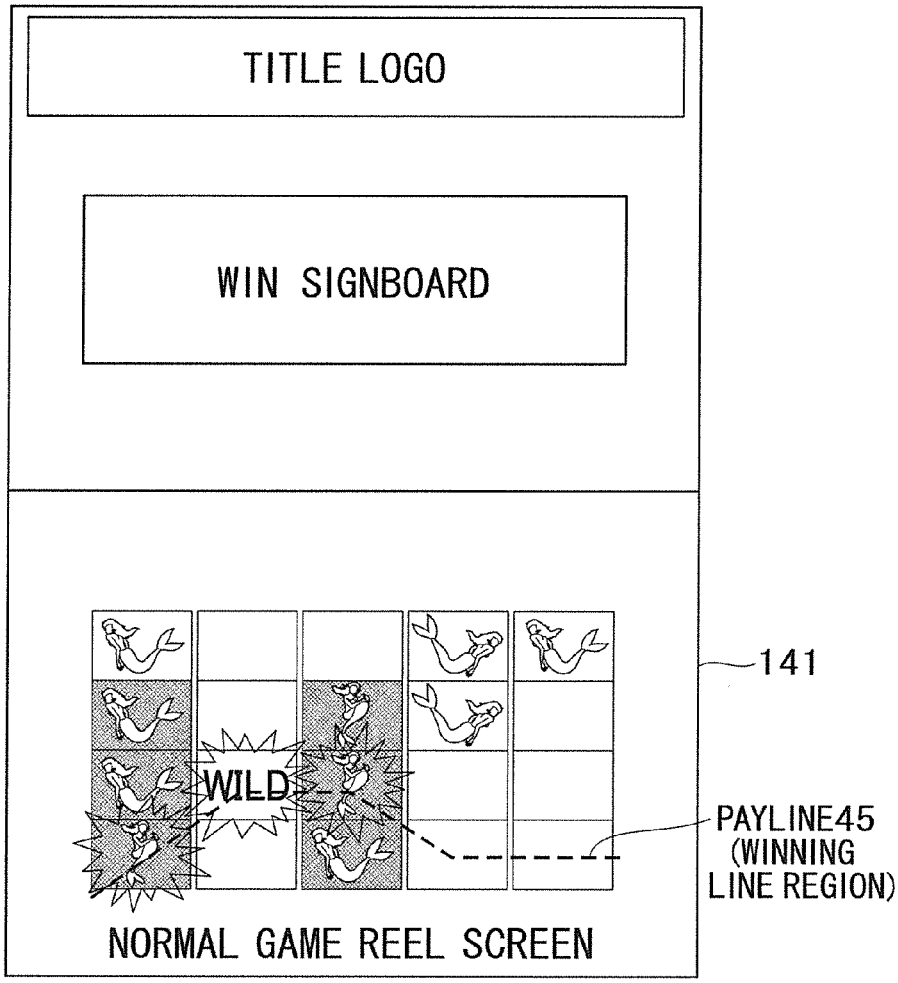
FIG. 85D illustrates the display state of the winning line region of the slot machine of the embodiment of the present invention.

Therefore, when, for example, two winnings simultaneously occur as in FIG. 85A and FIG. 85B, as the brightness of one winning line region is arranged to be relatively higher than the brightness of the other winning line region, the operation of emphasizing the one winning line region is repeated in the order of the winning line numbers rearranged in the ascending or descending order. As a result, when plural serial symbols are regarded as a single serial symbol, the player is able to recognize which serial symbol is in the winning line region or outside the winning line region. In other words, the player can easily recognize which part of the serial symbols achieve the win.

When there are plural types of wins, the difference between the winning line region and the outside of the winning line region in brightness may be changed in accordance with each type of wins. Furthermore, in addition to the brightness, a display state indicated by a combination of at least one of color, blinking, and mark display may be changed in accordance with each type of wins. Furthermore, wins of the same type may be distinguished from one another by a difference in the waiting time, whereas wins of different types may be distinguished from one another by display states other than the brightness. This makes it possible to distinguish all wins from one another by brightness and display states other than the brightness.

(Winning Line Table)

As shown in FIG. 83, the winning line table includes winning line number rows and winning line region columns, and is referred to in the winning line emphasizing process 1 and the winning line emphasizing process 2. The winning line numbers are integers from 1 to 50. There are 50 types of winning line regions corresponding to the respective winning line numbers. In the winning line table, the waiting time referred to in the waiting process shown in FIG. 81 may be set for each winning line number. Furthermore, in the winning line table, a brightness decrease amount which is referred to when the brightness outside the winning line region is lowered may be set for each winning line number.

[Other Notes]

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process executed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A gaming machine executing a normal game and a free game shifted from the normal game, the gaming machine comprising:

a storage configured to store a normal game video reel group which is used in the normal game and free game video reel groups which are different from one another in layout of symbols and are used in the free game;

a display device configured to display a game result by rearranging the normal game video reel group and the free game video reel groups;

an input device configured to receive an input from a player; and a controller, the controller being programmed to execute the processes of:

(1A) as the normal game, randomly determining which symbols laid out on the normal game video reel group are to be rearranged on the display device;

(1B) rearranging the symbols determined in the process (1A) on the display device and awarding a benefit in accordance with a combination of the rearranged symbols;

(1C) when the awarded benefit is a right to execute the free game, randomly associating the free game video reel groups with options displayed on the display device, respectively;

(1D) by the input device, receiving an input indicating which one of the options displayed on the display device is selected;

(1E) determining the video reel group associated with the option selected by the input device as a video reel group used in the free game;

(1F) by using the video reel group determined in the process (1E), randomly determining, as the free game, which symbols laid out on the free game video reel group are to be rearranged on the display device, rearranging the determined symbols on the display device, and awarding a benefit of the free game in accordance with a combination of the rearranged symbols;

(1G) after repeating the process (1F) for a predetermined number of times, randomly determining whether to award the right to execute the free game as the benefit again;

(1H) when it is determined in the process (1G) that the right to execute the free game is awarded as the benefit, repeating the processes (1C) to (1G); and (1I) when it is determined in the process (1G) that the right to execute the free game is not awarded as the benefit, terminating the free game, wherein, in the free game, expectation for the benefit to be awarded is arranged to be different between the video reel groups to be used, and in the process (1E), expectations of the video reel groups associated with the options in the process (1C) are displayed when the video reel group used in the free game is determined.

2. The gaming machine according to claim 1, wherein, the number of a predetermined symbol laid out on each of the free game video reel groups is larger than the number of the predetermined symbol laid out on the normal game video reel group.

3. A gaming machine executing a normal game and a free game shifted from the normal game, the gaming machine comprising:

a storage configured to store a normal game video reel group which is used in the normal game and free game video reel groups which are different from one another in layout of symbols and are used in the free game;

a display device configured to display a game result by rearranging the normal game video reel group and the free game video reel groups;

an input device configured to receive an input from a player; and a controller, the controller being programmed to execute the processes of:

(1A) as the normal game, randomly determining which symbols laid out on the normal game video reel group are to be rearranged on the display device;

(1B) rearranging the symbols determined in the process (1A) on the display device and awarding a benefit in accordance with a combination of the rearranged symbols;

(1C) when the awarded benefit is a right to execute the free game, randomly associating the free game video reel groups with options displayed on the display device, respectively;

(1D) by the input device, receiving an input indicating which one of the options displayed on the display device is selected;

(1E) determining the video reel group associated with the option selected by the input device as a video reel group used in the free game;

(1F) by using the video reel group determined in the process (1E), randomly determining, as the free game, which symbols laid out on the free game video reel group are to be rearranged on the display device, rearranging the determined symbols on the display device, and awarding a benefit of the free game in accordance with a combination of the rearranged symbols;

(1G) after repeating the process (1F) for a predetermined number of times, randomly determining whether to award the right to execute the free game as the benefit again;

(1H) when it is determined in the process (1G) that the right to execute the free game is awarded as the benefit, repeating the processes (1C) to (1G); and (1I) when it is determined in the process (1G) that the right to execute the free game is not awarded as the benefit, terminating the free game, wherein, in the process (1G), (e1) on the display device, multi-level display regions are provided and a meter is displayed to indicate a display region of a higher level one by one each time a predetermined time elapses or an input is received by the input device, (e2) an effect is performed in such a way that, each time the predetermined time elapses or the input is received by the input device, the meter indicates a display region of a higher level one by one, and (e3) when it is determined in the process (1E) that the right to execute the free game is to be awarded as the benefit, an effect of causing the meter to indicate a display region of a predetermined level is performed and an effect of notifying that the right to execute the free game is to be awarded is performed.

4. The gaming machine according to claim 1, wherein, the symbols laid out on the video reel groups are classified into plural types, and in the process of awarding the benefit, when the combination of the symbols rearranged on the display device is a combination with which the benefit is awarded, an integral effect is performed for symbols which are of the same type and serially rearranged in one video reel group, among the symbols constituting the combination with which the benefit is awarded.

5. A method of controlling a gaming machine executing a normal game and a free game shifted from the normal game, the gaming machine including:

a storage configured to store a normal game video reel group which is used in the normal game and free game video reel groups which are different from one another in layout of symbols and are used in the free game;

a display device configured to display a game result by rearranging the normal game video reel group and the free game video reel groups;

an input device configured to receive an input from a player; and a controller, under the control by the controller, the method comprising the steps of:

(2A) as the normal game, randomly determining which symbols laid out on the normal game video reel group are to be rearranged on the display device;

(2B) rearranging the symbols determined in the step (2A) on the display device and awarding a benefit in accordance with a combination of the rearranged symbols;

(2C) when the awarded benefit is a right to execute the free game, randomly associating the free game video reel groups with options displayed on the display device, respectively;

(2D) by the input device, receiving an input indicating which one of the options displayed on the display device is selected;

(2E) determining the video reel group associated with the option selected by the input device as a video reel group used in the free game;

(2F) by using the video reel group determined in the step (2E), randomly determining, as the free game, which symbols laid out on the free game video reel group are to be rearranged on the display device, rearranging the determined symbols on the display device, and awarding a benefit of the free game in accordance with a combination of the rearranged symbols;

(2G) after repeating the step (2F) for a predetermined number of times, randomly determining whether to award the right to execute the free game as the benefit again;

(2H) when it is determined in the step (2G) that the right to execute the free game is awarded as the benefit, repeating the steps (2C) to (2G); and (2I) when it is determined in the step (2G) that the right to execute the free game is not awarded as the benefit, terminating the free game, wherein, in the free game, expectation for the benefit to be awarded is arranged to be different between the video reel groups to be used, and in the process (2E), expectations of the video reel groups associated with the options in the process (1C) are displayed when the video reel group used in the free game is determined.

6. The gaming machine according to claim 2, wherein, the predetermined symbol is a symbol with which a benefit advantageous for the player is awarded.

7. The gaming machine according to claim 1, wherein, in the free game, the video reel groups to be used are arranged to be different from one another in the maximum payout or minimum payout with respect to the benefit to be awarded.

8. The gaming machine according to claim 1, wherein, in the free game, expectation for the benefit to be awarded is arranged to be different between the video reel groups to be used, and the expectation is either expectation for the benefit when the free game is executed once or expectation for a payout as a result of the execution of the free game for the predetermined number of times awarded as the benefit of the normal game.

9. A gaming machine executing a normal game and a free game shifted from the normal game, the gaming machine comprising:

a storage configured to store a normal game video reel group which is used in the normal game and free game video reel groups which are different from one another in layout of symbols and are used in the free game;

a display device configured to display a game result by rearranging the normal game video reel group and the free game video reel groups;

an input device configured to receive an input from a player; and a controller, the controller being programmed to execute the processes of:

(1A) as the normal game, randomly determining which symbols laid out on the normal game video reel group are to be rearranged on the display device;

(1B) rearranging the symbols determined in the process (1A) on the display device and awarding a benefit in accordance with a combination of the rearranged symbols;

(1C) when the awarded benefit is a right to execute the free game, randomly associating the free game video reel groups with options displayed on the display device, respectively;

(1D) by the input device, receiving an input indicating which one of the options displayed on the display device is selected;

(1E) determining the video reel group associated with the option selected by the input device as a video reel group used in the free game;

(1F) by using the video reel group determined in the process (1E), randomly determining, as the free game, which symbols laid out on the free game video reel group are to be rearranged on the display device, rearranging the determined symbols on the display device, and awarding a benefit of the free game in accordance with a combination of the rearranged symbols;

(1G) after repeating the process (1F) for a predetermined number of times, randomly determining whether to award the right to execute the free game as the benefit again;

(1H) when it is determined in the process (1G) that the right to execute the free game is awarded as the benefit, repeating the processes (1C) to (1G); and (1I) when it is determined in the process (1G) that the right to execute the free game is not awarded as the benefit, terminating the free game, wherein, predetermined symbols are serially laid out on the normal game video reel group and the free game video reel groups, and the number of the predetermined symbols serially laid out on each of the free game video reel groups is arranged to be larger than the number of the predetermined symbols serially laid out on the normal game video reel group.

* * * * *